US010625933B2

(12) United States Patent
Pham

(10) Patent No.: US 10,625,933 B2
(45) Date of Patent: Apr. 21, 2020

(54) SYSTEM AND METHOD FOR DELIVERY OF OILFIELD MATERIALS

(71) Applicant: SCHLUMBERGER TECHNOLOGY CORPORATION, Sugar Land, TX (US)

(72) Inventor: Hau Nguyen-Phuc Pham, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/215,052

(22) Filed: Dec. 10, 2018

(65) Prior Publication Data

US 2019/0106274 A1 Apr. 11, 2019

Related U.S. Application Data

(60) Division of application No. 14/318,095, filed on Jun. 27, 2014, now Pat. No. 10,150,612, which is a (Continued)

(51) Int. Cl.
*E04H 7/22* (2006.01)
*B65D 88/30* (2006.01)
(Continued)

(52) U.S. Cl.
CPC ..... *B65D 88/30* (2013.01); *B65D 88/32* (2013.01); *B65D 88/54* (2013.01); *B65D 90/12* (2013.01); *B65D 90/48* (2013.01); *E04H 7/22* (2013.01)

(58) Field of Classification Search
CPC ..... B65D 88/30; B65D 90/48; B65D 90/12; B65D 88/32; B65D 88/54; B65D 90/16; B65D 90/14; E04H 7/22
See application file for complete search history.

(56) References Cited

U.S. PATENT DOCUMENTS 559,965 A 5/1896 Bierstadt
896,233 A 8/1908 McQueen
(Continued)

FOREIGN PATENT DOCUMENTS

CA 2643743 C 4/2011
CN 2601189 Y 1/2004
(Continued)

OTHER PUBLICATIONS

Examination Report dated Dec. 19, 2018 in corresponding AU Application No. 2015259393; 4 pages.
(Continued)

*Primary Examiner* — Brent W Herring
(74) *Attorney, Agent, or Firm* — Cathy Hewitt

(57) ABSTRACT

A system and methodology facilitates the handling of oilfield material. The oilfield material is stored in at least one silo which enables use of gravity to feed the oilfield material to a blender or other suitable equipment. Each modular silo is transportable and may be engaged with a support structure via a pivot connection. Once engaged, the silo is pivoted to a raised, upright position on the support structure. The oilfield material is then moved to an interior of the silo, and gravity may be used to feed the oilfield material to a blender or other equipment in a controlled manner.

6 Claims, 39 Drawing Sheets

Related U.S. Application Data continuation-in-part of application No. PCT/US2013/054287, filed on Aug. 9, 2013.

(51) Int. Cl.

| | |
|---|---|
| ***B65D 88/54*** | (2006.01) |
| ***B65D 88/32*** | (2006.01) |
| ***B65D 90/12*** | (2006.01) |
| ***B65D 90/48*** | (2006.01) |

(56) References Cited

U.S. PATENT DOCUMENTS 1,526,527 A 2/1925 Butler
1,560,826 A 11/1925 Kirschbraun
1,576,940 A 3/1926 Warner
2,073,652 A 3/1936 Robb
2,099,898 A 11/1937 Larkin
2,357,583 A * 9/1944 Franco ..... E04G 21/04 187/225
2,735,839 A 2/1956 Schrenk
2,774,497 A 12/1956 Martin
2,792,262 A 5/1957 Hathorn
2,858,950 A 11/1958 Martin
3,155,248 A 11/1964 Haller
3,170,560 A 2/1965 Obmascher
3,208,616 A 9/1965 Haskins
3,263,436 A 8/1966 Goldfarb
3,314,557 A 4/1967 Sackett
3,394,961 A 7/1968 Matte
3,451,986 A 6/1969 Metais
3,490,632 A * 1/1970 McKinney ..... B60P 1/64 414/332
3,497,327 A 2/1970 Kehse
3,560,053 A 2/1971 Ortloff
3,618,801 A 11/1971 Blanchard
3,666,129 A 5/1972 Haskins
3,687,319 A 8/1972 Adam et al.
3,743,108 A 7/1973 Visser
3,756,443 A 9/1973 Verschage et al.
3,787,479 A 1/1974 Oriehl et al.
3,842,910 A 10/1974 Zingg et al.
3,883,019 A 5/1975 Hansen, Jr.
3,883,148 A * 5/1975 Miller ..... B60P 3/221 105/358
3,894,645 A 7/1975 Verschage
3,938,673 A 2/1976 Perry, Jr.
3,974,602 A 8/1976 Pohl et al.
3,985,254 A * 10/1976 Grandury ..... B60P 1/64 414/498
3,998,433 A 12/1976 Iwako
4,026,441 A * 5/1977 Jones ..... E04D 15/07 222/609
4,077,612 A 3/1978 Ricciardi
4,079,150 A 3/1978 Beck et al.
4,090,623 A * 5/1978 Noyon ..... B60P 1/6418 414/391
4,103,793 A 8/1978 Weaver
4,111,314 A * 9/1978 Nelson ..... B65D 88/30 414/787
4,187,047 A * 2/1980 Squifflet, Sr. ..... B60P 1/64 414/332
4,209,278 A 6/1980 Cooper et al.
4,222,498 A 9/1980 Brock
4,248,359 A * 2/1981 Brock ..... B65G 41/002 222/160
4,249,848 A * 2/1981 Griffin ..... B65D 88/30 414/332
4,268,208 A 5/1981 Hankins et al.
4,337,014 A 6/1982 Farnham
4,348,146 A 9/1982 Brock
4,373,857 A 2/1983 Giles
4,375,343 A 3/1983 Butler
4,400,126 A 8/1983 Desourdy
4,427,133 A 1/1984 Kierbow et al.
4,453,829 A 6/1984 Althouse, III
4,465,420 A 8/1984 Dillman
4,561,821 A 12/1985 Dillman
4,579,496 A 4/1986 Gerlach
4,601,628 A 7/1986 Lowing
4,621,972 A 11/1986 Grotte
4,626,166 A * 12/1986 Jolly ..... B60P 1/64 298/19 R
4,671,665 A 6/1987 McIntire
4,701,095 A 10/1987 Berryman et al.
4,775,275 A 10/1988 Perry
4,808,004 A 2/1989 McIntire et al.
4,832,561 A 5/1989 Nijenhuis
4,850,750 A 7/1989 Cogbill et al.
4,855,960 A 8/1989 Janssen et al.
4,883,363 A 11/1989 Pillon et al.
4,899,832 A 2/1990 Bierscheid, Jr.
4,907,712 A 3/1990 Stempin
4,917,560 A * 4/1990 Murray ..... B65D 88/30 414/21
4,925,358 A 5/1990 Cook
4,944,646 A 7/1990 Edwards et al.
5,006,034 A 4/1991 Bragg et al.
5,018,932 A 5/1991 Croisier
5,035,269 A 7/1991 Pytryga et al.
5,046,856 A 9/1991 McIntire
5,052,486 A 10/1991 Wilson
5,121,989 A 6/1992 Horton et al.
5,190,374 A 3/1993 Harms et al.
5,195,861 A 3/1993 Handke
5,201,498 A * 4/1993 Akins ..... A01K 3/00 119/502
5,236,261 A * 8/1993 Hagenbuch ..... B65D 88/30 222/503
5,339,996 A 8/1994 Dubbert et al.
5,362,193 A 11/1994 Milstead
5,382,411 A 1/1995 Allen
5,387,736 A 2/1995 Salomone et al.
5,413,154 A 5/1995 Hurst, Jr. et al.
5,426,137 A 6/1995 Allen
5,427,497 A 6/1995 Dillman
5,667,298 A 9/1997 Musil et al.
5,775,713 A 7/1998 Peterson et al.
5,777,234 A 7/1998 Kosmal
5,785,421 A 7/1998 Milek
5,795,062 A 8/1998 Johnson
5,822,930 A 10/1998 Klein
6,000,840 A 12/1999 Paterson
6,050,743 A * 4/2000 Medinger ..... A01C 15/006 111/178
6,186,195 B1 2/2001 Anstotz
6,186,654 B1 * 2/2001 Gunteret, Jr. ..... B01F 5/265 366/18
6,193,402 B1 2/2001 Grimland et al.
6,286,986 B2 9/2001 Grimland et al.
6,293,689 B1 * 9/2001 Guntert, Jr. ..... B28C 7/0495 366/2
6,447,674 B1 * 9/2002 Simon ..... G01G 13/024 177/105
6,474,926 B2 * 11/2002 Weiss ..... B28C 7/0495 414/332
6,491,421 B2 12/2002 Rondeau et al.
6,527,428 B2 * 3/2003 Guntert, Jr. ..... B28C 7/0495 366/2
6,832,851 B1 12/2004 von Wilcken
6,939,031 B2 9/2005 Pham et al.
6,948,535 B2 9/2005 Stegemoeller
7,048,432 B2 5/2006 Phillippi et al.
7,104,328 B2 9/2006 Phillippi et al.
7,214,028 B2 5/2007 Boasso et al.
7,258,522 B2 8/2007 Pham et al.
7,308,953 B2 * 12/2007 Barnes ..... E21B 7/02 175/122
7,419,296 B2 9/2008 Allen
7,540,308 B2 6/2009 Pessin et al.
7,614,451 B2 11/2009 Blaschke et al.
7,703,518 B2 4/2010 Phillippi et al.
7,815,222 B2 10/2010 Markham

(56) References Cited

U.S. PATENT DOCUMENTS 7,836,949 B2 11/2010 Dykstra
7,837,427 B2 11/2010 Beckel et al.
7,841,394 B2 11/2010 McNeel et al.
7,845,413 B2 12/2010 Shampine et al.
7,866,881 B2 1/2011 El Kholy et al.
7,921,914 B2 4/2011 Bruins et al.
7,926,564 B2 4/2011 Phillippi et al.
7,931,088 B2 4/2011 Stegemoeller et al.
8,066,955 B2 11/2011 Pinchot
8,083,083 B1 12/2011 Mohns
8,127,844 B2 3/2012 Luharuka et al.
8,137,051 B2 3/2012 Glenn et al.
8,142,134 B2 3/2012 Lavoie et al.
8,146,665 B2 4/2012 Neal
8,313,269 B2 11/2012 Fisher et al.
8,354,602 B2 1/2013 Lucas et al.
8,585,341 B1 11/2013 Oren et al.
8,651,792 B2 2/2014 Friesen
8,661,743 B2 3/2014 Flusche
8,726,584 B1 * 5/2014 Nolte ..... E04H 1/12 52/122.1
8,734,081 B2 5/2014 Stegemoeller et al.
8,834,012 B2 9/2014 Case et al.
8,926,252 B2 1/2015 McIver et al.
8,931,996 B2 1/2015 Friesen et al.
8,944,740 B2 2/2015 Teichrob et al.
9,017,001 B1 4/2015 Dueck
9,097,033 B2 8/2015 Margevicius et al.
9,457,335 B2 10/2016 Pham et al.
9,475,029 B2 10/2016 McSpadden et al.
9,663,303 B2 5/2017 Waldner et al.
9,688,178 B2 * 6/2017 Pham ..... B65G 67/30
9,862,538 B2 * 1/2018 Pham ..... B65D 88/30
2002/0034120 A1 * 3/2002 Guntert, Jr. ..... B28C 7/0495 366/2
2002/0147370 A1 10/2002 Hinz et al.
2003/0150494 A1 8/2003 Morgan et al.
2003/0161212 A1 8/2003 Neal et al.
2003/0196809 A1 10/2003 Willberg et al.
2003/0202869 A1 10/2003 Posch
2003/0227817 A1 12/2003 Martel et al.
2004/0008571 A1 1/2004 Coody et al.
2004/0209780 A1 10/2004 Harris et al.
2004/0256106 A1 12/2004 Phillippi et al.
2005/0028979 A1 2/2005 Brannon et al.
2005/0067351 A1 3/2005 Graham
2005/0091941 A1 * 5/2005 Baird ..... B66F 11/04 52/633
2005/0123385 A1 6/2005 Kirsch
2005/0201197 A1 9/2005 Duell et al.
2006/0028914 A1 2/2006 Phillippi et al.
2006/0065400 A1 3/2006 Smith
2006/0107998 A1 5/2006 Kholy et al.
2006/0289166 A1 12/2006 Stromquist et al.
2007/0014653 A1 1/2007 Glenn et al.
2007/0114035 A1 5/2007 Parris et al.
2007/0179326 A1 8/2007 Baker
2007/0201305 A1 8/2007 Heilman et al.
2008/0008562 A1 1/2008 Beckel et al.
2008/0066911 A1 3/2008 Luharuka et al.
2008/0073895 A1 3/2008 Herman et al.
2008/0179054 A1 * 7/2008 McGough ..... E21B 43/26 166/250.14
2008/0264641 A1 10/2008 Slabaugh et al.
2009/0078410 A1 3/2009 Krenek et al.
2009/0078792 A1 3/2009 Vlasak
2010/0038077 A1 2/2010 Heilman et al.
2010/0071284 A1 * 3/2010 Hagan ..... B65D 88/30 52/192
2010/0188926 A1 7/2010 Stegemoeller et al.
2010/0243251 A1 9/2010 Luharuka et al.
2010/0243252 A1 9/2010 Luharuka et al.
2010/0243255 A1 9/2010 Luharuka et al.
2010/0278621 A1 * 11/2010 Redekop ..... B65D 88/30 414/523
2010/0319921 A1 12/2010 Eia et al.
2010/0329072 A1 12/2010 Hagan et al.
2011/0003720 A1 1/2011 Sullivan
2011/0061855 A1 3/2011 Case et al.
2011/0063942 A1 3/2011 Hagan et al.
2011/0127178 A1 * 6/2011 Claussen ..... B65D 88/26 206/216
2011/0197536 A1 * 8/2011 Clark ..... E04F 10/08 52/650.1
2011/0255941 A1 * 10/2011 Friesen ..... B65D 88/30 414/288
2012/0024738 A1 2/2012 Herman et al.
2012/0048537 A1 3/2012 Rettie et al.
2012/0099954 A1 * 4/2012 Teichrob ..... B65G 63/008 414/332
2012/0127820 A1 5/2012 Noles, Jr.
2012/0127822 A1 5/2012 Noles, Jr.
2012/0128449 A1 5/2012 Fikes et al.
2012/0134772 A1 * 5/2012 Herman ..... B60P 1/6463 414/808
2012/0167485 A1 * 7/2012 Trevithick ..... E21B 15/00 52/112
2012/0219391 A1 8/2012 Teichrob et al.
2012/0255734 A1 10/2012 Coli et al.
2012/0273206 A1 11/2012 Zamora et al.
2012/0298210 A1 11/2012 Pham et al.
2013/0105166 A1 5/2013 Medvedev et al.
2013/0150268 A1 6/2013 Oldham
2013/0269735 A1 * 10/2013 Roetzel ..... E21B 21/062 134/40
2013/0288934 A1 10/2013 Powell et al.
2013/0309052 A1 11/2013 Luharuka et al.
2013/0324444 A1 12/2013 Lesko et al.
2014/0041317 A1 2/2014 Pham et al.
2014/0041319 A1 2/2014 Pham et al.
2014/0041322 A1 2/2014 Pham et al.
2014/0044508 A1 2/2014 Luharuka et al.
2014/0093339 A1 * 4/2014 Friesen ..... B65D 88/30 414/288
2014/0166647 A1 * 6/2014 Sheesley ..... B65D 90/66 220/1.5
2014/0255265 A1 9/2014 Kulkarni et al.
2015/0044003 A1 * 2/2015 Pham ..... B65D 88/32 414/332
2015/0044004 A1 2/2015 Pham et al.
2015/0064077 A1 3/2015 McSpadden et al.
2015/0166135 A1 * 6/2015 Pham ..... B65G 67/30 414/812
2015/0166260 A1 6/2015 Pham et al.
2015/0238912 A1 8/2015 Luharuka et al.
2015/0238913 A1 8/2015 Luharuka et al.
2015/0238914 A1 8/2015 Luharuka et al.
2015/0240148 A1 8/2015 Luharuka et al.
2016/0129418 A1 5/2016 Pham et al.
2016/0130924 A1 5/2016 Pham et al.
2017/0327309 A1 * 11/2017 Hunter ..... B65D 88/30

FOREIGN PATENT DOCUMENTS

CN 2693601 Y 4/2005
CN 101434836 A 5/2009
CN 201317413 Y 9/2009
CN 201458370 U 5/2010
CN 201610285 U 10/2010
CN 202398329 U 8/2012
CN 202506322 U 10/2012
CN 203486442 U 3/2014
CN 103721619 A 4/2014
CN 204109871 U 1/2015
EP 0048312 A1 3/1982
EP 0241056 A1 10/1987
EP 2609999 A1 7/2013
FR 2655007 A1 5/1991
JP S5715828 A 1/1982
JP S57015828 A 1/1982
KR 100589613 B1 6/2006

(56) References Cited

FOREIGN PATENT DOCUMENTS

| | | | |
|---|---|---|---|
| RU | 10418 | U1 | 7/1999 |
| RU | 2228842 | C2 | 1/2004 |
| SU | 1341161 | A1 | 9/1987 |
| WO | 8500046 | A1 | 1/1985 |
| WO | 1985000046 | | 1/1985 |
| WO | 0244517 | A1 | 6/2002 |
| WO | 03087182 | A2 | 10/2003 |
| WO | 2007022300 | A2 | 2/2007 |
| WO | 2007098606 | A1 | 9/2007 |
| WO | 2010070599 | A1 | 6/2010 |
| WO | 2011061503 | A1 | 5/2011 |
| WO | 2011088493 | A1 | 7/2011 |
| WO | 2012121896 | A2 | 9/2012 |
| WO | 2012166590 | A1 | 12/2012 |
| WO | 2013099826 | A1 | 7/2013 |
| WO | 2013134624 | A1 | 9/2013 |
| WO | 2014028317 | A1 | 2/2014 |

OTHER PUBLICATIONS

Office Action issued in Chinese Patent Appl. No. 201580036796.9 dated Oct. 25, 2018; 29 pages (with English translation).
Office Action issued in Russian Patent Appl. No. 2015117758 dated Dec. 5, 2018; 13 pages (with English translation).
Office Action issued in Russian Patent Appl. No. 2015117770 dated Nov. 16, 2018; 16 pages (with English Translation).
Office Action issued in Chinese Patent Appl. No. 2015800109793 dated Sep. 12, 2018; 39 pages (with English translation).
Office Action issued in Chinese Patent Appl. No. 201580032114.7 dated Jul. 18, 2018; 15 pages.
Office Action issued in Eurasian Patent Appl. No. 201691737/31 dated Mar. 19, 2018; 4 pages (with English translation).
International Search Report and Written Opinion issued in PCT/US2015/030287 dated Jul. 29, 2015; 14 pages.
Extended Search Report issued in European Patent Appl. No. 15755550.9 dated Oct. 9, 2017; 9 pages.
International Search Report and Written Opinion issued in PCT/US2015/017175 dated May 28, 2015, 16 pages.
International Search Report and Written Opinion issued in PCT/US2015/059177 dated Feb. 17, 2016; 14 pages.
International Search Report and Written Opinion issued in PCT/US2015/059182 dated Feb. 29, 2016; 13 pages.
Decision on Grant issued in Russian Patent Appl. No. 2014132435 dated Sep. 20, 2018; 24 pages (with English translation).
Office Action issued in Chinese Patent Appl. No. 201580034894.9 dated Jul. 3, 2018; 9 pages (with English translation).
Decision on Grant issued in Russian Patent Appl. No. 2017102359 dated Jul. 27, 2018; 16 pages (with English translation).
Office Action issued in Russian Patent Application No. 2014132435 dated Apr. 3, 2018; 9 pages.
Office Action issued in Russian Patent Application No. 2017102359 dated Mar. 7, 2018; 11 pages.

* cited by examiner

SYSTEM AND METHOD FOR DELIVERY OF OILFIELD MATERIALS

RELATED APPLICATION INFORMATION

This application is a Continuation-In-Part application of and also claims the benefit of PCT Patent Application Serial No. PCT/US2013/054287, filed Aug. 9, 2013 and is a divisional application of Ser. No. 14/318,095, the entire disclosures of which are hereby incorporated herein by reference.

BACKGROUND

To facilitate the recovery of hydrocarbons from oil and gas wells, the subterranean formations surrounding such wells can be hydraulically fractured. Hydraulic fracturing may be used to create cracks in subsurface formations to allow oil and/or gas to move toward the well. The formation is fractured by introducing a specially engineered fluid, sometimes referred to as fracturing fluid or fracturing slurry, at high pressure and high flow rates into the formation through one or more wellbores. The fracturing fluids may be loaded with proppant which are sized particles that may be mixed with the liquids of the fracturing fluid to help form an efficient conduit for production of hydrocarbons from the formation to the wellbore. Proppant may comprise naturally occurring sand grains or gravel, man-made proppants, e.g. fibers or resin coated sand, high-strength ceramic materials, e.g. sintered bauxite, or other suitable materials. The proppant collects heterogeneously or homogeneously inside the fractures to prop open the fractures formed in the formation. Effectively, the proppant creates planes of permeable conduits through which production fluids can flow to the wellbore.

At the well site, proppant and other fracturing fluid components are blended at a low-pressure side of the system. The oilfield materials often are delivered from storage facilities to a blender by pneumatic systems which blow the oilfield materials. Water-based liquid is added and the resulting fracturing fluid is delivered downhole under high pressure. However, handling of the proppant prior to blending tends to create substantial dust as the proppant is moved to the blender via blowers. As a result, dust control devices, e.g. vacuums, are employed in an effort to control the dust. The variety of equipment used in the process also tends to create a large footprint at the well site, and operating the equipment is generally a manually intensive process.

SUMMARY

In general, the present disclosure provides a system and method which facilitate the handling of oilfield materials in a space efficient manner. The oilfield material is stored in at least one silo which may enable use of gravity to feed the oilfield material to a blending system or other suitable equipment. In many applications, the oilfield material is delivered to each silo without blowers. A mobile support structure is disclosed, which receives one or more modular silos at the wellsite. Each modular silo is transportable and may be engaged with a support structure that may be transported to the wellsite separately via a connection that allows for controlled movement of the modular silo during erection. Once engaged, the modular silo may be pivoted to a raised, upright position on the support structure. The oilfield material is then moved to an interior of the silo, and gravity may be used to feed the oilfield material to a blender or other equipment in a controlled manner.

Some embodiments of the present disclosure are directed to a mobile oilfield material transfer unit. The unit includes a chassis having a first end, a second end, a support beam extending between the first end and the second end, and wheels operably coupled with the support beam for movably supporting the support beam. The unit also includes an erecting mast assembly including a mast movably connected with the chassis proximate to the second end, and an actuator system coupled with the mast and with the chassis for moving the mast between a horizontal position and a vertical position. The unit also has a first conveyor assembly including a support frame coupled with the mast and moveable between the horizontal position and the vertical position, the first conveyor assembly including a first conveyor coupled with the support frame, an inlet, and an upper discharge portion, the first conveyor adapted to move a volume of oilfield material from the inlet to the upper discharge portion.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
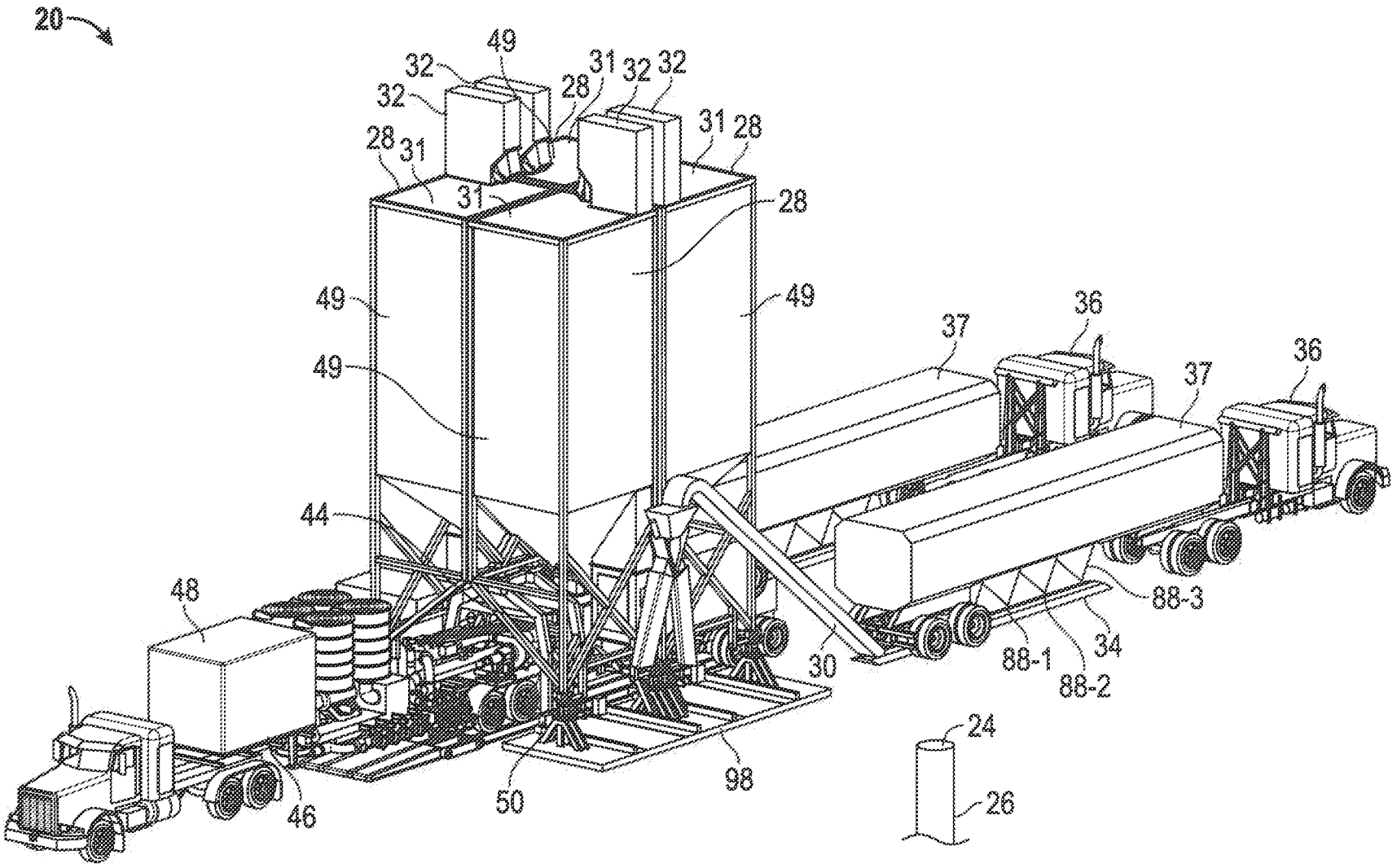
FIG. 1 is an illustration of an example of a proppant delivery system positioned at a well site, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Finally, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

The present disclosure generally involves a system and methodology to facilitate handling of oilfield materials in a space efficient manner. In one embodiment, the oilfield materials may be carried to a wellsite by suitable trucks and loaded into at least one modular silo without using air to carry the oilfield material. By way of example, the oilfield materials may be moved into a plurality of modular silos by using vertical conveyors to move the oilfield material without blowers. In some embodiments, each modular silo comprises an outer housing defining an enclosed interior for receiving the oilfield material. A corresponding vertical conveyor is positioned within the enclosed interior and is used to lift the oilfield material from a silo inlet, e.g. a hopper, to an upper portion of the modular silo without utilizing airflow to carry the oilfield materials. Once the oilfield material is disposed within the upright modular silo, the outflow of oilfield material through a silo outlet may be gravity controlled so as to selectively release the desired amount of material into a blending system or other suitable equipment positioned underneath the modular silo.

According to an example, a vertical silo is designed as a modular silo which may be carried to the well site by an over-the-road truck before being mounted in a generally upright position on the support structure. Truck refers to a transport vehicle, such as an articulated truck having a trailer pulled by a tractor. In this example, the modular silo is carried by the trailer of the truck. However, the truck also may comprise a straight truck or other suitable truck designed to carry the modular silo and to transport the modular silo over public roadways. The support structure may be designed in a manner which allows the silo to be erected from its lateral position on the truck to an upright, e.g. vertical, position at the well site. However, it should be understood that in other embodiments, a crane may be used to lift the modular silo and place the modular silo onto a support structure. The use of upright silos provides an efficient solution for proppant delivery in many applications. Gravity effectively causes the oilfield material to flow downwardly to desired equipment, such as a blending system.

The support structure may be designed in a variety of forms and configurations to support individual modular silos or a plurality of modular silos. By way of example, the support structure may be constructed of struts arranged in an A-frame configuration or other type of configuration able to support and secure the at least one modular silo in the desired upright position. In at least some applications, the support structure is designed to engage each modular silo while the modular silo is positioned on the transport truck. This allows the modular silo to be pivoted upwardly directly from the truck to its operational, upright position. The support structure also may be constructed to support each modular silo at a sufficient height to enable oilfield material to be gravity fed through a bottom end feeder and into a portable blender positioned below. In some applications, load cells are incorporated into the support structure to monitor the loading caused by each modular silo which enables tracking of the amount of oilfield material in each modular silo. In one embodiment, the support structure is a mobile support structure implemented as a trailer having wheels and a gooseneck portion for connection to the truck. In this embodiment, the gooseneck portion may convert to a ramp to aid in positioning a blending system underneath the modular silos. In another embodiment, the blending system may be integrated on the deck of the mobile support structure.

Figure 5:
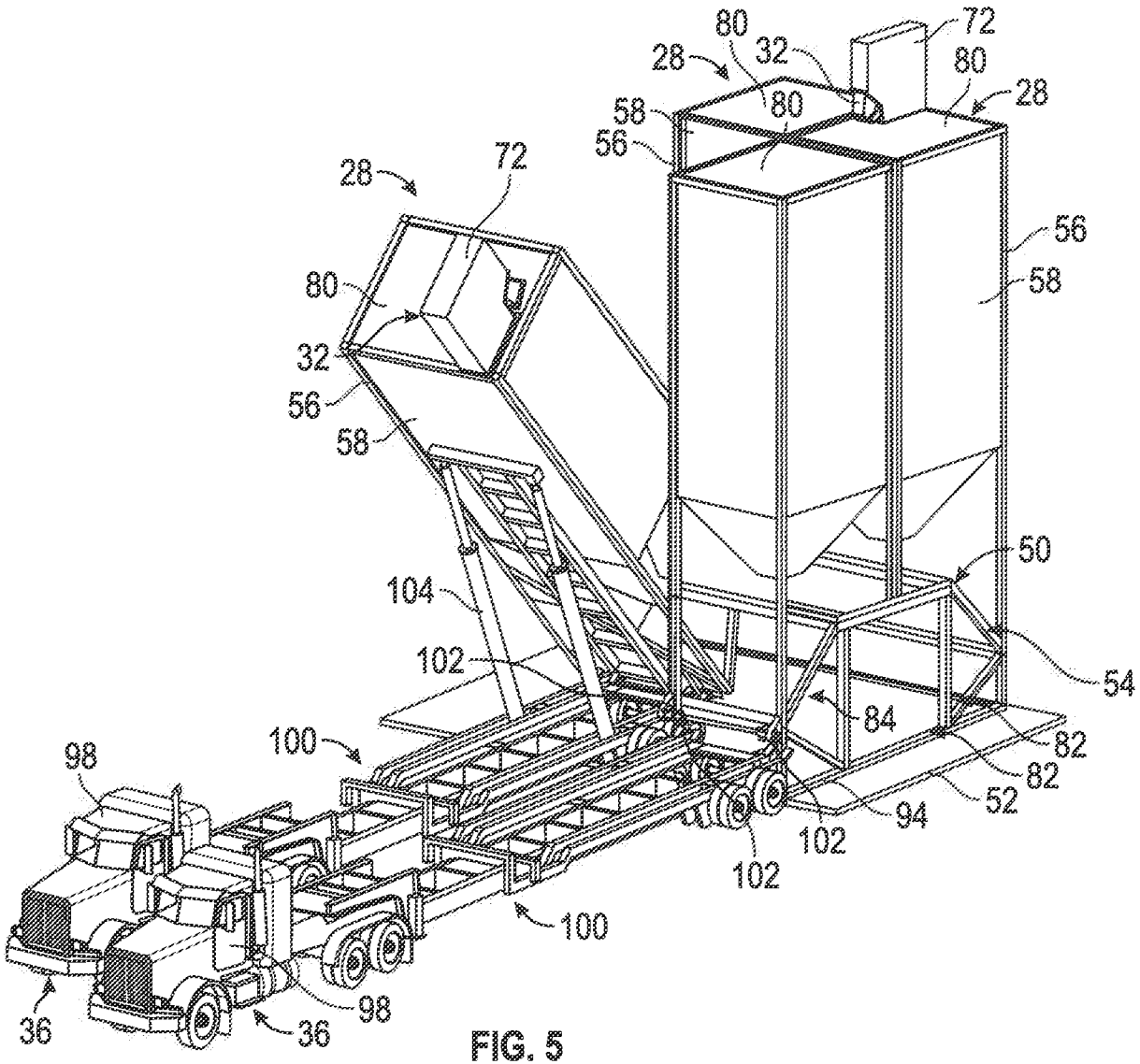
FIG. 5 is an illustration of a plurality of modular silos transported by over-the-road trucks and erected into position on the support structure, according to an embodiment of the disclosure.

In some embodiments, a conveyor, such as a mechanical belt conveyor, may be utilized to move oilfield material unloaded from a gravity dump transport into an intake hopper of a vertical conveyor enclosed within the modular silo. The mechanical belt conveyor can be backed over by a trailer hauling the oilfield material with multiple nozzles overlapping the mechanical belt conveyor, or other types of haulers may be used, such as tail dumps and live bottom trailers. By way of example, the vertical conveyor may comprise a bucket elevator or other type of vertical conveyor capable of conveying the oilfield material to an upper end of the modular silo a substantial distance, e.g. 30 to 70 feet, above the well site surface. The conveyor moving the oilfield material to the silo and the vertical conveyor may be enclosed to provide a dust free solution for handling oilfield material at much higher rates with greater energy efficiency and lower attrition than that achieved with existing pneumatic, e.g. blower, type conveyance systems. To increase storage capacity of the modular silo as compared to a cylindrical silo, the outer housing may have a substantially rectangular shape defining four corners (which may form pointed vertices or be rounded). The modular silo may be transported on a trailer having a gooseneck. As best shown in FIG. 5, to further increase the storage capacity of the modular silo while still being capable of being transported by a truck, the vertical conveyor may extend beyond a top of the outer housing and be offset towards one of the corners so as to avoid the gooseneck of the trailer.

Depending on the parameters of a given fracturing process, a plurality of the modular silos may be grouped together so that feeders of the plurality of modular silos provide oilfield material to a common area, e.g. to a truck mounted blending system having a proppant metering/rate control system, or other portable blender or blending system positioned beneath the modular silos. In order to reduce the space required at the wellsite for the plurality of the modular silos, the common area may be located below the outer housings of the modular silos. In this example, the outer housings of the modular silos overlap the common area. Additionally, some or all of the modular silos may be divided into compartments. In some applications, individual modular silos may have a plurality of internal compartments for holding different types of oilfield materials. Individual silos also may be divided into main storage compartments and secondary storage compartments located below the main storage compartments. In the latter example, the main storage compartment may be used to gravity feed oilfield material to an outlet feeder for distribution into the blending system. Some systems may utilize a belt feeder or other type of feeder system instead of gravity feed. The secondary storage compartment may be exposed to the internal vertical conveyor and proppant from the secondary storage compartment may continually be lifted and discharged into the main storage compartment. In some applications, the secondary compartments or other compartments of the modular silo may have separate features which enable independent filling of those particular compartments. Additionally, outlet feeders may be designed with controllable mechanisms, e.g. gates, which are adjustable to control the outflow of oilfield material.

The modular silos may be designed in a variety of sizes and shapes, including cylindrical shapes or rectangular shapes, selected to enable transport via a suitable over-the-road truck. By way of example, the modular silos may vary in size according to the proppant delivery plan for a given fracturing operation, but an example of a suitable modular silo may hold 2000-4000 cubic feet of oilfield material. In some systems, the modular silos are provided with sufficient clearance on the bottom side to form an unobstructed passage to enable a portable blending system, such as a truck mounted blending system, to be driven under a system of combined modular silos to receive oilfield material via gravity feed. For example, the portable blending system may be mounted on a truck trailer which is backed into position under the outlet feeders of a plurality of modular silos. In some embodiments, the modular silos may be designed as standalone silos and in other embodiments, the modular silos may be designed for placement on a framework/support structure which supports the modular silos at a desired height. In one embodiment the blending system may be skid mounted in order to be transported on a trailer to the wellsite and then placed under the silo system by a suitable mechanical device, such as a winch.

Each of these embodiments may utilize an enclosed, vertical conveyor to avoid blowing of the oilfield material, although in other embodiments a pneumatic fill tube can be used as a vertical conveyor. Each modular silo also may be filled by an integrated, oilfield material loading and delivery system utilizing an enclosed conveyor or other suitable system for moving oilfield material from an unload area to an inlet associated with the vertical conveyor at a lower end of the modular silo. In some applications, the vertical conveyor may be powered by a belt or other device driven by the enclosed conveyor system used to move oilfield material from the unload area to the inlet of the modular silo. This allows the system to be substantially automated. However, the individual motive systems, e.g., vertical conveyor and enclosed conveyor extending from the unload area, may be powered individually or collectively by a variety of sources, including various motors, engines, or other devices.

Referring generally to FIG. 1, an embodiment of a proppant delivery system for forming a slurry suitable for fracturing formations, is illustrated in position at a well site. By way of example, the proppant delivery system may comprise many types of equipment, including vehicles, storage containers, material handling equipment, pumps, control systems, and other equipment designed to facilitate the fracturing process.

In the example of FIG. 1, a proppant delivery system 20 is illustrated in position at a wellsite 22 having a well 24 with at least one wellbore 26 extending down into a reservoir/formation. The proppant delivery system 20 may comprise many types and arrangements of equipment, and the types or arrangements may vary from one fracturing operation to another. By way of example, the proppant delivery system 20 may comprise at least one modular silo 28, e.g. a plurality of modular silos that may be transported over-the-road by trucks able to operate on public roadways. The modular silos 28 are designed to store oilfield material such as a proppant used to prop open fractures upon fracturing of the subterranean formation, or guar used to increase the viscosity of a hydraulic fracturing fluid. In the example illustrated, several modular silos 28 receive oilfield material via conveyors 30, e.g. belt conveyors, and the oilfield material is lifted to an upper portion 31 of each modular silo 28 by corresponding vertical conveyors 32. The conveyors 30 and the vertical conveyors 32 may operate by carrying the oilfield material instead of blowing the oilfield material to avoid erosion of components and dusting of the area. Additionally, the conveyors 30 and vertical conveyors 32 may be enclosed to further reduce dust as the oilfield material is delivered from an unload area 34 and into the modular silos 28.

As illustrated, oilfield material transport trucks 36 may be used to deliver oilfield material to the unload area 34. In this example, the trucks 36 are tractor-trailer trucks having trailers 37 which may be backed over a portion of a selected conveyor 30. The trailers 37 can be gravity feed trailers or other types of trailers capable of moving the oilfield material to the wellsite 22. The trailers may be operated to release the oilfield material onto a belt or other suitable carrier of the selected conveyor 30 for transfer to the associated modular silo or silos 28 along an enclosed pathway within the conveyor 30.

In this example, the proppant delivery system 20 may comprise a variety of other components including water tanks (not shown) for supplying water that is mixed with the oilfield material to form the hydraulic fracturing fluid, e.g. proppant slurry, that may be pumped downhole into wellbore 26 via a plurality of pumps (not shown). By way of example, pumps may be truck mounted pumps, e.g. pumping systems mounted on truck trailers designed for over-the-road transport. The multiple pumps may be coupled to a common manifold (not shown) designed to deliver the hydraulic fracturing fluid to the wellbore 26. The proppant delivery system 20 also may comprise a blending system 44 designed to blend oilfield material delivered from modular silos 28. By way of example, the blending system 44 may be a portable blender, such as a truck mounted blender or a skid mounted blender. In the specific example illustrated, blending system 44 is mounted on a truck trailer 46 that may be driven, e.g. backed up, into a common area 47 (shown in FIG. 3) that is positioned underneath or proximate to the modular silos 28. The proppant delivery system 20 also may comprise a variety of other components, such as a control facility 48 and/or other components designed to facilitate a given fracturing operation. In one embodiment, the common area 47 is located below the outer housings 49 of the modular silos 28. In this embodiment, the outer housings 49 of the modular silos 28 overlap the common area 47.

Figure 1A:
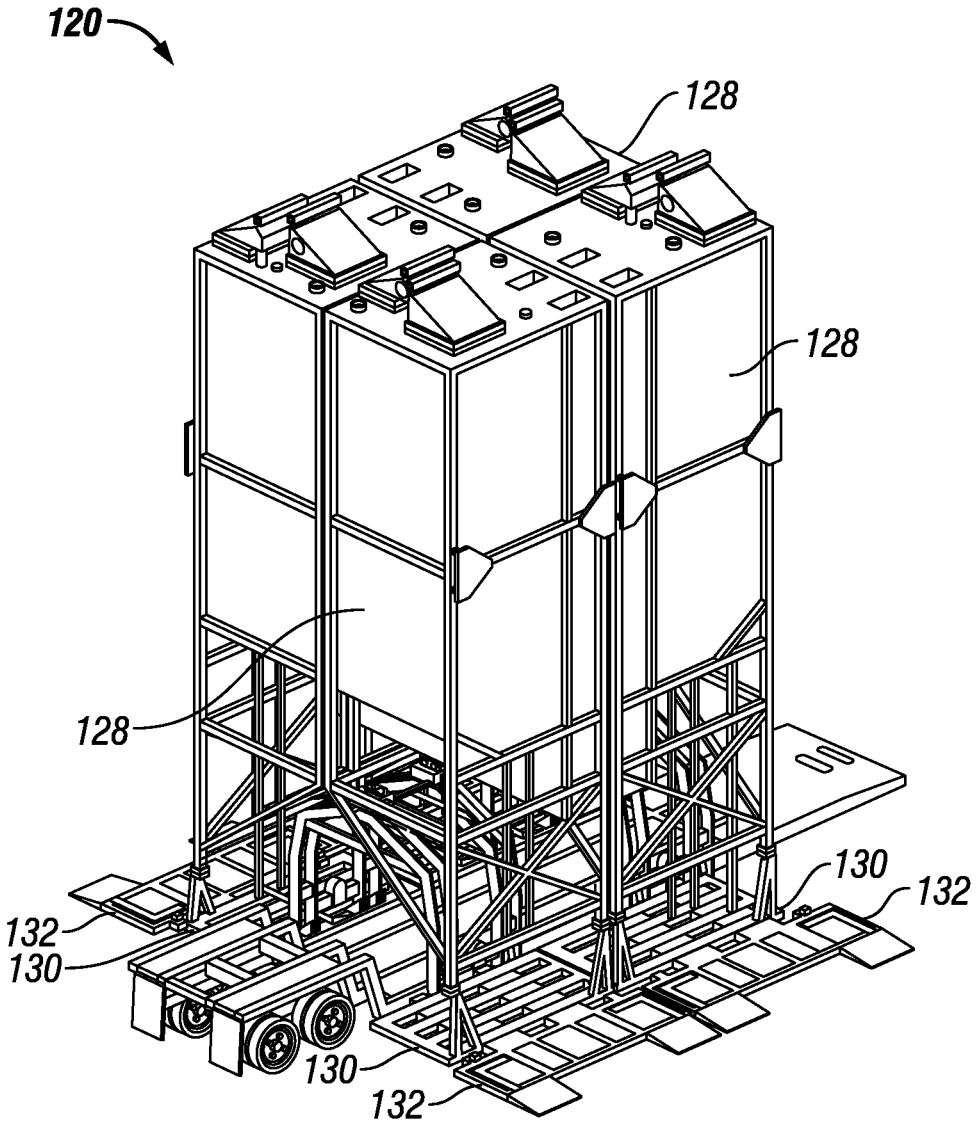
FIG. 1A shows an example of a modular silo and mobile support structure positioned at a well site, according to an embodiment of the disclosure.

FIG. 1A illustrates another embodiment of a modular silo arrangement as part of a proppant delivery system for forming a slurry suitable for fracturing subterranean formations. In this example embodiment, similar with that shown in FIG. 1, the proppant delivery system can include many types of equipment, including vehicles, storage containers, material handling equipment, pumps, control systems, common areas, and other equipment designed to facilitate the fracturing process at a well-site having a well 24 with at least one wellbore 26 penetrating the formation. Modular silo arrangement 120 includes at least one modular silo 128 (four shown) transportable by truck over-the-road. Silo(s) 128 may be deployed, erected, and used in the same or similar fashion as silos 28, described above, such as for storing and delivering oilfield material. Furthermore, silos 128 may be filled or replenished, as well as integrated with other equipment, in similar ways as described herein. Silo 128 includes silo base 130 (three shown) which may be disposed upon and secured with base unit 132 (three shown) during the erecting into an upright or vertical orientation, and utilization of modular silo 128. A plurality of modular silos 128 may be coupled together.

Figure 1B:
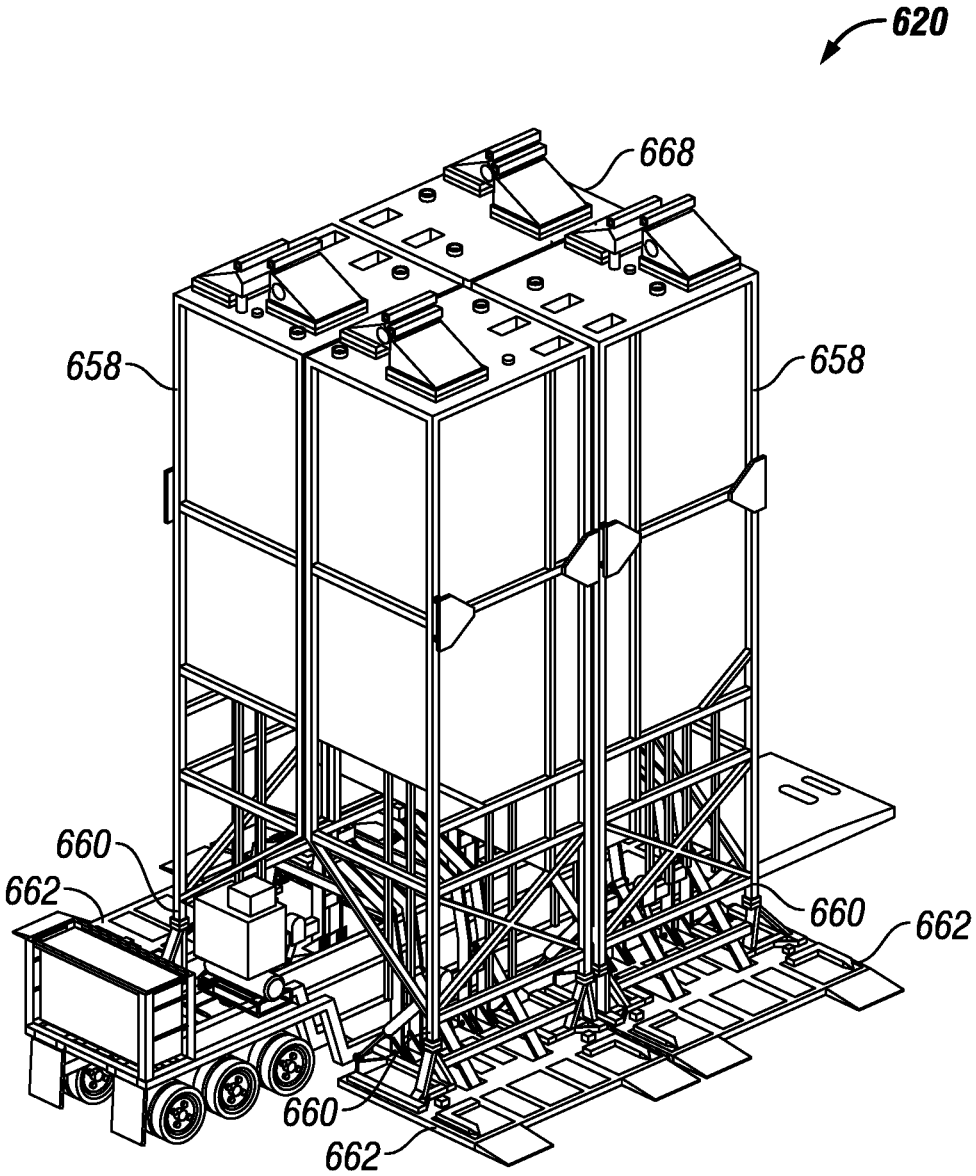
FIG. 1B depicts another example of a modular silo and mobile support structure positioned at a well site, according to an embodiment of the disclosure.

FIG. 1B depicts yet another embodiment of a modular silo arrangement as part of a proppant delivery system. In this embodiment, similar to those shown in FIGS. 1 and 1B, the proppant delivery system can include many types of well-site equipment to facilitate the fracturing process at a well-site having a well 24 with at least one wellbore 26 penetrating the formation. Modular silo arrangement 620 includes at least transportable one modular silo 658 (four shown). Silo(s) 658 may be deployed, erected, and used in the same or similar fashion as silos 28 and 128, described above, such as for storing and delivering oilfield material, and may be filled or replenished, as well as integrated with other equipment, in similar ways as described herein. Silo 658 includes silo base 660 (three shown) disposed upon and secured with base unit 662 (three shown) during the erecting into an upright or vertical orientation, and utilization of modular silo 658. Also, a plurality of modular silos 658 may be coupled together.

Figure 2:
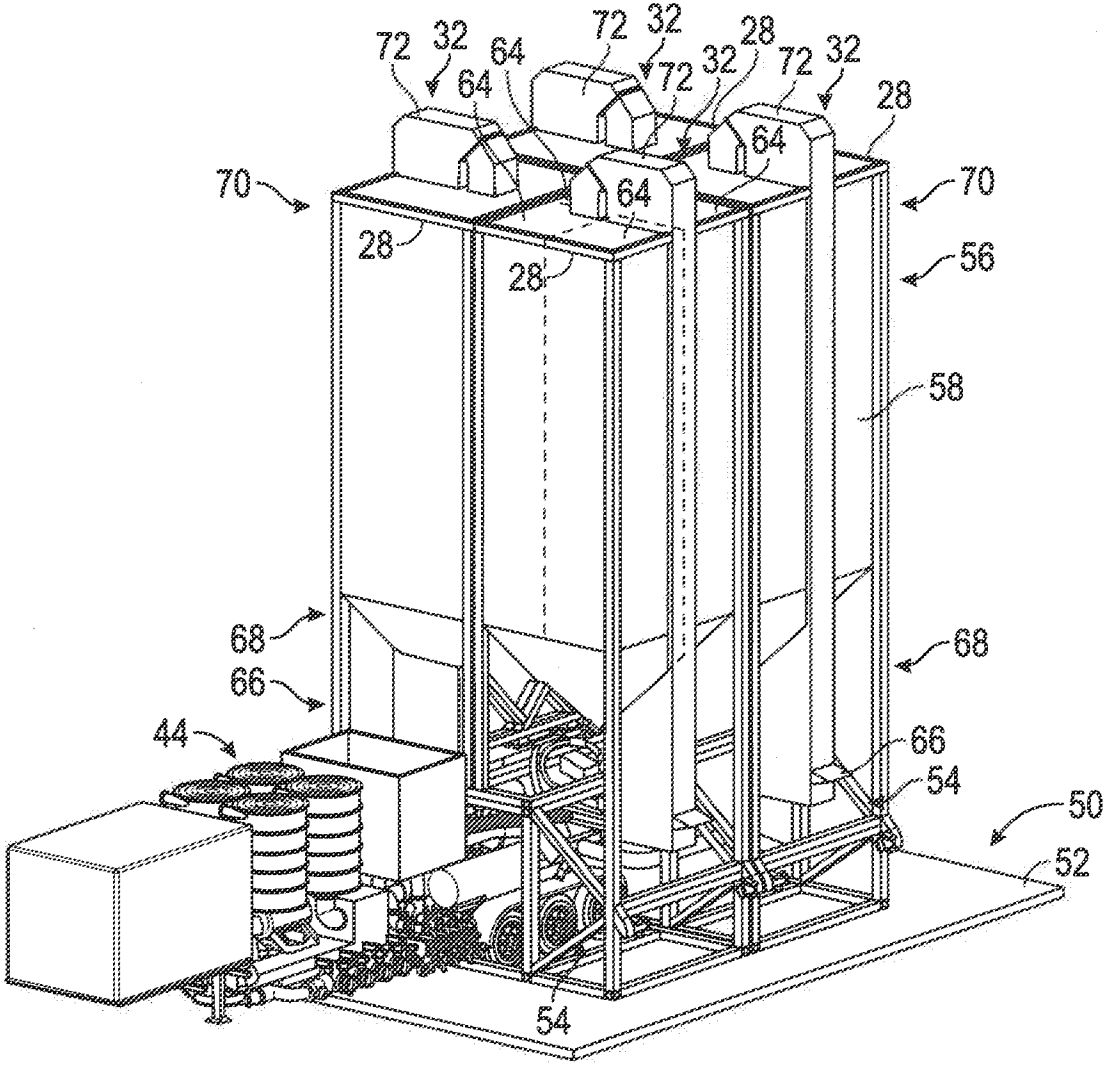
FIG. 2 is an illustration of another embodiment of a proppant delivery system in which a plurality of closed, modular silos are used for holding oilfield materials, according to an embodiment of the disclosure.

Referring generally to FIG. 2, an embodiment of modular silos 28 coupled together into a cooperating unit is illustrated. In this example, a plurality of the modular silos 28, e.g. four modular silos 28, is coupled together on a modular support structure, or framework, 50 which may be mounted on a mat system 52 which may be placed upon a pad, such as a concrete pad, gravel or the like. The mat system 52 distributes the load from the modular silos 28 onto the ground. The modular silos 28 may be releasably mounted in a generally upright or vertical orientation on support structure 50. Support structure 50 is constructed with a plurality of silo receiving regions 54 on which the individual modular silos 28 may be mounted in a generally upright or vertical orientation. The support structure 50 and the silo receiving regions 54 may be designed to elevate the modular silos 28 to a sufficient height so as to allow movement of portable blending system 44 to a position sufficiently beneath the modular silos 28 within the common area 47 in order to receive a controlled outflow of oilfield material. For example, the support structure 50 may be designed to allow a truck mounted blending system 44 to be driven, e.g. backed up, into position beneath the modular silos 28, as illustrated. Additionally, the pad may be constructed in a variety of sizes and forms, including cement pads, compacted aggregate pads, pads constructed as portable structures, mixtures of these various structural elements, and/or other suitable pad types for supporting the plurality of modular silos 28.

Figure 2A:
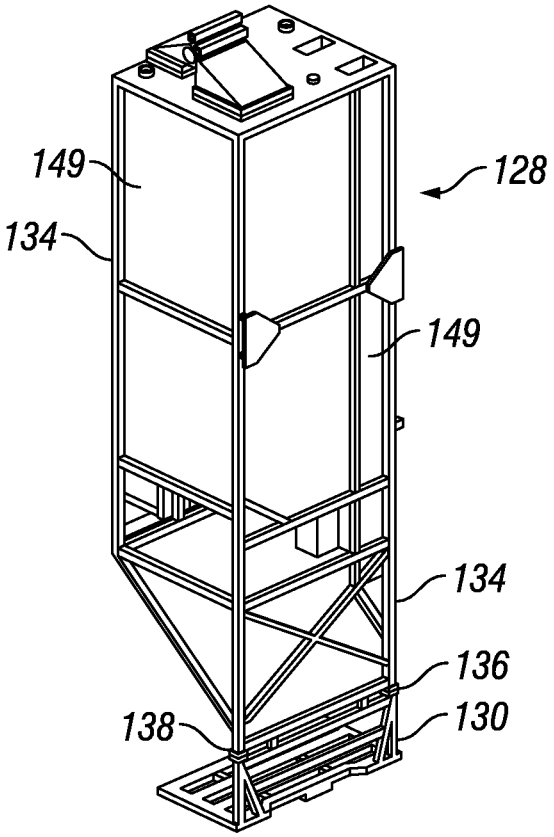
FIG. 2A illustrates a modular silo according to an embodiment of the disclosure.
Figure 2B:
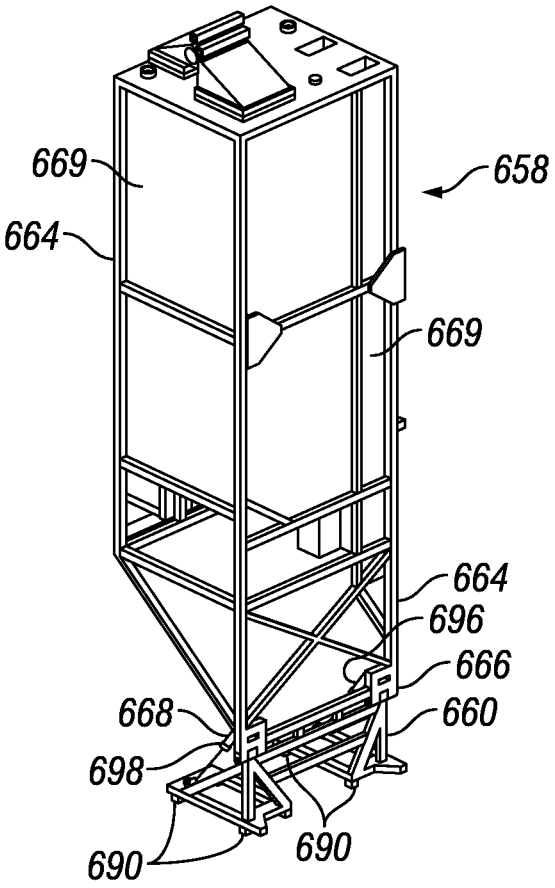
FIG. 2B shows a modular silo according to an embodiment of the disclosure.

Referring now to FIGS. 2A and 2B, which generally illustrates modular silos 128 and 658. Silo base 130 and 660 are movably connected with modular silo frame 134 and 634, respectively, at distal positions 136 and 138, or 666 and 668, so as to accommodate the erecting of modular silo 128 or 658 into an operational upright orientation. Silo frame 134 or 664 supports outer housing 149 or 669. Silo frame 134 or 664 may be designed to elevate modular silos 128 or 658 to height sufficient to allow movement of portable equipment to positions sufficiently beneath the modular silo 128 or 658, once erected into operational position. As shown in FIG. 2B, ties 696 and 698 may be attached to distal positions 666 and 668 of frame 664, as well as attached to base 660, to control the position of base 660. Cylinders 696 or 698 may be hydraulic cylinders, pneumatic cylinders, and the like. Base 660 in FIG. 2B may further include base extensions 690, which are heels or juts distally located at an end of base 660, and may be useful for connecting and interlocking with a mobile base.

Figure 3:
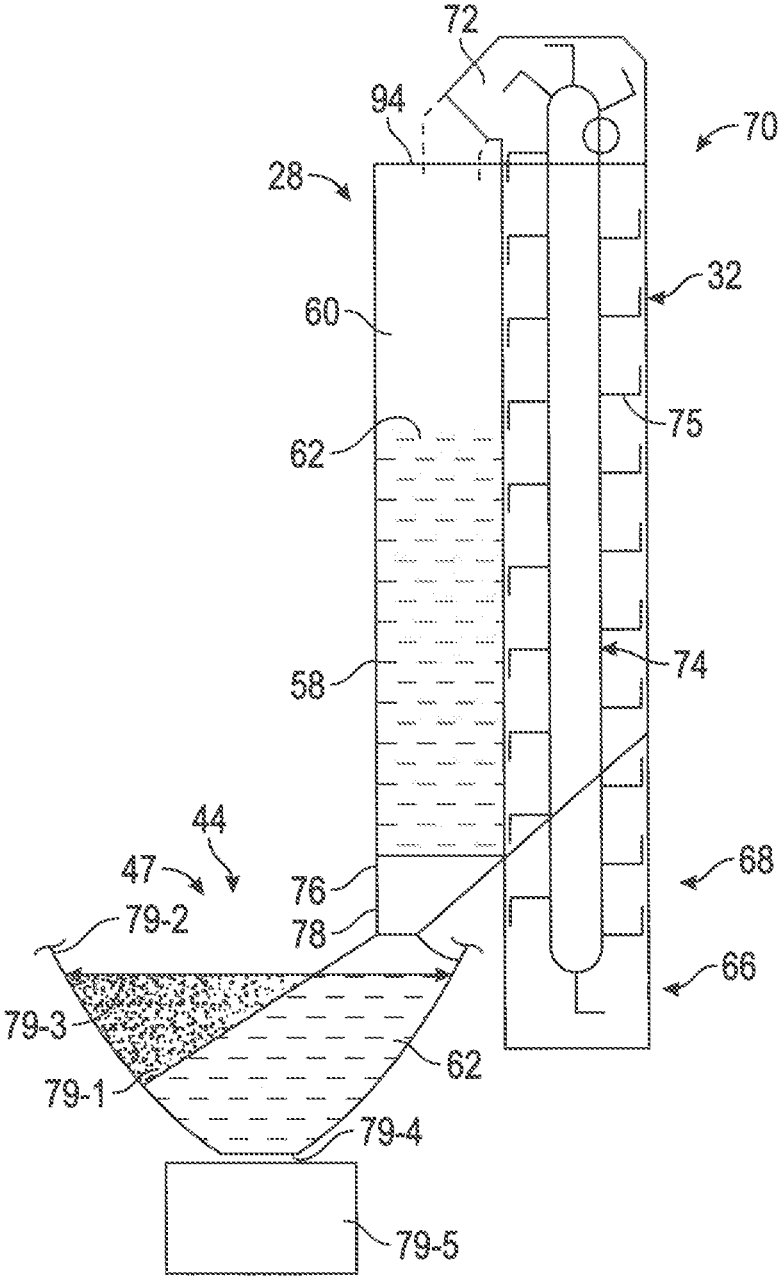
FIG. 3 is a schematic illustration of an example of a vertical conveyor system enclosed within a silo, according to an embodiment of the disclosure.

In the examples illustrated, modular silos 28, 128 and 658 each may be constructed with a silo frame 56, 134 or 654 respectively, supporting the outer housing 49, 149 or 649 respectively, which defines an enclosed interior 60 for holding oilfield material 62 (see also FIG. 3 which is applicable to housing 149 and 649 as well). Depending on the fracturing operation, oilfield material 62 may comprise naturally occurring sand grains or gravel, man-made proppants, resin coated sand, high-strength ceramic materials, e.g. sintered bauxite, other solids such as fibers, mica, mixtures of different sized oilfield materials, mixtures of different types of oilfield materials, and/or other suitable oilfield materials. In some applications, selected modular silos 28, 128 and 658, or each of the modular silos 28, 128 and 658, may be divided into the compartments 64 designed to hold different types of oilfield materials 62 that may be selectively released from the modular silo 28, 128 or 658 and blended via the blending system 44. Each enclosed vertical conveyor 32 is designed to lift oilfield material (e.g., with or without blowing) from an inlet 66, e.g. an inlet hopper, disposed at a lower portion 68 to an upper discharge portion 70 for release into enclosed interior 60 through a vertical conveyor head 72. In some embodiments, the conveyor head 72 may have a pivotable or otherwise movable discharge which is selectively controllable to deliver the desired oilfield material to a corresponding desired compartment 64 within a given modular silo 28, 128 or 658.

With further reference to FIG. 3, the vertical conveyor 32 may be positioned within enclosed interior 60 in a manner which limits escape of dust while providing a uniform modular unit that may be readily transported via an over-the-road truck, such as truck 36 with a suitably designed trailer. Vertical conveyor 32 also may be constructed in a variety of forms. For example, the vertical conveyor 32 may be constructed as a bucket elevator 74 having a plurality of buckets 75 conveyed in a continuous loop lifting oilfield material 62 from inlet 66 to upper discharge portion 70 for discharge into enclosed interior 60 via vertical conveyor head 72. The outflow of oilfield material 62 to the blending system 44 may be through an outlet, e.g. a feeder 76, and the amount of outflow through feeder 76 may be controlled by a suitable outflow control mechanism 78. For example, the blending system 44 may include a hopper 79-1 having an inlet 79-2 positioned below the feeder 76. In one embodiment, the outer housing 58 overlaps the inlet 79-2 of the hopper 79-1. The inlet 79-2 of the hopper 79-1 may have a width 79-3 up to 12 feet, and desirably between 8 feet to 8.5 feet. The hopper 79-1 may also have an outflow control mechanism 79-4 which is similar to the outflow control mechanism 78. By way of example, outflow control mechanisms 78 and 79-4 may comprise a controllable gate, e.g. hydraulic gate, control valve, or other flow control mechanism which is operated via control facility 48 or via another suitable control system. In this example, oilfield material 62 is gravity fed through feeder 76 and the amount of outflow is governed by the outflow control mechanism 78. In one embodiment, the amount of oilfield material 62 discharged into a blender 79-5 of the blending system 44 may be regulated by both of the outflow control mechanisms 78 and 79-4. In this instance, the outflow control mechanism 79-4 may be maintained in a fixed open position while the outflow control mechanism 78 is regulated in real-time by the control facility 48 to control an amount of oilfield material 62 discharged into the blender 79-5. Because the feeder 76 is within the confines of the hopper 79-1, as the hopper 79-1 fills with oilfield material 62, the oilfield material 62 will bear against the feeder 76 and form a plug. In this manner, the outflow control mechanism 79-4 is self-regulating and the outflow control mechanism 78 and the control facility 48 may solely control the amount of oilfield material 62 discharged into the blender 79-5.

Figure 4:
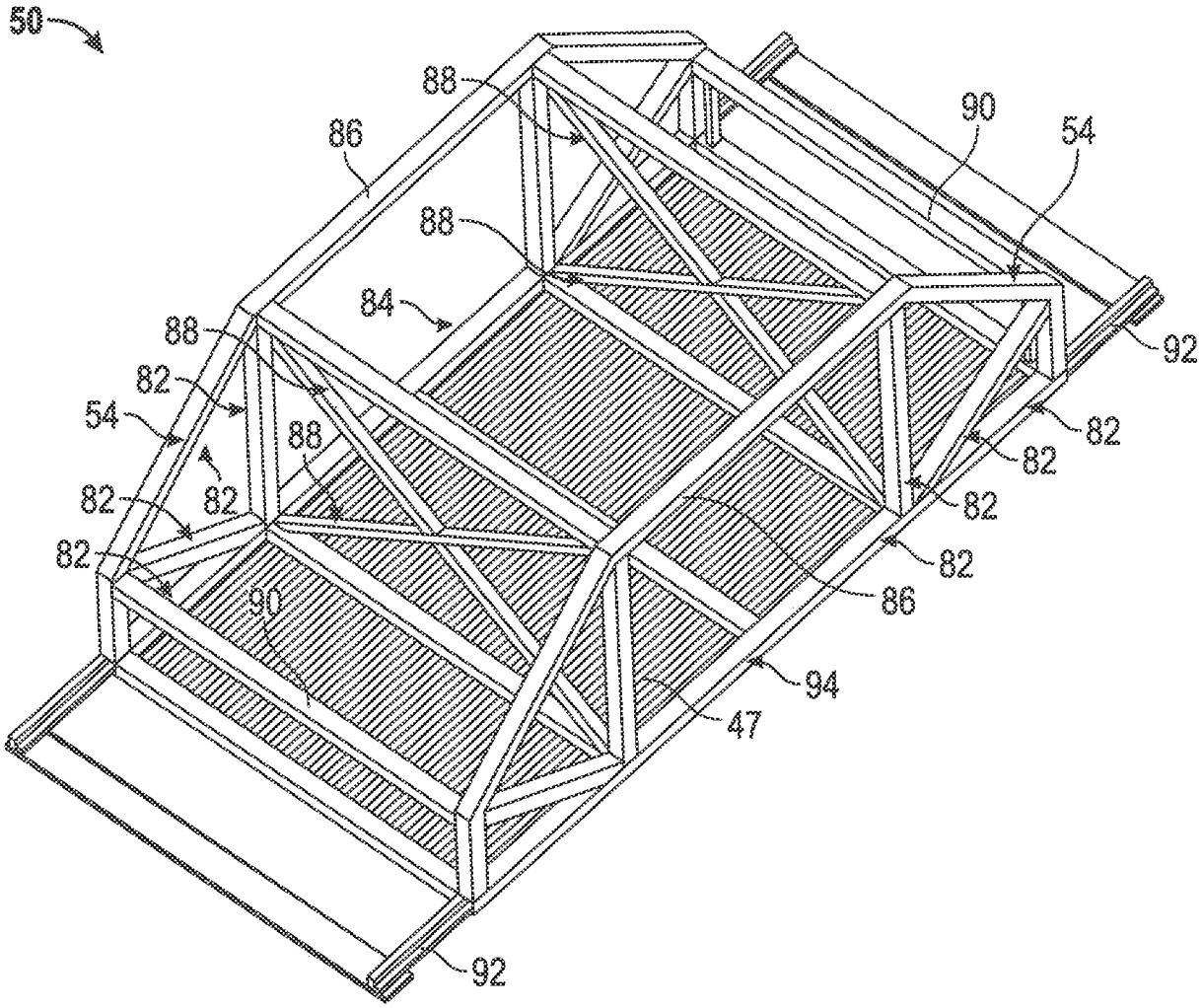
FIG. 4 is an illustration of an example of a support structure with silo receiving areas on which modular silos may be mounted in an upright orientation, according to an embodiment of the disclosure.

Referring generally to FIG. 4, an example of support structure 50 is illustrated. In this example, the support structure 50 comprises a plurality of struts 82 which are connected by suitable fastening methods to create a strong, stable structure for supporting at least one modular silo 28. Fastening methods may utilize welds, bolt and nut fasteners, and/or other suitable types of fasteners. The struts 82 are connected to form at least one silo receiving region 54. In the example illustrated, struts 82 are arranged to create a plurality of the silo receiving regions 54 designed to receive and support, for example, two modular silos 28. However, support structure 50 may be constructed in a variety of configurations for supporting various numbers of modular silos 28 in many types of arrangements and configurations.

In the embodiment illustrated, struts 82 also are arranged to create support structure 50 with a drive under region or passage 84 which provides space for system equipment, such as portable blending system 44 as well as encompasses the common area 47. By way of example, support structure 50 may be arranged so that silo receiving regions 54 are able to support modular silos 28 via silo frames 56 at a raised position which allows bottom feeders 76 to meter the outflow of oilfield material 62 down into the portable blending system 44 when the portable blending system 44 is positioned and/or driven into the passage 84. As illustrated, upper struts 86 may be used to connect silo receiving regions 54 and to provide an upper support for a portion of the modular silo frames 56. The upper struts 86 may be placed at a sufficient height to enable a truck mounted portable blending system 44 to be driven, e.g. backed up, into drive under region or passage 84 for receiving oilfield material 62 from the modular silos 28. In other embodiments, however, the upper struts 86 may be split and supported by additional vertical struts to allow separation of the silo receiving regions 54. The separation of silo receiving regions 54 allows individual silos 28 or groups of silos 28 to be separated and to provide a space through which equipment, e.g. the portable blending system 44, may be driven between the separated modular silos 28.

Support structure 50 also may comprise a variety of additional features, including strengthening cross struts 88 which may be positioned at various locations throughout the structure of support structure 50 to enhance the strength of the support structure. The support structure 50 also may comprise pivot struts 90 to which pivot connectors (shown in FIG. 6) may be attached, as discussed in greater detail below. The pivot struts 90 provide a strong region of the support structure 50 to which each modular silo 28 may initially be engaged and then pivoted against during erection of each modular silo 28 from a lateral position to an upright, operational position. In some applications, the pivot struts 90 are located at a height which matches corresponding pivot connectors of the modular silo frame 56 when the modular silo 28 is mounted laterally, e.g. horizontally, on a suitable over-the-road truck 36.

Referring again to FIG. 4, support structure 50 also may comprise or be connected with at least one expandable base 92 designed to stabilize the support structure 50 and the modular silos 28 when mounted in an upright position on the support structure 50. In the example illustrated, a plurality of expandable bases 92 are movably connected with a base portion 94 of support structure 50. The expandable bases 92 may be slidably received in base portion 94 for movement between a retracted position in base portion 94 and an extended position, as illustrated, to provide greater stability to the support structure 50. The extension and contraction of expandable bases 92 may be performed by a variety of suitable actuators, including hydraulic actuators, e.g. hydraulic cylinders, electric actuators, e.g. stepping motors which operate a screw coupled to the expandable bases, and/or mechanical actuators, e.g. expandable bases which may be manually transitioned between positions. Additionally, transition of the expandable bases 92 between retracted and actuated positions may be facilitated by a variety of other types of moveable joints, including hinges and other types of pivots, couplers which enable quick connection and disconnection of the expandable bases 92, and/or other suitable mechanisms. The number and orientation of expandable bases 92 also may be adjusted according to the parameters of a given application. The expandable bases 92 may be connected with the support structure 50 so as to provide a seismic base isolation to the support structure 50. The expandable bases 92 may include additional slideable or foldable outriggers connected at a side of the expandable base 92 to further stabilize the support structure 50.

In FIG. 5, an example is illustrated in which a plurality of modular silos 28 are being placed into position on two of the support structures 50 positioned side-by-side. In this example, each individual modular silo 28 is transported to the well site 22 by a suitable truck 36. As illustrated, the suitable truck 36 may comprise a tractor 98 pulling a trailer 100 appropriately sized to receive one of the silos 28 in a lateral, e.g. horizontal, orientation. In the example illustrated, the modular silo 28 is constructed such that vertical conveyor head 72 extends from closed top 80 of silo housing 58 generally along a side of the modular silo 28. This enables transport of the modular silo 28 on a conventional gooseneck style trailer 92, as illustrated.

Each truck 36 may be backed up to move the laterally positioned silo 28 into engagement with a corresponding silo receiving region 54 of support structure 50. As discussed above, the support structure 50 may comprise pivot struts 90 or other suitable structures located at an appropriate height to receive and engage each modular silo 28 when in the lateral position on truck 36. By way of example, the support structure 50 and the corresponding modular silos 28 may use pivot connectors 102 by which the silo 28 may be selectively engaged with the support structure 50. The pivot connectors 102 are positioned to allow engagement and connection of each silo 28 with the support structure 50 while the silo 28 is in a lateral position on truck 36. The pivot connectors 102 also are designed to maintain engagement of the modular silo 28 with the support structure 50 as the silo is pivoted from the lateral position to an operational upright, e.g. vertical, orientation.

The modular silos 28 may be pivoted or moved about pivot connectors 102 from the lateral position on truck 36 to the operational, upright position on the support structure 50 by a variety of mechanisms. For example, a ram 104 (shown in dashed lines) may be used to erect each silo 28 between the lateral and upright positions. The ram 104 may be a hydraulic or pneumatic ram positioned on trailer 100 to act against frame 56 of each modular silo 28 to pivot the modular silo 28 about pivot connectors 102 until the silo 28 is securely received in its upright position by silo receiving region 54. The ram 104 may be designed to operate off a hydraulic (or pneumatic) system of truck 36. In other applications, the ram 104 may be designed to pivot trailer 100 or a portion of trailer 100 upwardly while the modular silo 28 remains attached to the pivoting portion of the trailer 100. Other techniques may utilize cranes, pulleys, and/or other mechanisms to pivot each modular silo 28 about the pivot connection as the modular silo 28 is transitioned from the lateral position to the operational, upright orientation.

Figure 6:
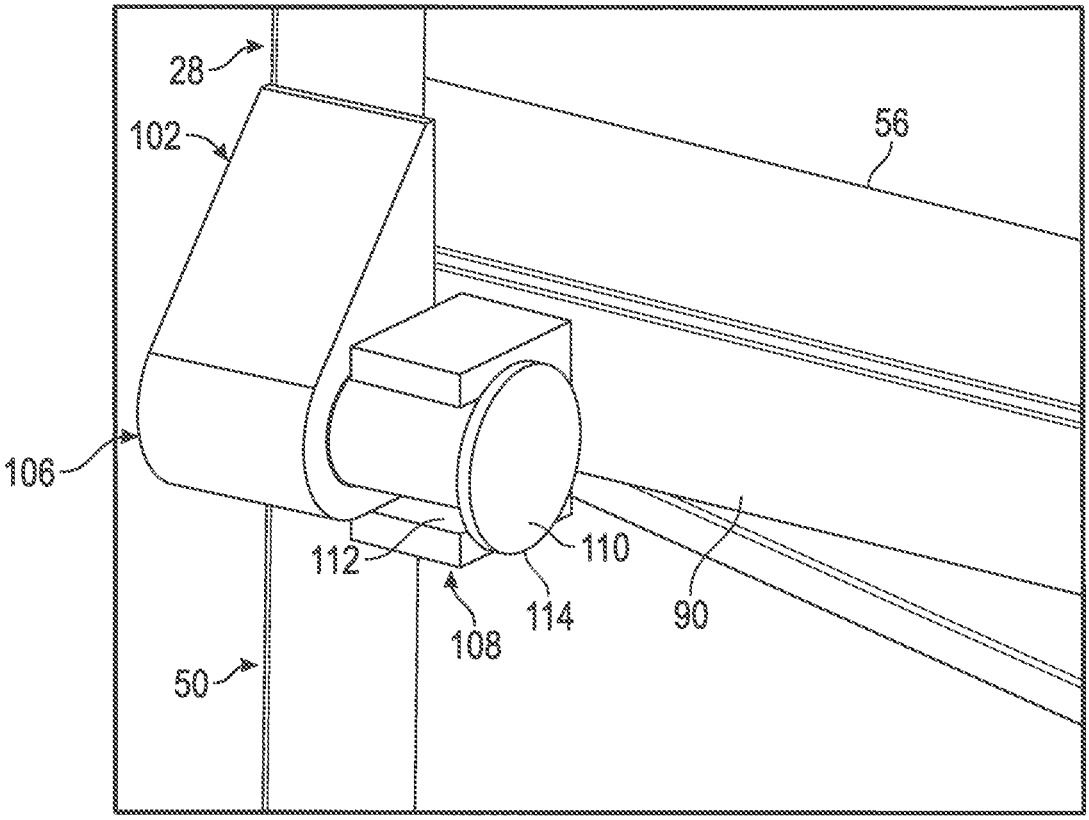
FIG. 6 is an illustration of an example of a pivot connection used in pivoting a modular silo from a lateral position to an upright position on the support structure, according to an embodiment of the disclosure.

The pivot connectors 102 are used to facilitate formation of the pivot connection between each modular silo 28 and the support structure 50 and may comprise a variety of individual or plural connector mechanisms. Generally, each pivot connector 102 comprises a pivot member 106 mounted to the silo 28 and a corresponding pivot member 108 mounted on the support structure 50, e.g. mounted on pivot struts 90, as illustrated in FIG. 6. In the specific example illustrated in FIGS. 5 and 6, each modular silo 28 is pivotably engaged with support structure 50 via a pair of the pivot connectors 102. By way of example, each pivot member 106 may comprise a pin 110 rotatably, e.g. pivotably, received in a corresponding pin receiver 112 which forms part of corresponding pivot member 108. Although pin 110 is illustrated as connected to frame 56 of modular silo 28 and pin receiver 112 is illustrated as connected to pivot struts 90 of support structure 50, the pin 110 and pin receiver 112 can be reversed. Additionally, the pivot connectors 102 may comprise a variety of other structures designed to enable selective engagement of the modular silos 28 with support structure 50 and controlled movement of the modular silos 28 with respect to the support structure 50. Depending on the design of the pivot connectors 102, a variety of retention features such as expanded pin head 114 may be used to maintain the pivotable connection between the modular silo 28 and support structure 50 during transition of the modular silo 28 from the lateral position to the upright position.

Figure 7:
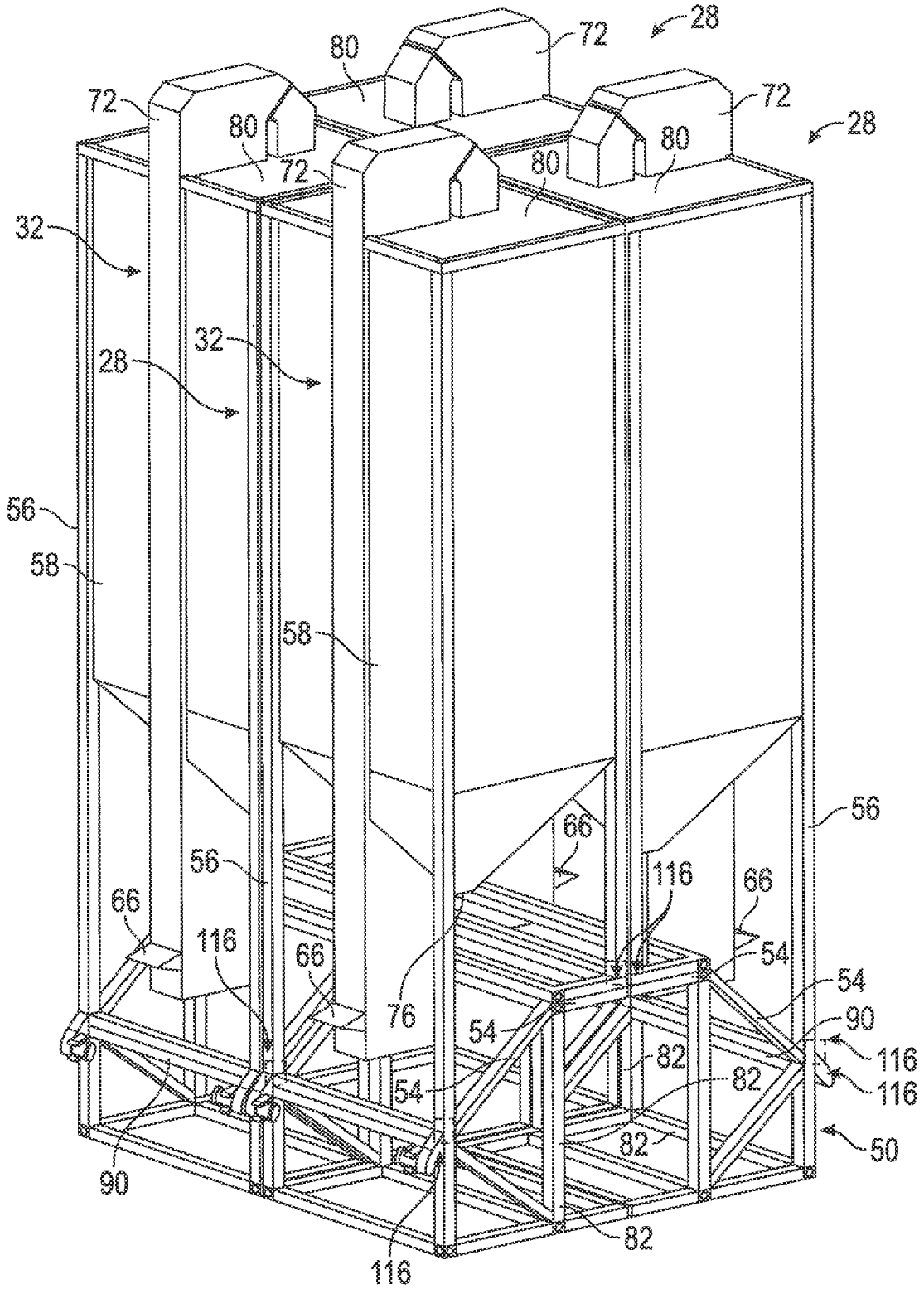
FIG. 7 is an illustration of a plurality of the modular silos positioned on the support structure with load cells mounted in appropriate locations to monitor the load, and thus the content weight, of each modular silo, according to an embodiment of the disclosure.

Referring generally to FIG. 7, the support structure 50 and/or modular silos 28 may comprise other features for detecting and/or monitoring certain system functions. For example, various sensors 116 may be positioned on support structure 50 and/or on modular silos 28 to detect and/or monitor parameters related to the delivery of oilfield material 62 for a given fracturing operation. By way of example, sensors 116 may comprise load cells mounted at silo receiving regions 54 to monitor the loads applied by individual modular silos 28. The loading data may be used to track the amount of oilfield material that remains in enclosed interior 60 of each modular silo 28.

Figure 8:
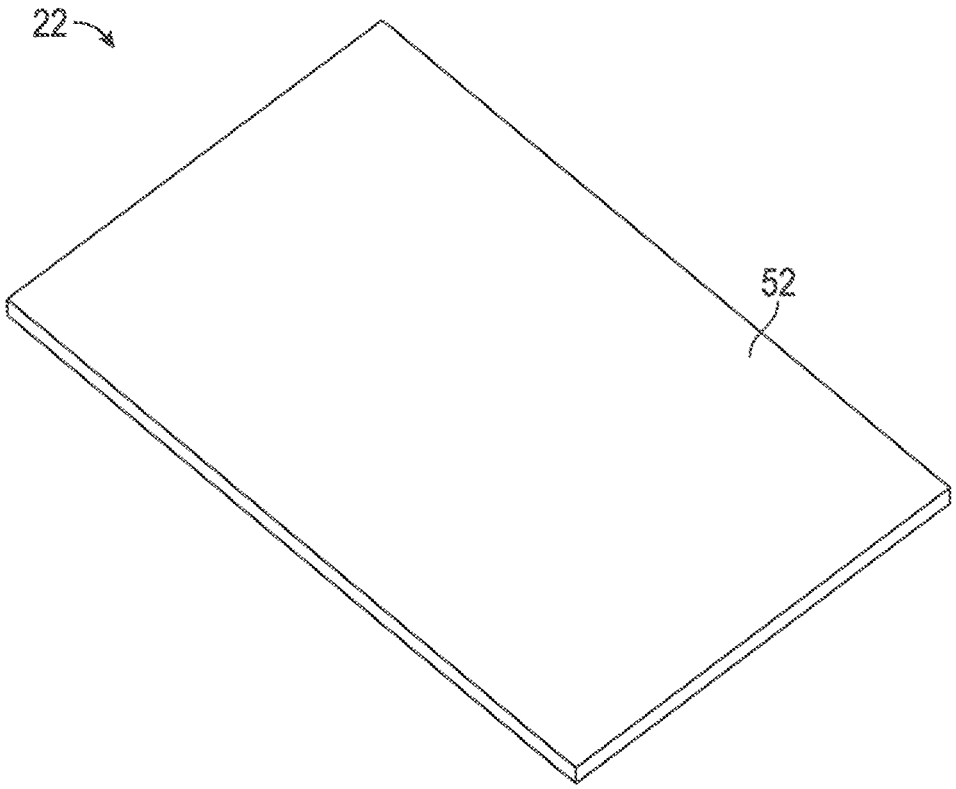
FIG. 8 is an illustration of an example of a mat system on which the support structure may be mounted at a well site, according to an embodiment of the disclosure.

In FIGS. 5, 7, 8 and 9, an operational example is illustrated to facilitate explanation of how an embodiment of the proppant delivery system may be constructed at a given wellsite 22. In this example, the mat system 52 is initially constructed at well site 22 as shown in FIG. 8. The mat system 52 52 may be constructed in a variety of sizes and forms depending on the environment and on the size and parameters of a given fracturing operation. By way of example, the mat system 52 may comprise of a structural material formed of steel or another suitable structural material, and positioned on the pad to distribute the weight of the modular silos 28 to the ground, as illustrated in FIG. 8.

Figure 9:
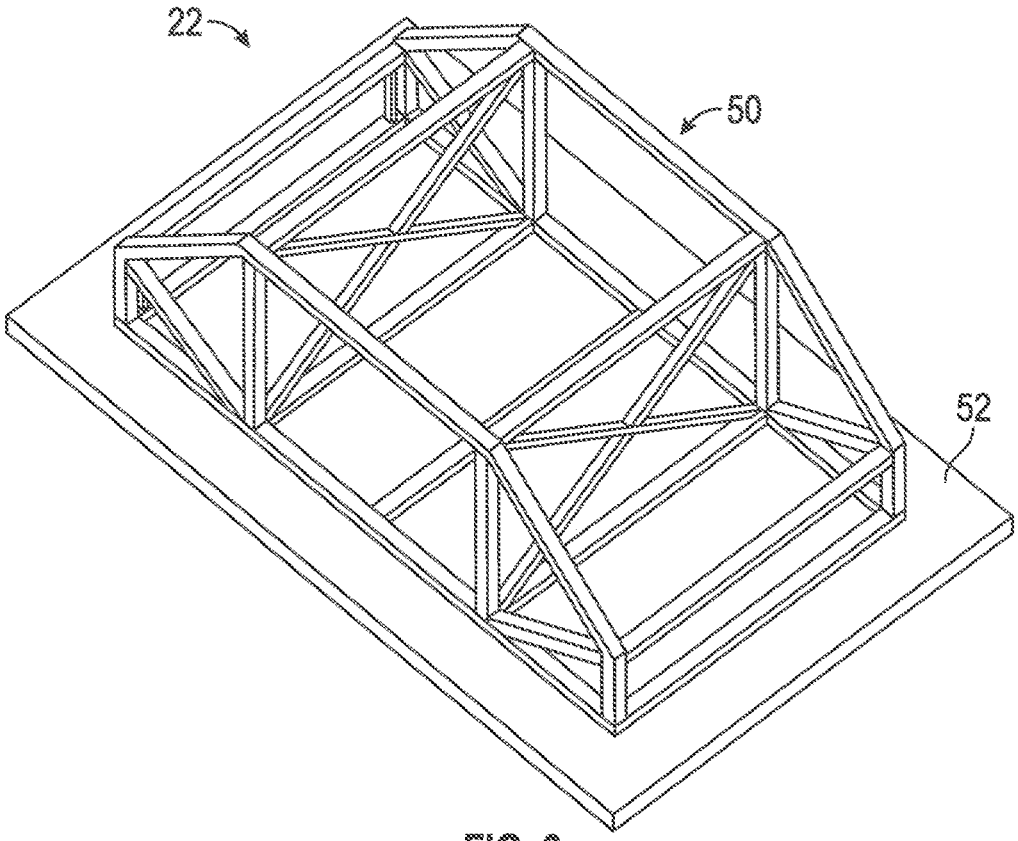
FIG. 9 is an illustration of an example of the support structure positioned on the mat system illustrated in FIG. 8, according to an embodiment of the disclosure.

Once the mat system 52 is in place, at least one support structure 50 may be assembled and/or positioned on the mat system 52, as illustrated in FIG. 9. The support structure 50 is oriented for receipt of modular silos 28 in a desired orientation at well site 22. In the specific example illustrated, the support structure 50 is constructed and positioned to receive a plurality of the modular silos 28, e.g. two, three or four modular silos 28. After the support structure 50 is properly positioned, trucks 36 are used to deliver modular silos 28. In one embodiment, the mat system 52 may be integrated into a base of the support structure 50.

As illustrated in FIG. 5, for example, an individual modular silo 28 may be mounted in a horizontal position on trailer 100 of truck 36. As discussed above, each modular silo 28 may be designed as a modular unit used alone or in cooperation with other silos 28. The modularity along with the design and sizing of the modular silos 28 enables transport of individual modular silos 28 over public highways via trucks 36. When truck 36 and the corresponding modular silo 28 arrive at the well site 22, the truck 36 is used to back modular silo 28 into engagement with a first support connection of the support structure 50 on the mat system 52. For example, the first support connection of the support structure may include the pivot members 106. The modular silo 28 is moved toward support structure 50 until pivot members 106 of silo frame 56 engage corresponding pivot members 108 of support structure 50 to form pivot connectors 102. The pivot connectors 102 provide a connection between the modular silo 28 and the support structure 50 which allows the modular silo 28 to be securely erected in a controlled manner from a lateral, e.g. horizontal, position to an operational, upright position. By way of example, the hydraulic ram 104 depicted in FIG. 5 may be used to erect the modular silo 28 toward the upright position.

Trucks 36 are used to deliver subsequent modular silos 28 to support structure 50 until the desired number of modular silos 28 is positioned at the well site 22 as shown in FIG. 7. Each of the modular silos 28 is pivoted to the upright position on silo receiving regions 54 of support structure 50, as illustrated in FIG. 7. After the modular silos 28 are mounted upright on support structure 50, the modular silos 28 may be bolted or otherwise further secured to support structure 50. In some applications, the modular silos 28 also may be tied to each other to further stabilize the assembly. In the example illustrated, support structure 50 supports modular silos 28 at a sufficient height to receive a portable blending system 44 in the drive under region or passage 84. In this example, feeders of the modular silos 28 may be positioned to discharge the oilfield material into the passage 84. Additionally, enclosed conveyor systems 30 may be connected to the inlet hoppers 66 of vertical conveyors 32. At this stage, oilfield material 62 may be delivered to the well site 22 and loaded into modular silos 28 via conveyors 30 and vertical conveyors 32.

It should be noted that in some applications, the external conveyor or conveyors 30 have a section with an exposed belt which allows oilfield material to be unloaded via gravity from appropriately designed gravity feed trucks which are backed over the exposed belt. The oilfield material fed onto the belt is then conveyed into an enclosed section of the conveyor 30 and transported along an incline for release into at least one inlet 66 of a corresponding modular silo 28.

The arrangement and components of the proppant delivery system 20 may vary substantially depending on the parameters of a given fracturing operation. The modular silos 28 may be used individually or in groups of modular silos securely mounted on the support structure 50. The modular silos may be mounted at a sufficient height to direct outflowing oilfield material through an outflow feeder positioned at the bottom of the enclosed interior and into the passage 84. In other applications, the feeders may be positioned to direct outflow of oilfield material from a higher compartment within the modular silo 28. In some applications, the modular silos 28 may comprise an enclosed interior divided into a plurality of compartments for holding different types of oilfield material that may be selectively metered to the blender system 44 for blending into a desired mixture which is then pumped downhole into the wellbore.

Additionally, various belt conveyors or other types of conveyors may be enclosed to deliver oilfield material from the unload area to the upright, modular silos 28. The modular silos 28 also may incorporate a variety of vertical conveyors for lifting the oilfield material to an upper discharge region of the modular silos 28. Various arrangements of upright modular silos 28 enable storage of a substantial quantity of oilfield materials that may be readily supplied for use in a fracturing operation. The upright arrangement of modular silos 28 also provides for an efficient use of well site space. In addition to the space efficiency, the enclosed system for storing and delivering oilfield material provides a clean well site substantially free of dust production. However, depending on the specifics of a given fracturing operation, various numbers and arrangements of modular silos 28, conveyors 30 and 32, blending systems 44, and other well site equipment may be employed.

The support structure 50 and the mat system 52 also may be constructed in various forms and configurations depending on the parameters of the desired fracturing operation. For example, the support structure 50 may be constructed from many types of strut configurations, combinations of struts and other structural components, and/or structural walls or other devices to support the modular silos 28. In some applications, the support structure 50 may be constructed as an A-frame or truncated A-frame. The support structure 50 also may be constructed as a single connected unitary support structure or as a plurality of sub support structures which may be separated to accommodate separation of individual modular silos 28 and/or separation of groups of modular silos 28. Similarly, the mat system 52 may be constructed with a variety of materials and in a variety of configurations depending on the parameters of the fracturing operation and on the characteristics of the corresponding equipment, e.g. modular silos 28, blending systems 44, and other equipment which facilitate the hydraulic fracturing.

Figure 10:
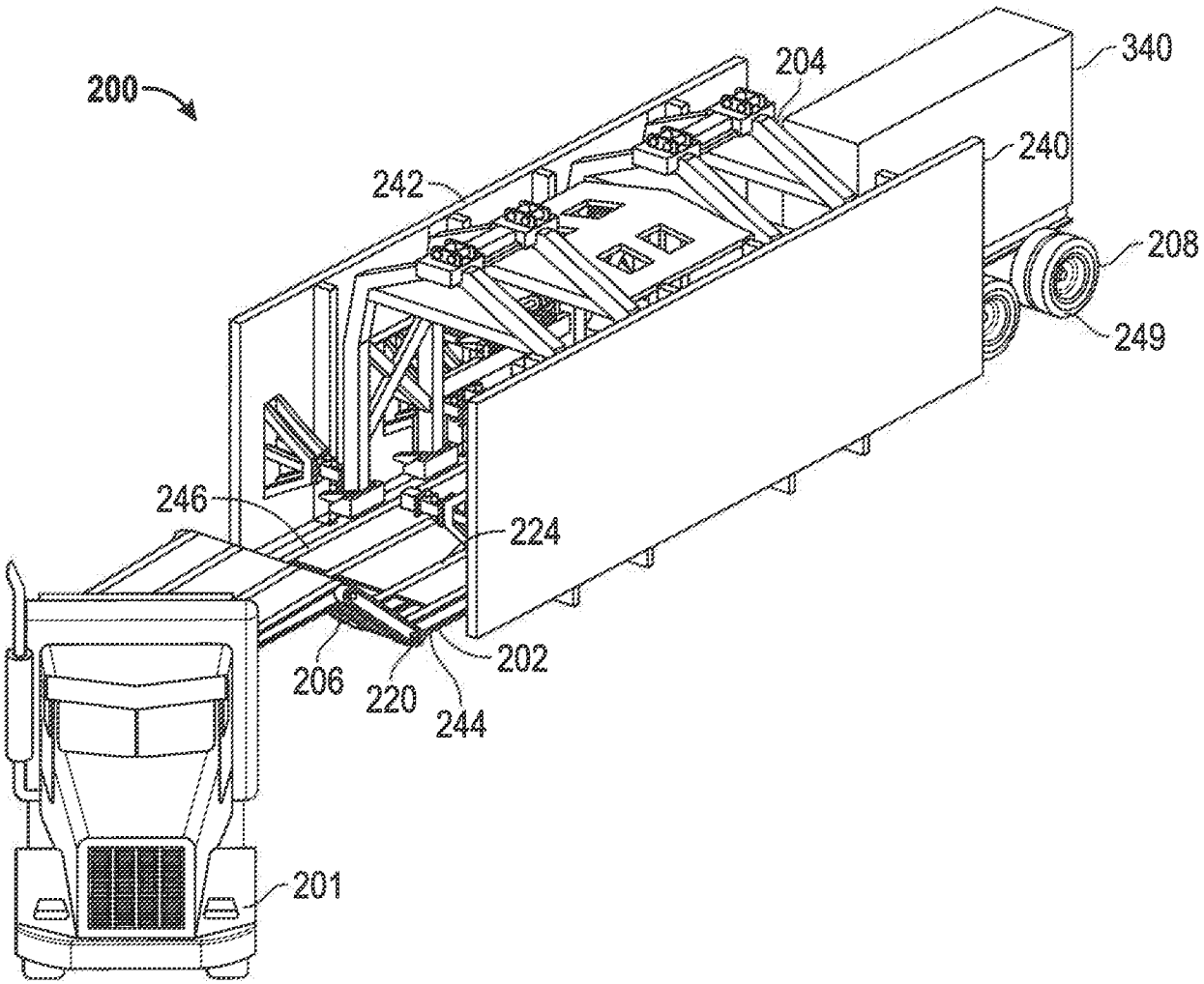
FIGS. 10-12 depict various illustrations of installing a mobile support structure at a location according to an embodiment of the disclosure.
Figure 11:
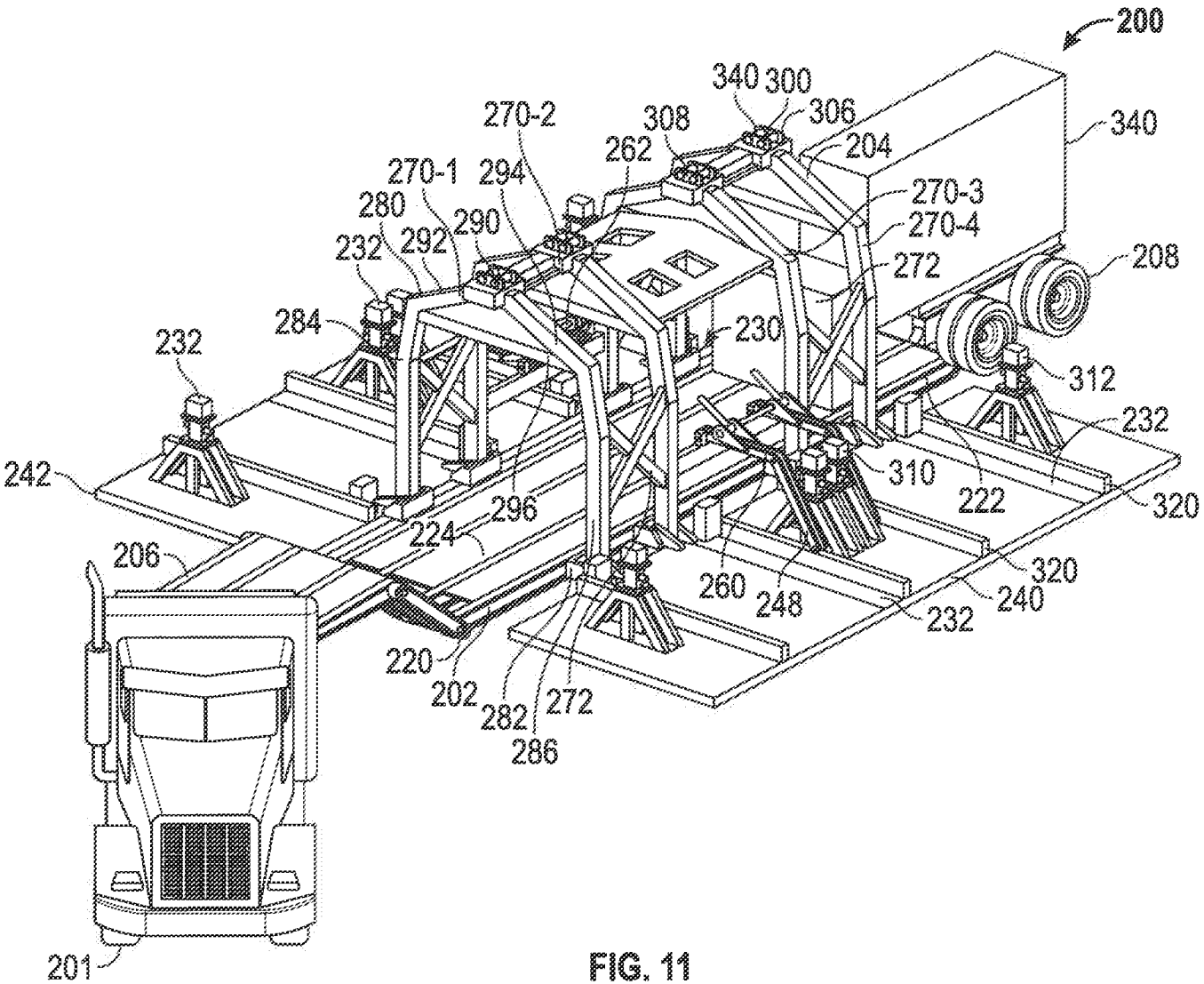
Figure 12:
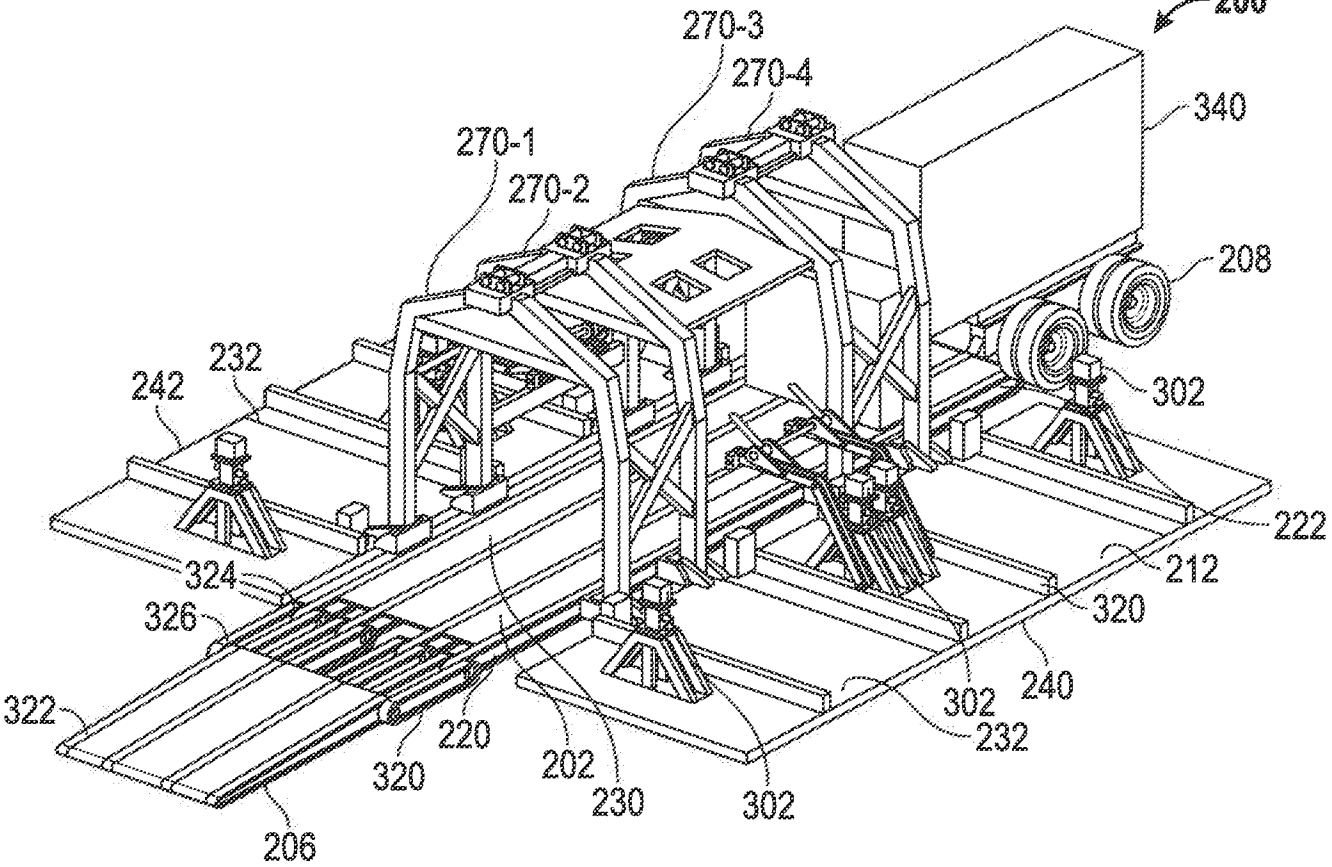
Figure 12A:
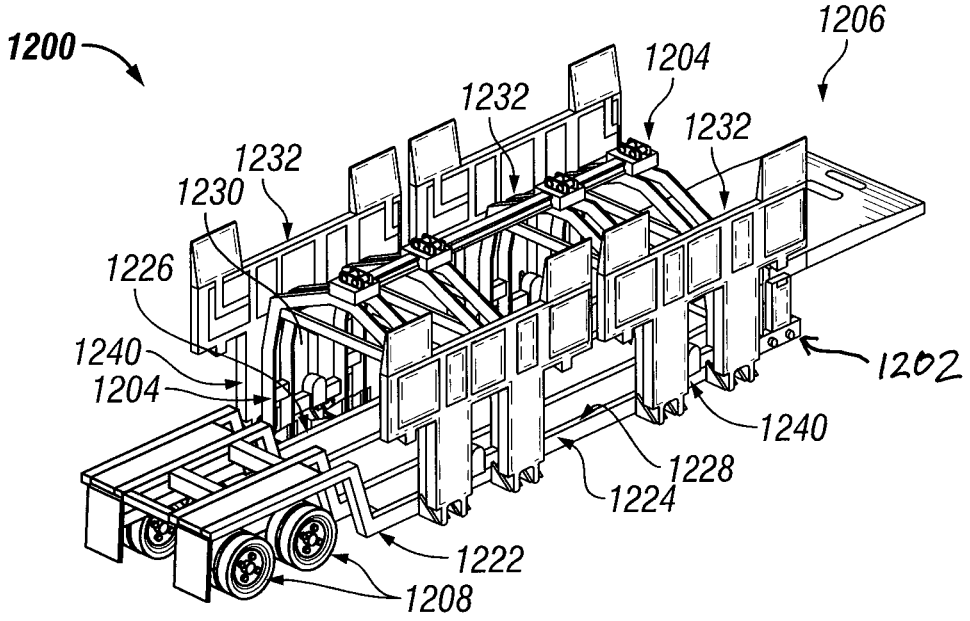
FIGS. 12A and 12B show another embodiment of mobile support structure in accordance with the disclosure.
Figure 12B:
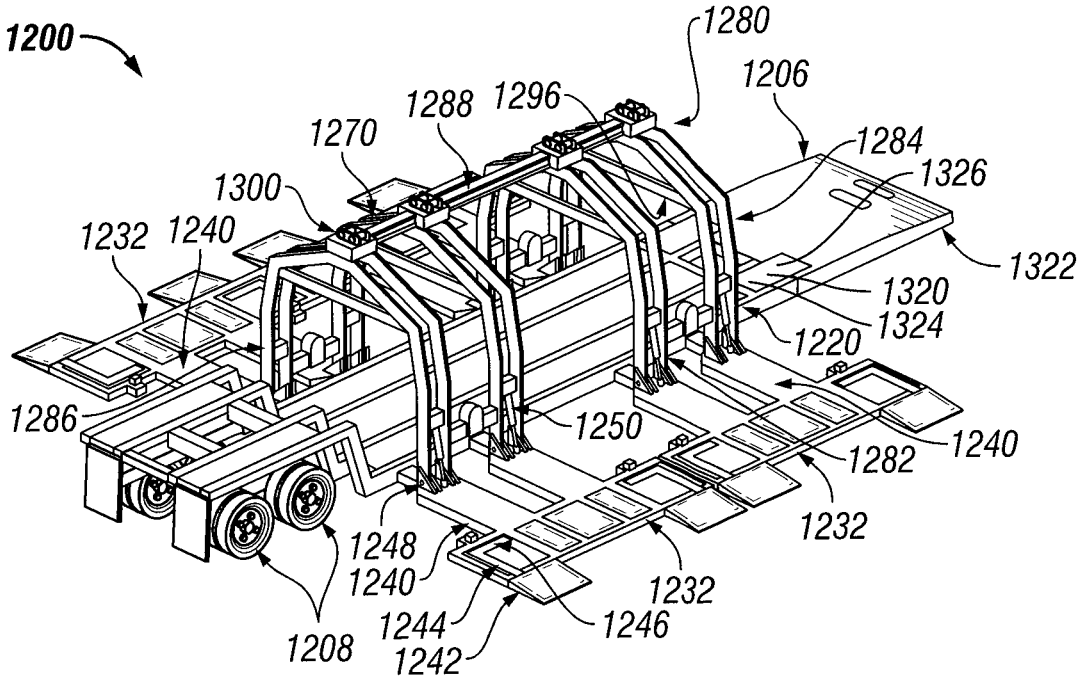

Shown in FIGS. 10, 11, 12, 13, 14 15, 16 and 17, is a mobile support structure 200 for supporting one or more modular silos 28 in accordance with the present disclosure. FIG. 10 shows the mobile support structure 200 in a transport configuration in which the mobile support structure 200 is configured to be transported on roadways by being pulled behind a truck 201. FIG. 11, on the other hand, shows the mobile support structure 200 in the process of being converted into an operational configuration for supporting one or more of the modular silos 28 while attached to the truck 201. FIG. 12 shows the mobile support structure 200 in the operational configuration and detached from the truck 201. In general, the mobile support structure 200 may be designed to comply with various state and federal regulations for transport over the highways. In this regard, the mobile support structure 200 may have a width and a height of less than about 14 feet and a length less than 53 feet. FIGS. 12A and 12B illustrate some other embodiments of mobile support structure in accordance with the disclosure. FIGS. 12A and 12B show the mobile support structure 1200 and 1400 in a transport configuration, the mobile support structure 1200 and 1400 configured to be transported by truck on roadways.

In the example shown, the mobile support structure 200 is provided with a support base 202, a frame structure 204, a gooseneck portion 206 and a plurality of wheels 208 for supporting the support base 202, the frame structure 204 and the gooseneck portion 206. The gooseneck portion 206 of the mobile support structure 200 can be attached to the truck 201 such that the truck 201 can move the mobile support structure 200 between various locations such as wellsites. As will be explained in more detail below, the mobile support structure 200 is designed to be transported to a wellsite, and then set up to support one or more of the modular silos 28. In the example shown, the mobile support structure 200 is designed to support up to four modular silos 28 (as shown in FIG. 1). However, it should be understood that the mobile support structure 200 can be designed to support more or less of the modular silos 28 depending upon state and federal regulations determining the size of the mobile support structure 200 as well as the width and/or size of the modular silos 28.

The support base 202 is provided with a first end 220, a second end 222, a top surface 224 and a bottom surface (not shown). The frame structure 204 is connected to the support base 202. The frame structure 204 extends above the support base 202 to define a passage 230 generally located between the top surface 224 and the frame structure 204. The frame structure 204 has at least one silo receiving region 232 sized and configured to receive at least one of the modular silo 28. In the example shown, the frame structure 204 has four silo receiving regions 232 with each of the silo receiving regions 232 designed to support one of the modular silos 28.

The gooseneck portion 206 extends from the first end 220 of the support base 202 and is configured to connect to the truck 210 as discussed above. The axles 208 can be located proximate to the second end 222 of the support base 202 as shown in FIG. 10, for example. In the example shown in FIG. 10, the mobile support structure 200 is provided with two axles. However, it should be understood that more than two axles can be used and positioned at various locations relative to the support base 202 to support the components of the mobile support structure 200.

As shown in FIG. 10, the mobile support structure 200 is also provided with a first expandable base 240 and a second expandable base 242 to provide further lateral support to the modular silos 28 to prevent the modular silos 28 from falling over. In the example shown, the support base 202 is provided with a first side 244 and a second side 246. The first expandable base 240 is positioned on the first side 244 of the support base 202 and the second expandable base 242 is positioned on the second side 246 of the support base 202.

The first and second expandable bases 240 and 242 may be movably connected to at least one of the frame structure 204 and the support base 202 via a mechanical linkage 248 so that the first and second expandable bases 240 and 242 may be selectively positioned between a travel position as shown in FIG. 10 and a support position as shown in FIG. 11. In the travel position shown in FIG. 10, the first and second expandable bases 240 and 242 extend substantially vertically and adjacent to the frame structure 204 so as to be within acceptable size limits for transporting the mobile support structure 200 on public roads and highways. However, in the support position shown in FIG. 11, the first and second expandable bases 240 and 242 extend substantially horizontally from the frame structure 204 to provide additional lateral support for the modular silos 28.

In one embodiment, the support base 202 is provided with a linkage (not shown) supported by the wheels 208 for moving the support base 202 in a vertical direction relative to the wheels 208 between a travel position in which the support base 202 is located above in a lower portion 249 of the wheels 208 (as shown in FIG. 10) and a support position in which the support base 202 is positioned on the ground and at least a portion of the support base 202 is aligned with the lower portion 249 of the wheels 208. When the support base 202 is positioned on the ground and the first and second expandable bases 240 and 242 are positioned in the support position, the support base 202 and the first and second expandable bases 240 and 242 may be coplanar. Further, the support base 202 and the first and second expandable bases 240 and 242 may be positioned on a pad to aid in stabilizing the support base 202 and the expandable bases on the ground at the wellsite prior to erecting the modular silos 28 onto the mobile support structure 200. The support base 202 may provide support to the one or more silos in sub-optimal ground surface conditions.

The mechanical linkage 248 movably connecting the frame structure 204 and/or support base 202 with the first and second expandable bases 240 and 242 can be implemented in a variety of manners. For example, the mechanical linkage 248 may be provided with a first set of hinges connecting the first expandable base 240 to the frame structure 204 and a second set of hinges connecting the second expandable base 242 to the frame structure 204. To automate the movement of the first and second expandable bases 240 and 242 between the support position and the travel position, the mechanical linkage 248 may be provided with a first set of actuators 260 and a second set of actuators 262. The first set of actuators 260 are connected to the frame structure 204 and the first expandable base 240. The second set of actuators 262 are connected to the frame structure 204 and the second expandable base 242. In general, the first set of actuators 260 and the second set of actuators 262 are configured to selectively move the first and second expandable bases 240 and 242 between the support position and the travel position. The first and second sets of actuators 260 and 262 can be constructed in a variety of manners and may include a hydraulic cylinder, a pneumatic cylinder, or a solenoid. In the example shown, the first set of actuators 260 is provided with two actuators and the second set of actuators 262 is also provided with two actuators. However, it should be understood that more or less actuators can be provided within the first and second set of actuators 260 and 262 depending upon the size of the actuators which are used.

Shown in FIG. 11 is a diagram of the mobile support structure 200 having the first and second expandable bases 240 and 242 positioned in the support position and showing the frame structure 204 more clearly than in FIG. 10. The frame structure 204 is provided with a plurality of frames 270 which are interconnected with a plurality of struts 272. In the example shown, the frame structure 204 is provided with four frames 270 (which are labeled in FIG. 11 with reference numerals 270-1, 270-2, 270-3 and 270-4. However, it should be understood that frame structure 204 may include more than four frames 270 or less than four frames 270. In the example shown, each of the frames 270 positioned in parallel and substantially identical in construction and function. For this reason, only one of the frames 270 will be described in detail hereinafter.

The frame 270-1, for example, is provided with a top member 280, a bottom member 282, and two side members 284 and 286 that are connected to form a closed structure surrounding at least a portion of the passage 230. The bottom member 282 is positioned within a passageway (not shown) extending through the support base 202 and is connected to the side members 284 and 286 to maintain the side members 284 and 286 a fixed distance apart. As shown in FIG. 11, the side members 284 and 286, and top member 280 may be shaped and connected to form an arch shape so as to increase the structural strength of the frame 270-1. The top member 280 is provided with an apex 290 which may be centrally located between the side members 284 and 286. The top member 280 includes a first leg 292 and a second leg 294 which are connected together at the apex 290. The first leg 292 is connected to the side member 284 and the second leg 294 is connected to the side member 286. The top member 280 may also be provided with a support beam 296 so as to increase the strength of the top member 280. In particular, the support beam 296 reinforces the first leg 292 and the second leg 294 to prevent the first leg 292 from deflecting relative to the second leg 294 and vice-versa when the modular silos 28 are being supported. The frame 270-1 can be made of any suitably strong and durable material to be able to support the load from the modular silos 28. For example, the top member 280, a bottom member 282, and two side members 284 and 286 may be constructed of pieces of tubular steel that are connected together using any suitable technique, such as mechanical fastening techniques utilizing combinations of bolts, plates and welds.

Figure 17:
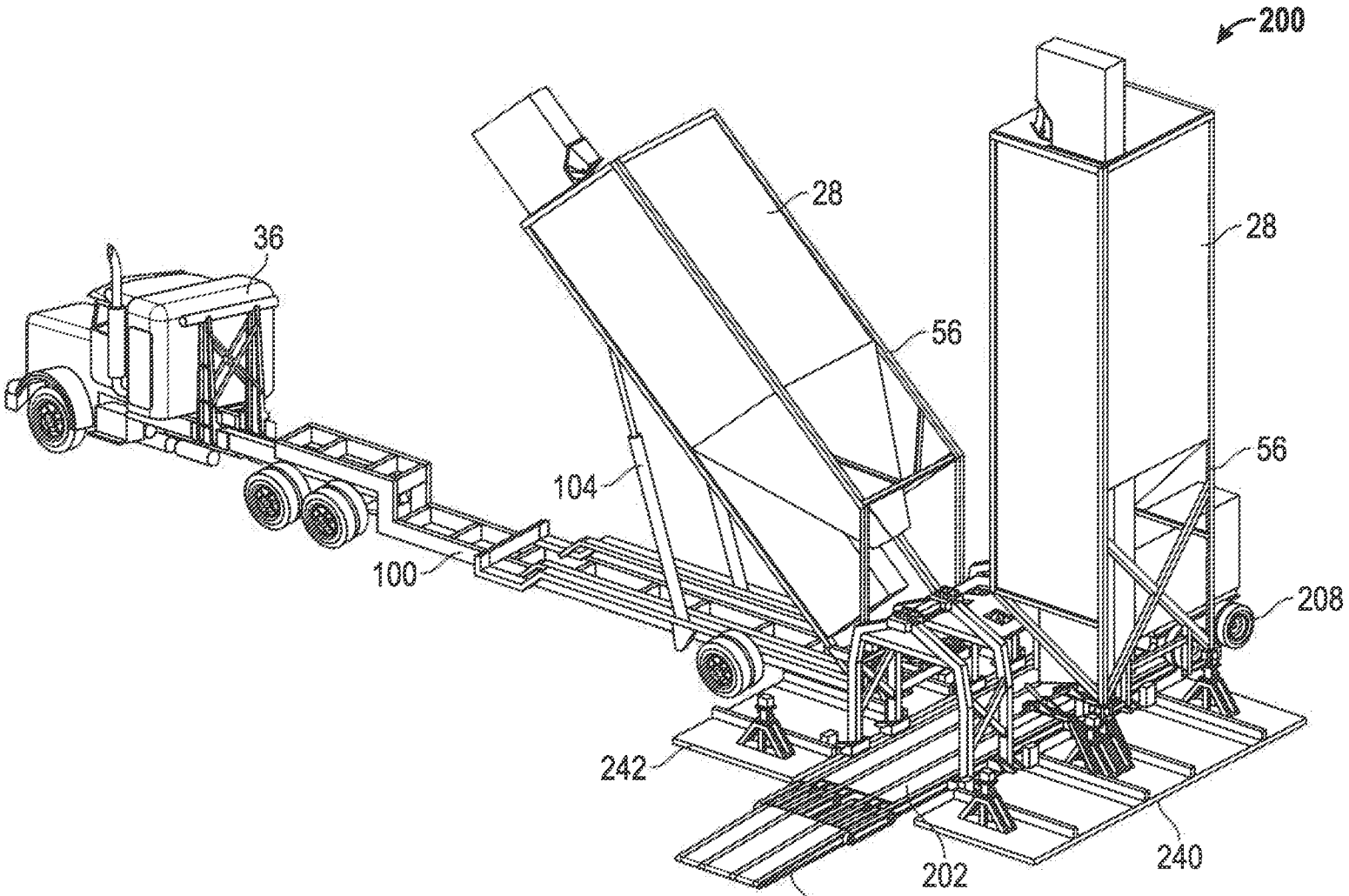

The frames 270-1 and 270-2 are connected by the struts 272 and are adapted to jointly support two modular silos 28. Likewise, the frames 270-3 and 270-4 are connected by the struts and are adapted to jointly support two modular silos 28 as shown in FIG. 17. In particular, the frames 270-1 and 270-2 form two silo receiving regions 232 of the mobile support structure 200, and the frames 270-3 and 270-4 form two other silo receiving regions 232. Within each of the silo receiving regions 232, the mobile support structure 200 is provided with a first connection 300 and a second connection 302. The first connection 300 within each of the silo receiving regions 232 is located at the apex 290 of the frames 270-1-4. The second connection 302 within each silo receiving region 232 is located on either the first expandable base 240 or the second expandable base 242 and at a lower elevation than the first connection 300 to engage the silo frame 56 when the modular silo 28 is on the trailer 37.

Figure 13:
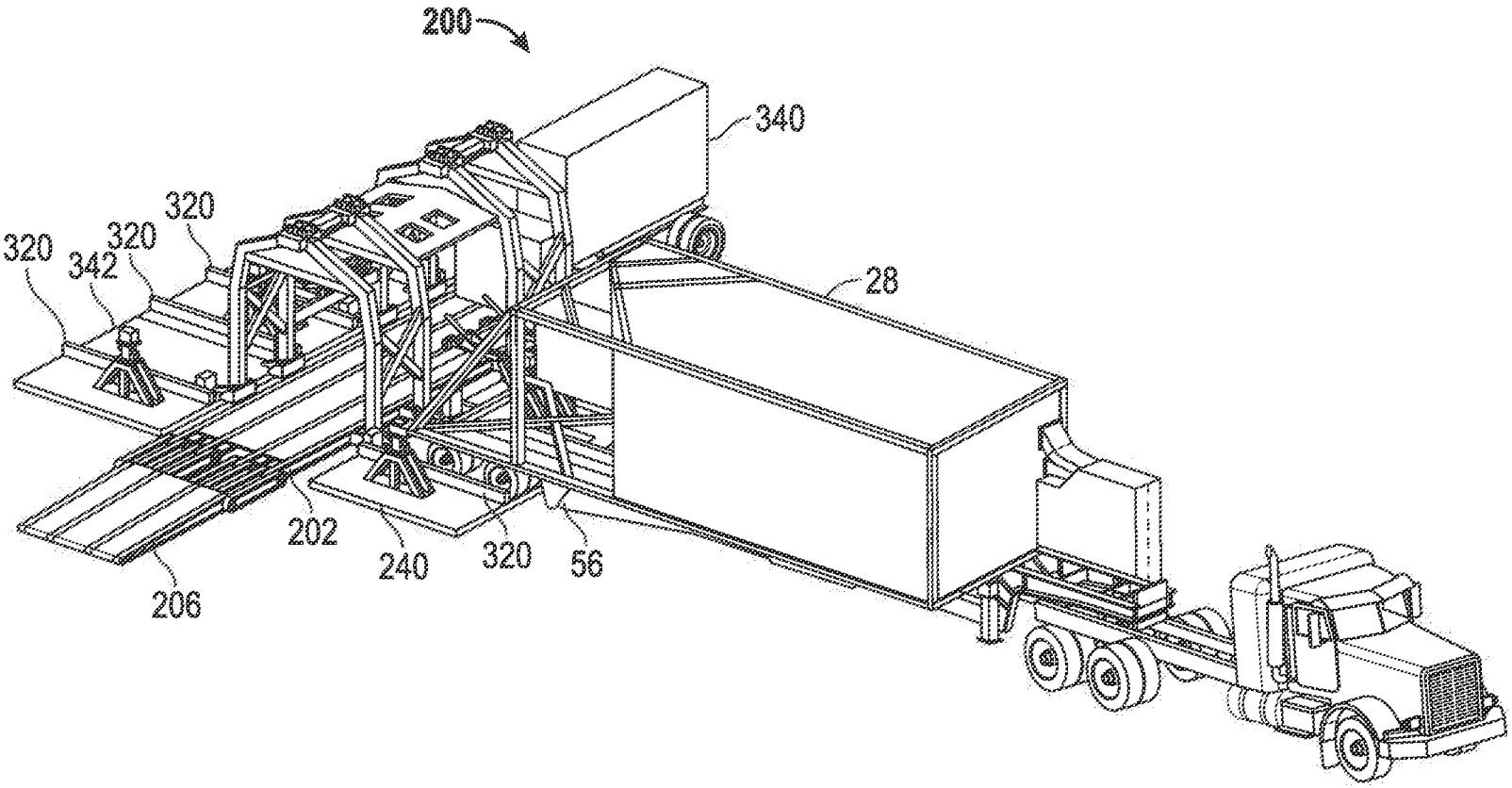
FIGS. 13-15 depict various illustrations of aligning a modular silo with connections of the mobile support structure at a location according to an embodiment of the disclosure.
Figure 14:
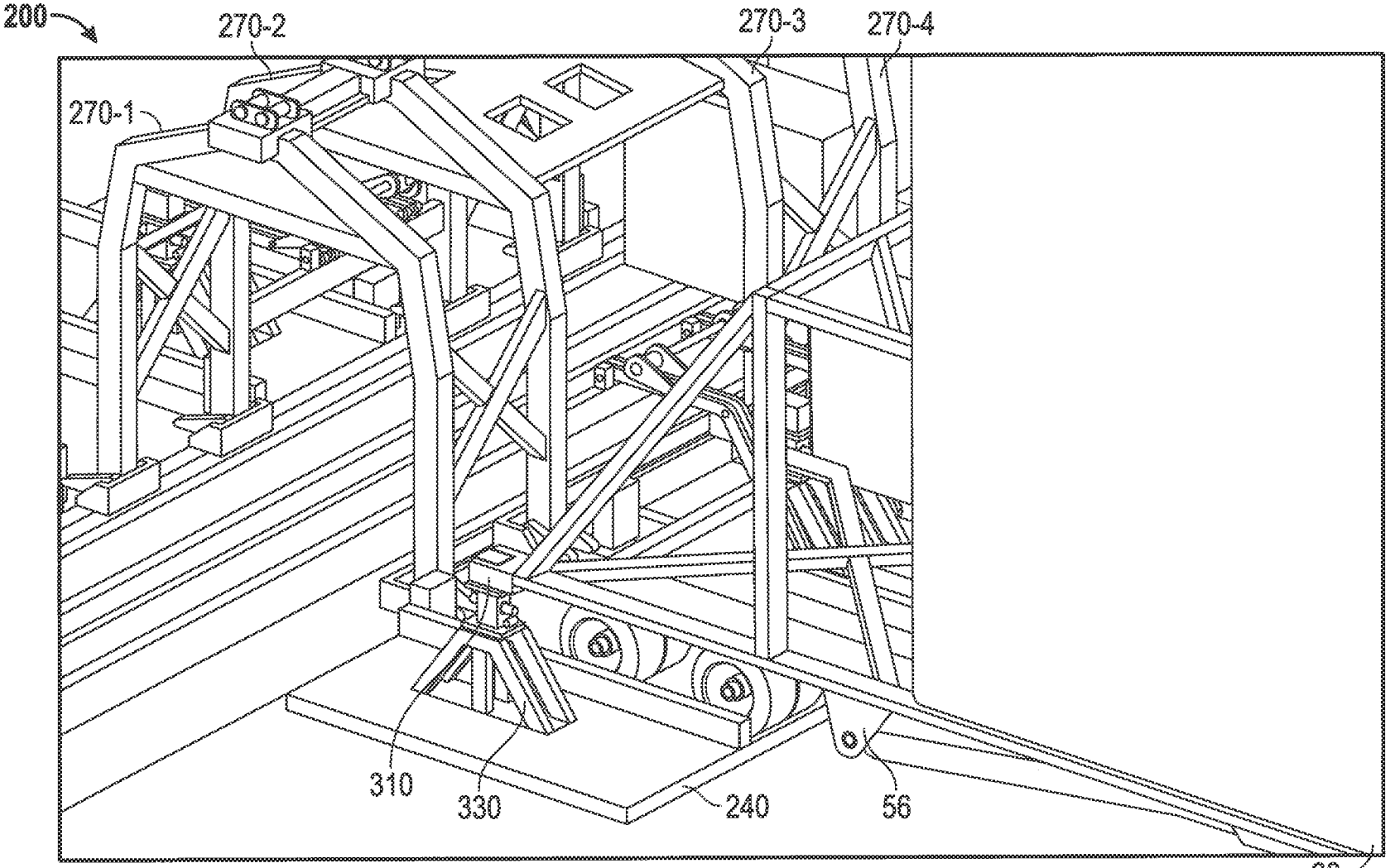

The first connection 300 within each of the silo receiving regions 232 includes a first connector 306 and a second connector 308 that are configured to attach to the silo frame 56 of the modular silos 28. The second connection 302 within each of the silo receiving regions 232 includes a first connector 310 and a second connector 312 that are configured to attach to the silo frame 56 of the modular silos 28. The first connector 310 and the second connector 312 of the second connection 302 are configured to connect to the silo frame 56 of the modular silo 28 when the modular silo 28 is positioned on the trailer 37 as discussed above. For example, as shown in FIG. 13, the trailer 37 can be backed to align the silo frame 56 with the first connector 310 and the second connector 312 of the second connection 302. As shown in FIGS. 13 and 14, to aid in backing the trailer 37 to align the silo frame 56 with the first connector 310 and the second connector 312 of the second connection 302, alignment guides 320 may be provided on the first expandable base 240 and the second expandable base 242 within each of the silo receiving regions 232.

In any event, once the silo frame 56 of the modular silo 28 to be erected onto the mobile support structure 200 is connected to the second connection 302, the modular silo 28 may be moved into the vertical position as discussed above using a ram, crane or other suitable mechanical assembly. When the modular silo 28 is in the vertical position, the silo frame 56 is connected to the frame structure 204 via the first connection 300 to maintain the modular silo 28 securely on the mobile support structure 200.

Once the support base 202 and the first and second expandable bases 240 and 242 have been deployed to the support position, the truck 201 can be disconnected from the gooseneck portion 206 of the mobile support structure 200. Once the truck 201 has been disconnected, the gooseneck portion 206 may be manipulated to lie on the ground and be generally co-planar with the support base 202. In this configuration, the gooseneck portion 206 may form a ramp to aid the operator in positioning the blending system 44 within the passage 230 as shown in FIG. 1. The gooseneck portion 206 may be provided with a first section 320 and a second section 322. The first section 320 extends from the first end 220 of the support base 202. The first section 320 has a first end 324 and a second end 326. The first end 324 of the first section 320 is movably connected to the support base 208, such as by the use of a set of hinges, voids and pins or other types of connectors which may be locked at more than one position. The second section 322 is movably connected to the second end 326 of the first section 320. For example, the first section 320 may be a four bar linkage which can be locked in an elevated position to form the gooseneck, or a lowered position to form the ramp Shown in FIG. 12 is the mobile support structure 200 in the operational configuration. In the operational configuration depicted in FIG. 12, the modular silos 28 can be loaded onto the mobile support structure 200, as shown for example, in FIGS. 1 and 13-17, and the blending system 44 can be positioned within the passage 230.

Shown in FIGS. 13-17 is an example in which a modular silo 28 is being placed into position on the mobile support structure 200. In this example, each individual modular silo 28 is transported to the well site 22 by the truck 36. As illustrated, the truck 36 may comprise the tractor 98 pulling the trailer 100 appropriately sized to receive one of the silos 28 in a lateral, e.g. horizontal, orientation.

Each truck 36 may be backed up to move the laterally positioned modular silo 28 into engagement with a corresponding silo receiving region 232 of the mobile support structure 200. Additional guide rails may be designed into the first and second expandable bases 240 and 242 to aid in the alignment of the silo trailer to the silo receiving region 232. Furthermore to aid in the proper alignment, the first and second expandable bases 240 and 242 may also serve as a reference elevation for the silo trailer.

As discussed above, the mobile support structure 200 may comprise the second connection 302 or other suitable structures located at an appropriate height to receive and engage each modular silo 28 when in the lateral position on the truck 36. By way of example, the mobile support structure 200 and the corresponding modular silos 28 may use the first and second connectors 310 and 312 by which the modular silo 28 may be selectively engaged with the mobile support structure 200. The first and second connectors 310 and 312 may be pivot connectors that are positioned to allow engagement and connection of each modular silo 28 with the mobile support structure 200 while the modular silo 28 is in a lateral position on the truck 36. The first and second connectors 310 and 312 also are designed to maintain engagement of the modular silo 28 with the mobile support structure 200 as the modular silo 28 is pivoted from the lateral position to an operational upright, e.g. vertical, orientation.

The modular silos 28 may be pivoted or moved about the first and second connectors 310 and 312 from the lateral position on the truck 36 to the operational, upright position on the support frame 204 of the mobile support structure 200 by a variety of mechanisms. For example, the ram 104 may be used to erect each modular silo 28 between the lateral and upright positions. The ram 104 may be a hydraulic or pneumatic ram positioned on trailer 100 to act against frame 56 of each modular silo 28 to pivot the modular silo 28 about the first and second connectors 310 and 312 until the modular silo 28 is securely received in its upright position by the silo receiving region 232. The ram 104 may be designed to operate off a hydraulic (or pneumatic) system of the truck 36. In other applications, the ram 104 may be designed to pivot the trailer 100 or a portion of the trailer 100 upwardly while the modular silo 28 remains attached to the pivoting portion of the trailer 100. Other techniques may utilize cranes, pulleys, and/or other mechanisms to pivot each modular silo 28 about the first and second connectors 310 and 312 as the modular silo 28 is transitioned from the lateral position to the operational, upright orientation.

Figure 15:
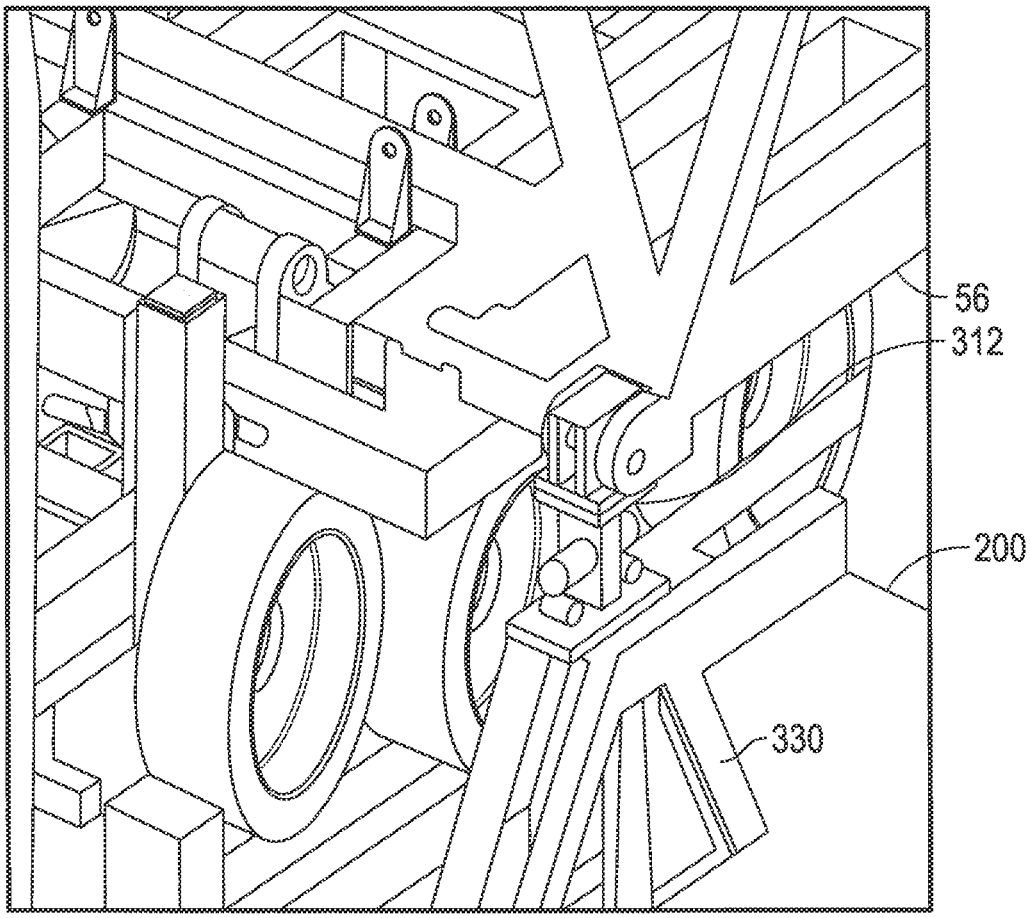
Figure 16:
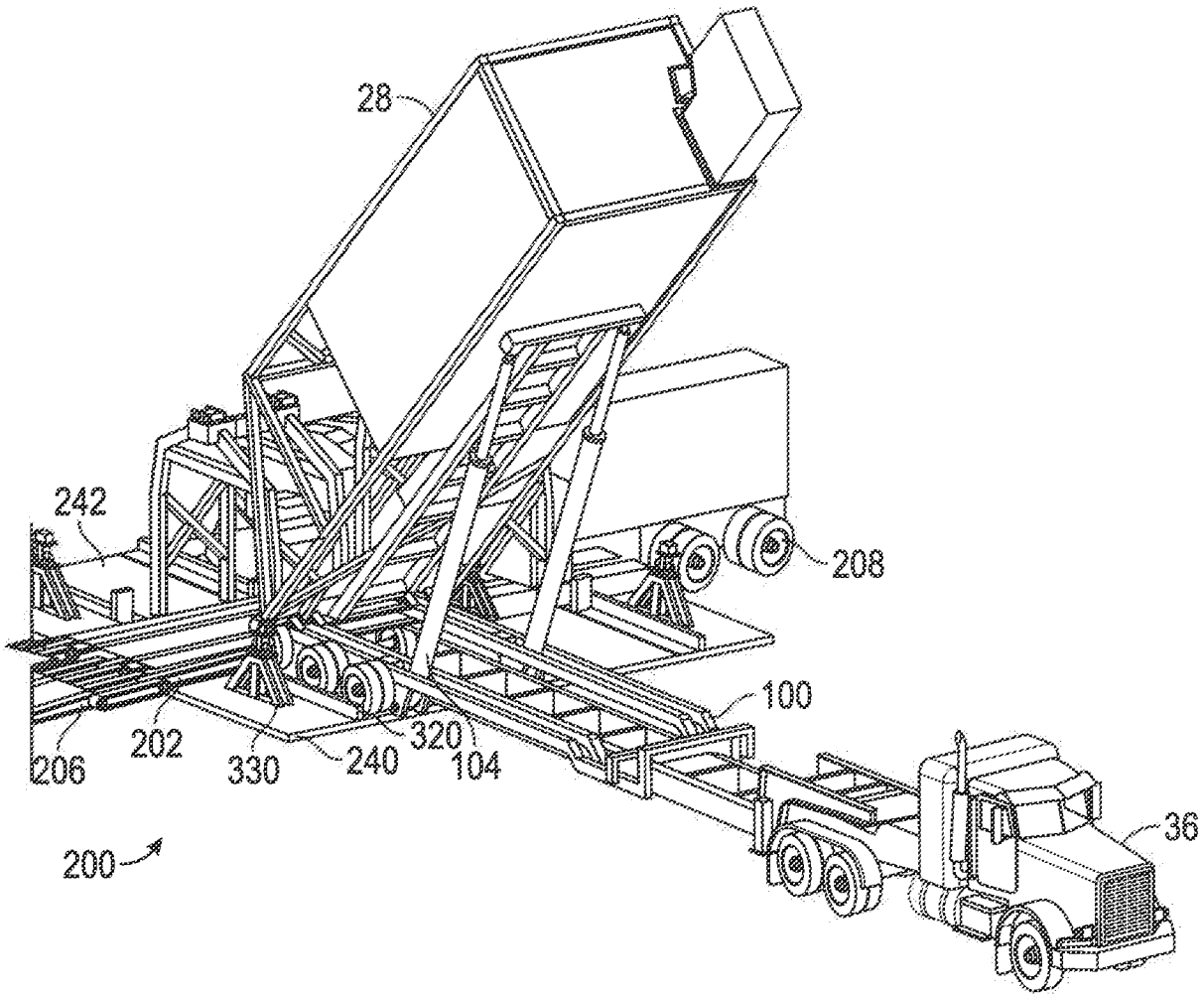
FIGS. 16-17 depict various illustrations of erecting the modular silos onto the mobile support structure according to an embodiment of the disclosure.

The first and second connectors 310 and 312 are shown in more detail in FIGS. 14 and 15. The first and second connectors 310 and 312 are used to facilitate formation of the connection between each modular silo 28 and the mobile support structure 200 and may comprise a variety of individual or plural connector mechanisms. Generally, each of the first and second connectors 310 and 312 are designed to permit controlled movement of the modular silo 28 relative to the mobile support structure 200. The first and second connectors 310 and 312 may comprise a pivot member mounted to the silo 28 and a corresponding pivot member mounted on the mobile support structure 200, e.g. mounted on struts 330, as illustrated in FIGS. 14 and 15. In the specific example illustrated in FIGS. 14 and 15, each modular silo 28 is pivotably engaged with the mobile support structure 200 via a pair of the pivot members. By way of example, each pivot member may comprise a pin rotatably, e.g. pivotably, received in a corresponding pin receiver of the pivot member. Although pin may be connected to frame 56 of modular silo 28 and pin receiver may be connected to pivot struts 330 of support structure 50, the pin and the pin receiver can be reversed. Additionally, the first and second connectors 310 and 312 may comprise a variety of other structures designed to enable selective engagement of the modular silos 28 with the mobile support structure 200 and controlled movement of the modular silos 28 with respect to the mobile support structure 200. Depending on the design of the first and second connectors 310 and 312, a variety of retention features such as an expanded pin head may be used to maintain the pivotable connection between the modular silo 28 and the mobile support structure 200 during transition of the modular silo 28 from the lateral position to the upright position.

The mobile support structure 200 may also be provided with other types of equipment to facilitate the handling of the oilfield material and/or the blending of the oilfield material to form the slurry as discussed above. For example, the mobile support structure 200 may be provided with a power generation system 340 that is supported by the wheels 208. In this embodiment, the power generation system 340 may be utilized to generate electrical power which may be provided to the conveyors 30 and 32 as well as other equipment at the proppant delivery system 20. The mobile support structure 200 may also be provided with a dry additives feeder, power sources, controls and controllers, a skid for supporting a blender system integrated into the support base 202. Further, the mobile support structure 200 may be provided with weather proofing to protect from the harsh environmental conditions. Further, the mobile support structure 200 may be provided with various sensors 116 positioned on the frame structure 204 and/or on modular silos 28 to detect and/or monitor parameters related to the delivery of oilfield material 62 for a given fracturing operation. By way of example, the sensors 116 may comprise four load cells in each silo receiving region 232 and may be part of the connectors 306, 308, 310 and 312 to monitor the loads applied by individual modular silos 28. The loading data may be used to track the amount of oilfield material that remains in enclosed interior 60 of each modular silo 28 for inventory management purposes.

Figure 18:
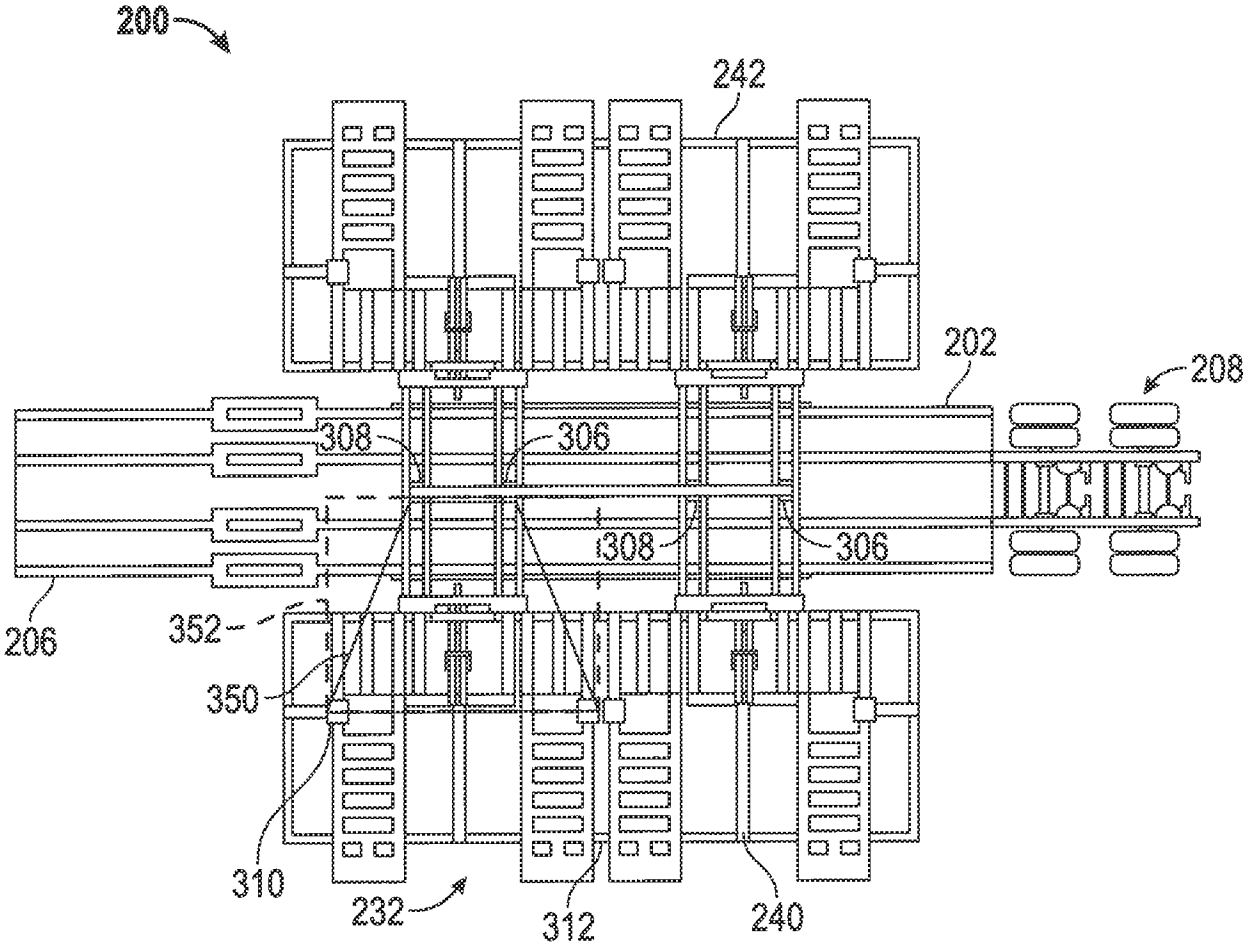
FIG. 18 is a top plan view of the exemplary mobile support structure depicted in FIGS. 10-17.

Shown in FIG. 18 is a top plan view of the mobile support structure 200. The connectors 306, 308, 310 and 312 may be arranged in a truncated triangle configuration 350, such as a trapezoid to enhance the stability of the modular silo 28 supported within the silo receiving region 232. Further, to aid in the support of the modular silo 28, the combined horizontal area of the support base 202, first expandable base 240 and second expandable base 242 is much larger than the horizontal area occupied by one of the modular silos 28 when installed on the mobile support structure 200. For example, a first horizontal area 352 occupied by one of the modular silos 28 when positioned in a vertical orientation is shown in FIG. 18. As can be seen, the support base 202, first expandable base 240 and the second expandable base 242 occupy a combined second horizontal area that is at least one and a half times as large as the first horizontal area 352 and may be eight or ten times as large as the first horizontal area 352.

Referring now to FIGS. 12A and 12B, another embodiment of the disclosure, mobile support structure 1200 includes support base 1202, frame structure 1204, gooseneck portion 1206 and a plurality of wheels 1208 for supporting the support base 1202, the frame structure 1204 and the gooseneck portion 1206. The gooseneck portion 1206 of the may be attached to a truck to move the mobile support structure 1200 between various locations. The mobile support structure 1200 is designed to support up to four modular silos. However, it should be appreciated that the mobile support structure 1200 can be designed to support more or less of the modular silos depending upon jobsite and/or regulatory requirements. The support base 1202 is provided with a first end 1220, a second end 1222, a first side 1224, a second side 1226, a top surface 1228 and a bottom surface (not shown). Frame structure 1204 connects to support base 1202, and frame structure 1204 extends above support base 1202 to define a passage 1230. Frame structure 1204 has at least one extended base 1232 including a modular silo receiving region 1240, which is a skeletonized or framework design. A first and second extended base 1232 are illustrated, which are connected with first side 1224, and a third and fourth extended base connected with second side 1226, of support base 1202. In the example shown, the frame structure 1204 has four silo receiving regions 1240 with each of the silo receiving regions 1240 designed to support one of the modular silos. Extended base 1232 may provide lateral support for modular silos and prevent the modular silos from falling over.

Ramps 1242 (six shown) are outwardly disposed upon extended base 1232. Ramps 1242 may allow wheel access to the surface of extended base 1232, in operational position, for various reasons, including material delivery to the system, maintenance, rig up, and the like. The surface of extended base 1232 may further include wheel guides 1244 and wheel chocks 1246 disposed thereon for accommodating, stabilizing and controlling the position of a wheel when moved onto the surface of extended base 1232.

Extended base 1232 may be movably connected to support base 1202 and/or frame structure 1204 by a suitable mechanical linkage at positions 1248 (four shown). The mechanical linkage at positions 1248 which movably connect the frame structure 1204 and/or support base 1202 with the extended base 1232 may be implemented in a variety of manners, such as, for example, hinges connecting the extended base 1232 to frame structure 1204, a pivot pin system connecting extended base 1232 to frame structure 1204, and the like. Extended base 1232 may be selectively positioned between a travel position as shown in FIG. 12A and an operational support position as shown in FIG. 12B, where the position may be selected by any suitable position control device 1250 (four shown), such as a hydraulic cylinder, a pneumatic cylinder, a solenoid and the like. The extended bases 1232 may be substantially vertically positioned adjacent to frame structure 1204 in a travel position, while in an operational position, extended bases 1232 may be positioned substantially horizontally from frame structure 1204 to provide additional support for modular silos.

Referring again to FIG. 12A, the gooseneck portion 1206 extends from the first end 1220 of the support base 1202 and is configured to connect to a truck. Wheels 1208, connected by axles, may be located proximate to the second end 1222 of the support base 1202. While the example shown in FIGS. 12A and 12B shows two wheel and axle configurations, any number of wheel and axle configurations may be used and positioned at any suitable location(s) relative to the support base 1202 to support the components of the mobile support structure 1200.

Shown in FIG. 12B, frame structure 1204 is provided with a plurality of frames 1270. In the example shown, the frame structure 1204 is provided with four frames 1270. While four frames 1270 are shown, it should be appreciated that frame structure 1204 may include more than four frames 1270 or less than four frames 1270. Each frame 1270 includes a top member 1280, a bottom member 1282, and two side members 1284 and 1286 that are connected to form a closed structure surrounding at least a portion of the passage 1230. The top member 1280 may also be provided with a support beam 1296 to increase the strength of the top member 1280. A plurality of frames 1270 may be interconnected at top members 1280 with beam 1288 to further increase the strength and stability of structure 1204. The mobile support structure 1200 is provided with a connection 1300 (eight shown), located at the apex of the frames 1270, for receiving and connecting with modular silos. Connections 1300 are located within an upper silo receiving region sized and configured to receive at least one modular silo.

Upon deployment of support base 1202 and extended bases 1240 to the support position, the truck can be disconnected from the gooseneck portion 1206 of the mobile support structure 1200. The gooseneck portion 1206 may be manipulated to lie on the ground and be generally co-planar with the support base 1202. Gooseneck portion 1206 may form a ramp to enable accommodation of a blending system (such as 44 shown in FIG. 1 for example) within the passage 1230. The gooseneck portion 1206 may include a first section 1320 extending from the first end 1220 of the support base 1202, where the first section 1320 includes first end 1324 and second end 1326. First end 1324 of first section 1320 is movably connected to the support base 1202, by suitable connector which may be locked at more than one position. A second section 1322 is movably connected to the second end 1326 of the first section 1320. For example, the first section 1320 may be a four bar linkage which can be locked in an elevated position to form the gooseneck, or a lowered position to form the ramp.

Figure 12C:
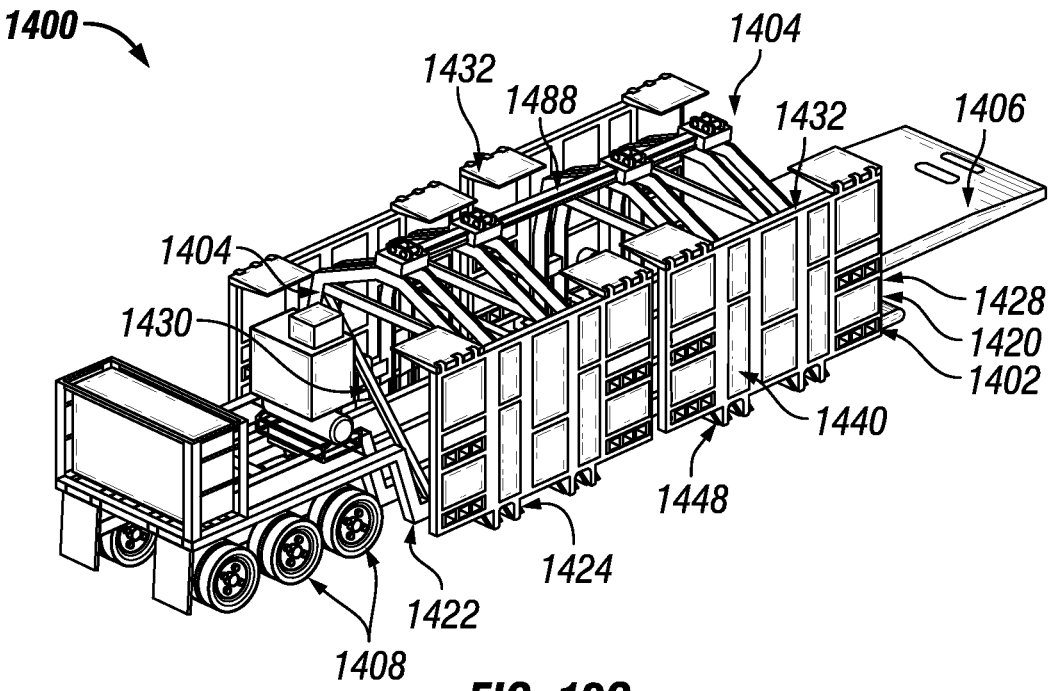
FIGS. 12C and 12D show yet another embodiment of mobile support structure in accordance with the disclosure.
Figure 12D:
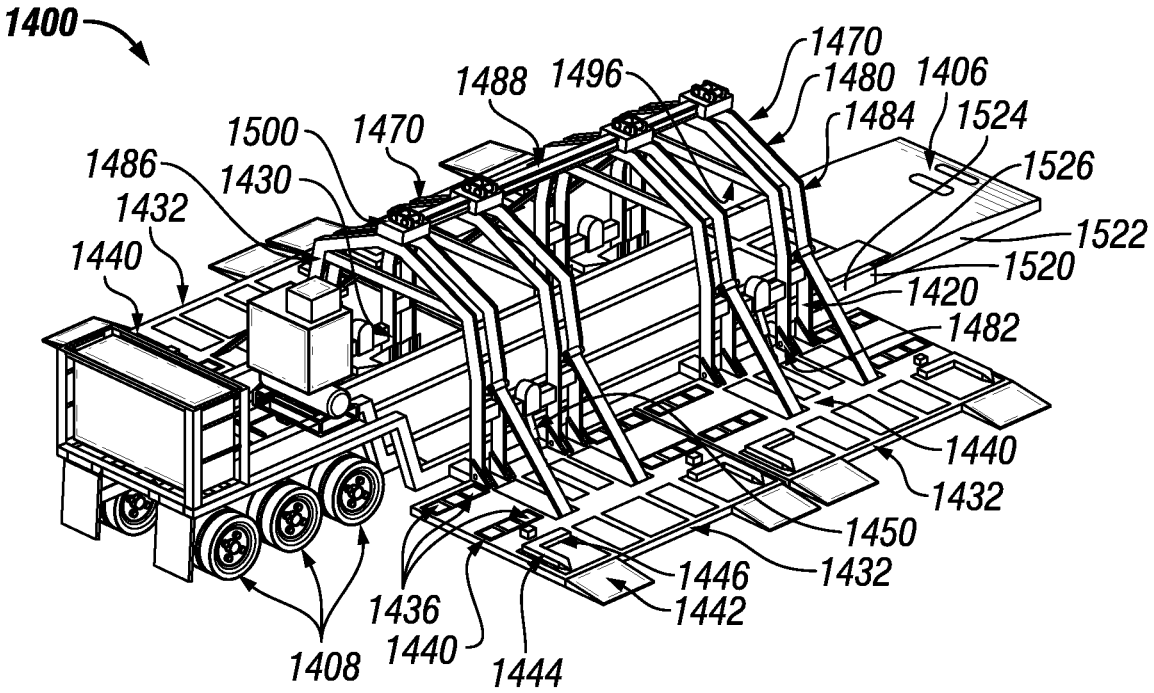

Referring to FIGS. 12C and 12D, in another embodiment of the disclosure, mobile support structure 1400 includes frame structure 1404, gooseneck portion 1406, support base 1402, and a plurality of wheels 1408 for supporting the support base 1402, the frame structure 1404 and the gooseneck portion 1406 which may be attached to a truck to move the mobile support structure 1400 between locations. Mobile support structure 1400 is designed to support up to four modular silos, however, it should be appreciated that the mobile support structure 1400 can be designed to support more or less of the modular silos depending upon requirements. Support base 1402 has first end 1420, second end 1422, first side 1424, opposed second side 1426 (not shown), top surface 1428 and a bottom surface (not shown). Frame structure 1404 connects with support base 1402, frame structure 1404 extends above support base 1402 to define passage 1430, and frame structure 1404 has at least one extended base 1432 having a framework design which includes a modular silo receiving region 1440. A first and second extended base 1432 are illustrated connected with first side 1424, and a third and fourth extended base 1432 connected with second side 1426, of support base 1402. The four extended bases 1432 shown provide four silo receiving regions 1440, with each of the silo receiving regions 1440 designed to support a modular silo. The receiving regions 1440 of extended bases 1432 further include openings 1436 for receiving and interlocking, or otherwise connecting, with a portion of a silo base, such as base extensions 690 shown in FIG. 2B. Extended base 1432 may provide lateral support for modular silos. Ramps 1442 may be outwardly disposed upon extended base 1432, and allow wheel access to the surface of extended base 1432. The surface of extended base 1432 may further include wheel guides 1444 and wheel chocks 1446.

Extended base 1432 may be movably connected to support base 1402 and/or frame structure 1404 by a suitable mechanical linkage at positions 1448. The mechanical linkage at positions 1448 which movably connect the frame structure 1404 and/or support base 1402 with the extended base 1432 may be implemented in a variety of manners, such as, for example, hinges connecting the extended base 1432 to frame structure 1404, a pivot pin system connecting extended base 1432 to frame structure 1404, and the like. Extended base 1432 may be selectively positioned between a travel position as shown in FIG. 12C and an operational support position as shown in FIG. 12D, where the position may be selected by any suitable position control device 1450. The extended bases 1432 may be substantially vertically positioned adjacent to frame structure 1404 in a travel position, and while in an operational position, extended bases 1432 may be positioned substantially horizontally from frame structure 1404 to provide additional support for modular silos. Referring again to FIG. 12C, the gooseneck portion 1406 extends from the first end 1420 and is configured to connect to a truck. Wheels 1408, pairs connected by axles, are located proximate the second end 1422 of the support base 1402. While the example shown in FIGS. 12C and 12D shows three wheel and axle configurations, any number of wheel and axle configurations may be used and positioned at any suitable location(s) relative to the support base 1402 to support the components of the mobile support structure 1400.

Shown in FIG. 12D, frame structure 1404 has a plurality of frames 1470. In FIG. 12D, the frame structure 1404 is provided with four frames 1470, however it should be appreciated that frame structure 1404 may include more or less than four frames 1470. Each frame 1470 includes top member 1480, bottom member 1482, and side members 1484 and 1486, which are all connected to form a closed structure surrounding at least a portion of the passage 1430. The top member 1480 may be provided with a support beam 1496. A plurality of frames 1470 may be interconnected at top members 1480 with beam 1488 to further increase the strength and stability of structure 1404. The mobile support structure 1400 is provided with connections 1500 (four shown), located at the apex of the frames 1470, for receiving and connecting with modular silos. Connections 1500 are located within an upper silo receiving region sized and configured to receive at least one modular silo.

Support base 1402 and extended bases 1440 may be moved to the support position, and truck disconnected from the gooseneck portion 1406 of the mobile support structure 1400. The gooseneck portion 1406 may be positioned on the ground co-planar with support base 1402. Gooseneck portion 1406 may form a ramp for equipment access to passage 1430. Gooseneck portion 1406 includes first section 1520 extending from first end 1420, and includes a first end 1524 and second end 1526. First end 1524 of first section 1520 is movably connected to the support base 1402, and may be locked at more than one position. A second section 1522 is movably connected to second end 1526 of the first section 1520, and first section 1520 may be a four bar linkage which can be locked in an elevated position to form the gooseneck, or a lowered position to form the ramp.

Figure 19:
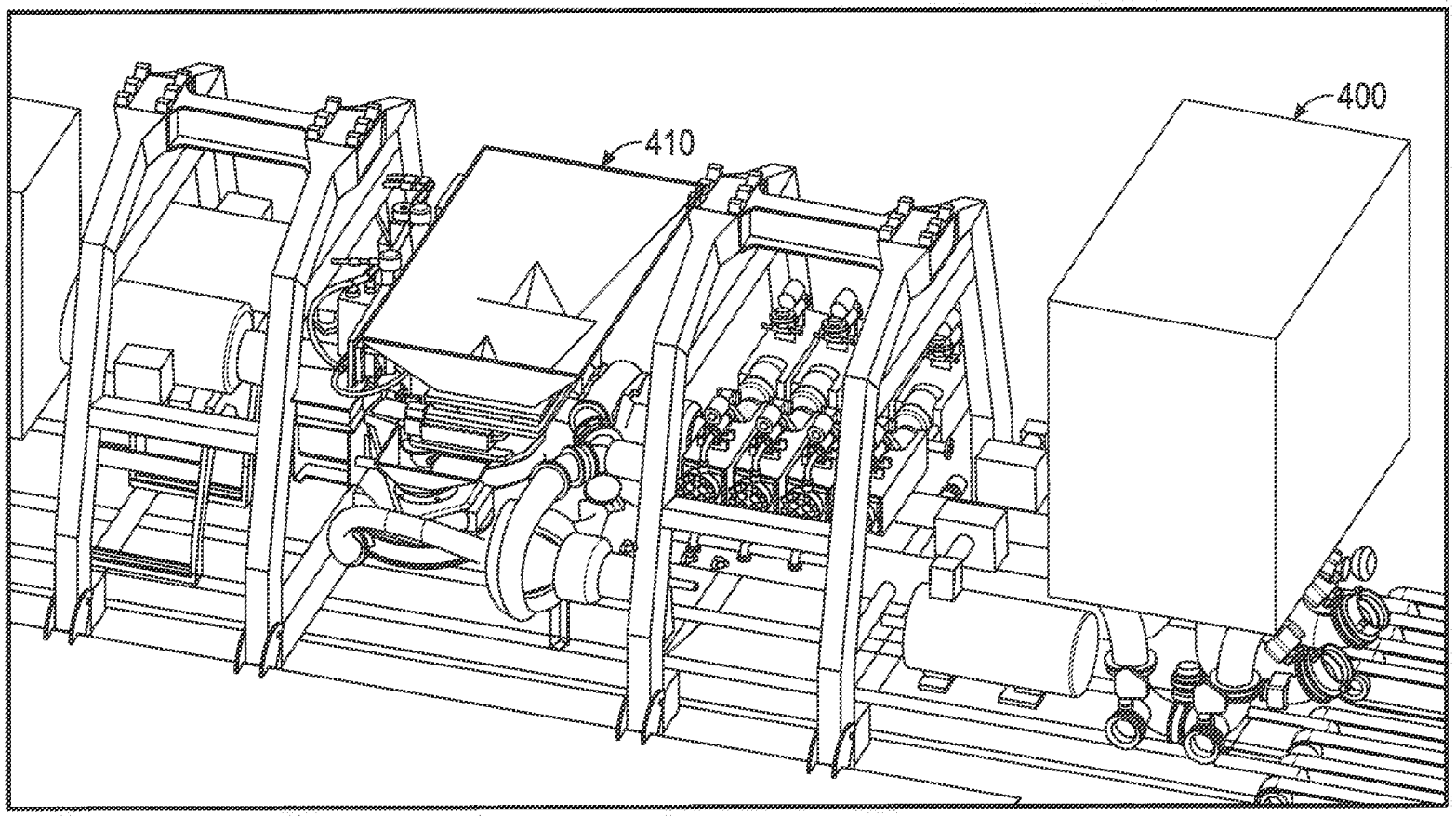
FIG. 19 is a perspective view of another embodiment of a mobile support structure constructed in accordance with the present disclosure having a blending system integrated into a support base of the mobile support structure and within a passage defined by a frame structure.

Shown in FIG. 19 is another embodiment of a mobile portable structure 400, which is similar in construction and function as the mobile portable structure 200, with the exception that the mobile portable structure 400 has an integrated blending system 410. The integrated blending system may be transported with the other components of the mobile portable structure 400 and provided on skids or tracks to be moved off of a support base 412 of the mobile portable structure 400.

Figure 20:
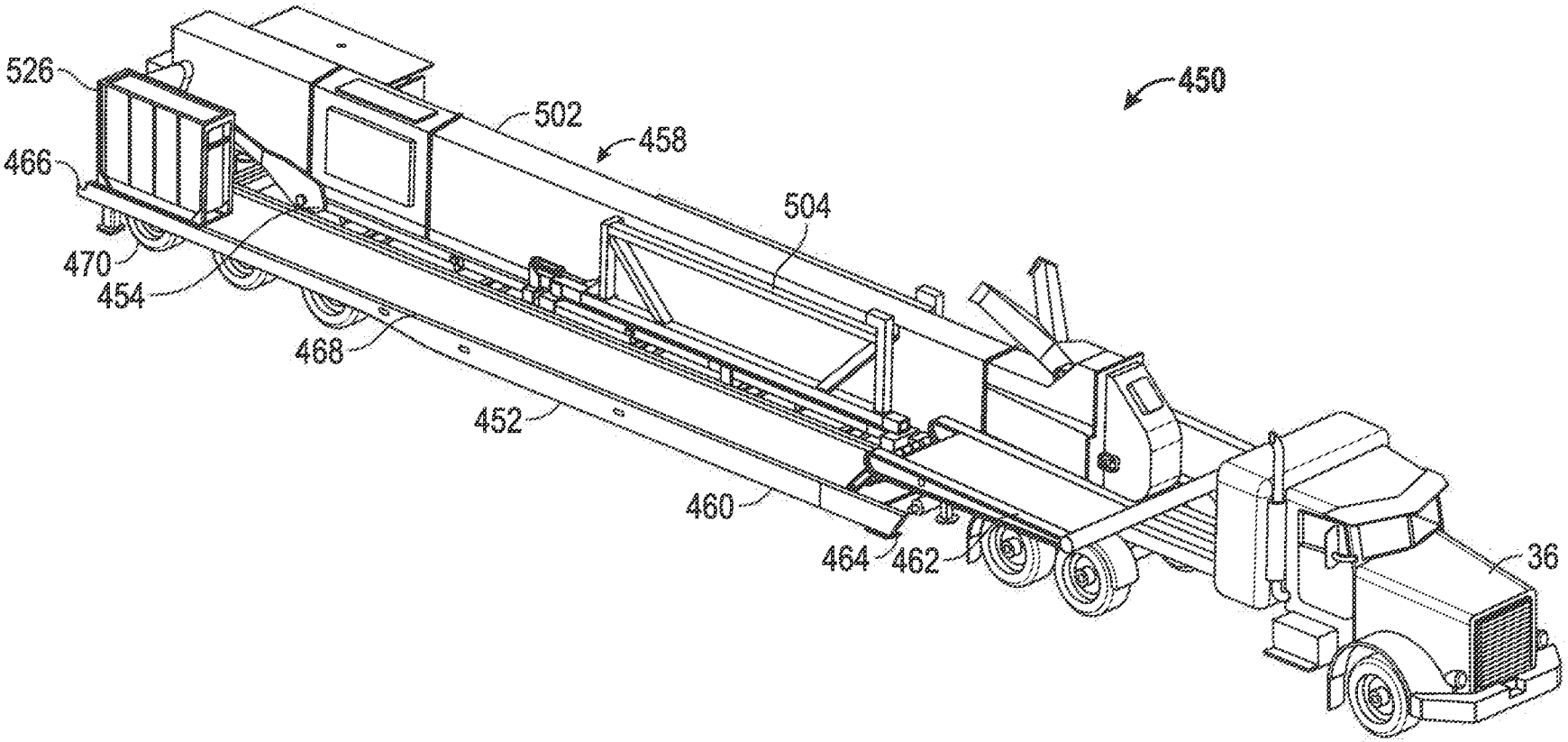
FIG. 20 is a perspective view of an example of a mobile oilfield material transfer unit according to an embodiment of the disclosure, with a first conveyor assembly shown in a horizontal position.
Figure 21:
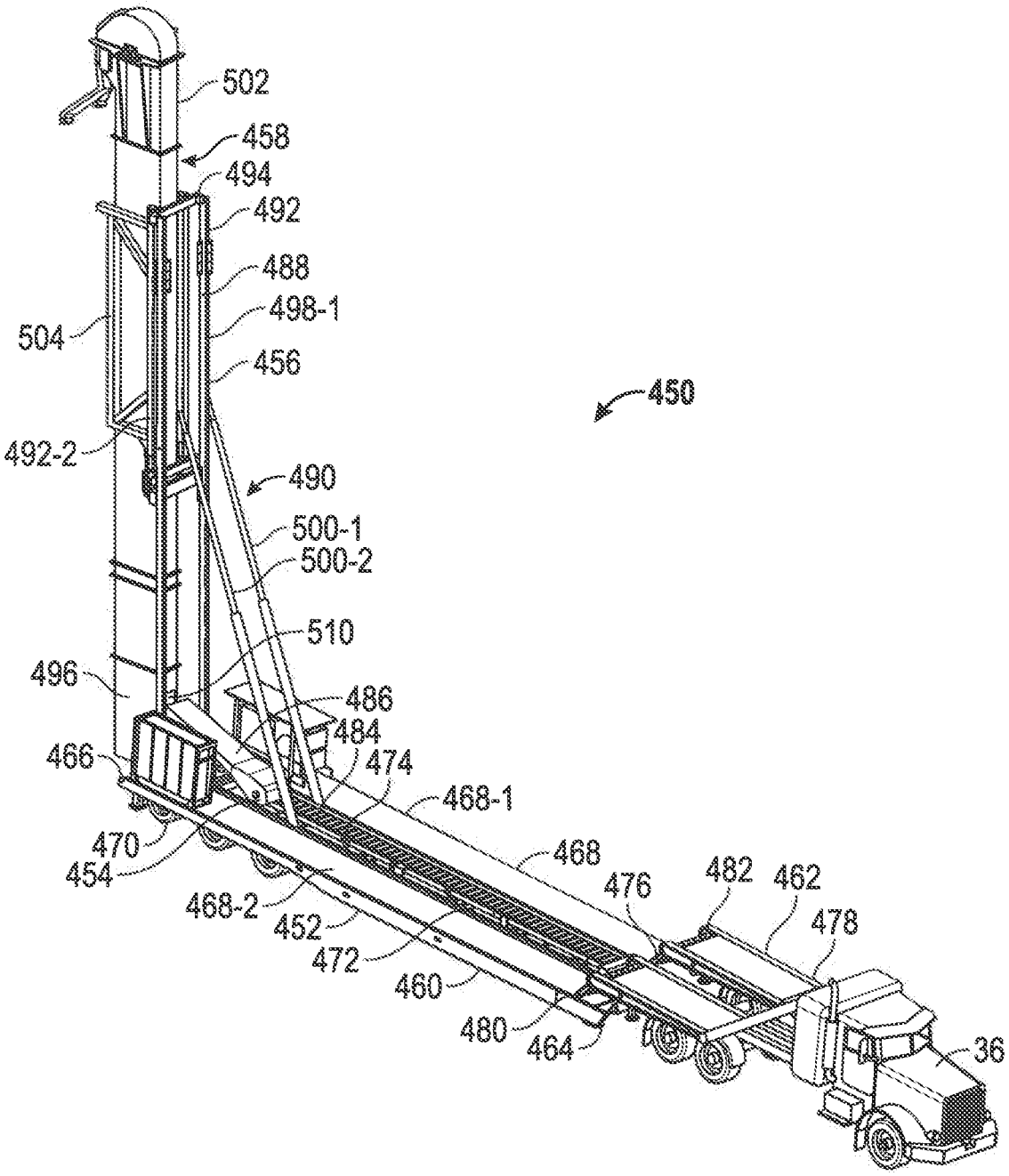
FIG. 21 is a perspective view of the mobile oilfield material transfer unit of FIG. 20 shown with the first conveyor assembly shown in a vertical position.

Referring generally to FIGS. 20-21, shown therein is an embodiment of a mobile oilfield material transfer unit 450 constructed in accordance with the present disclosure. The mobile oilfield material transfer unit 450 may include a chassis 452, a horizontal conveyor system 454 that may be referred to herein as a "second conveyor system 454", an erecting mast assembly 456, and a first conveyor assembly 458.

The chassis 452 includes a support base 460 and a gooseneck portion 462. The chassis 452 may be configured to support the first conveyor assembly 458 and to be pulled by a truck 36 to transport the first conveyor assembly 458 to any desired location such as a well site. The chassis 452 is coupled to the erecting mast assembly 456 and may further be configured to erect the first conveyor assembly 458 to an upright or vertical operational position for conveying oilfield material into a silo (which may be a modular silo), as discussed in more detail with reference to FIG. 24. The chassis 452 may cooperate with the erecting mast assembly 456 to move the first conveyor assembly 458 from a horizontal or transport position on the chassis 452 to an upright or vertical operational position. In some embodiments the chassis 452 may also be configured to be docked or otherwise aligned with a modular silo as will be described below.

The chassis 452 is provided with a support base 460 having a first end 464 (e.g., a front end) and a second end 466 (e.g., a rear end). The chassis 452 may also be provided with a support beam 468 extending between the first end 464 and the second end 466 of the support base 460, and a plurality of wheels 470 located at least partially underneath the support beam 468 (e.g., proximate to the second end 466) and operably connected to the support beam 468. The wheels 470 may be connected to one or more axles, and may include collapsible suspensions in some embodiments of the instant disclosure, such that the support base 460 may be positioned onto the ground when the suspension of the wheels 470 is collapsed.

In the embodiment shown in FIGS. 20-21, the chassis 452 is provided with two support beams, e.g., 468-1 and 468-2, which are separated from one another by a gap 472 and may be connected together to collectively form a support base 460 via one or more transverse support members 474 (FIG. 21). The gap 472 extends longitudinally along the support base 460 between the first end 464 and the second end 466. The support beams 468-1 and 468-2 may be implemented as a steel beam, channel, I-beam, H-beam, wide flange, universal beam, rolled steel joist, or any other structure. In some embodiments of the present disclosure a plurality of transverse support members 474 may be spaced a distance apart from one another between the first end 464 and the second end 466 of the support base 460, while extending between the support beams 468-1 and 468-2.

Figure 25:
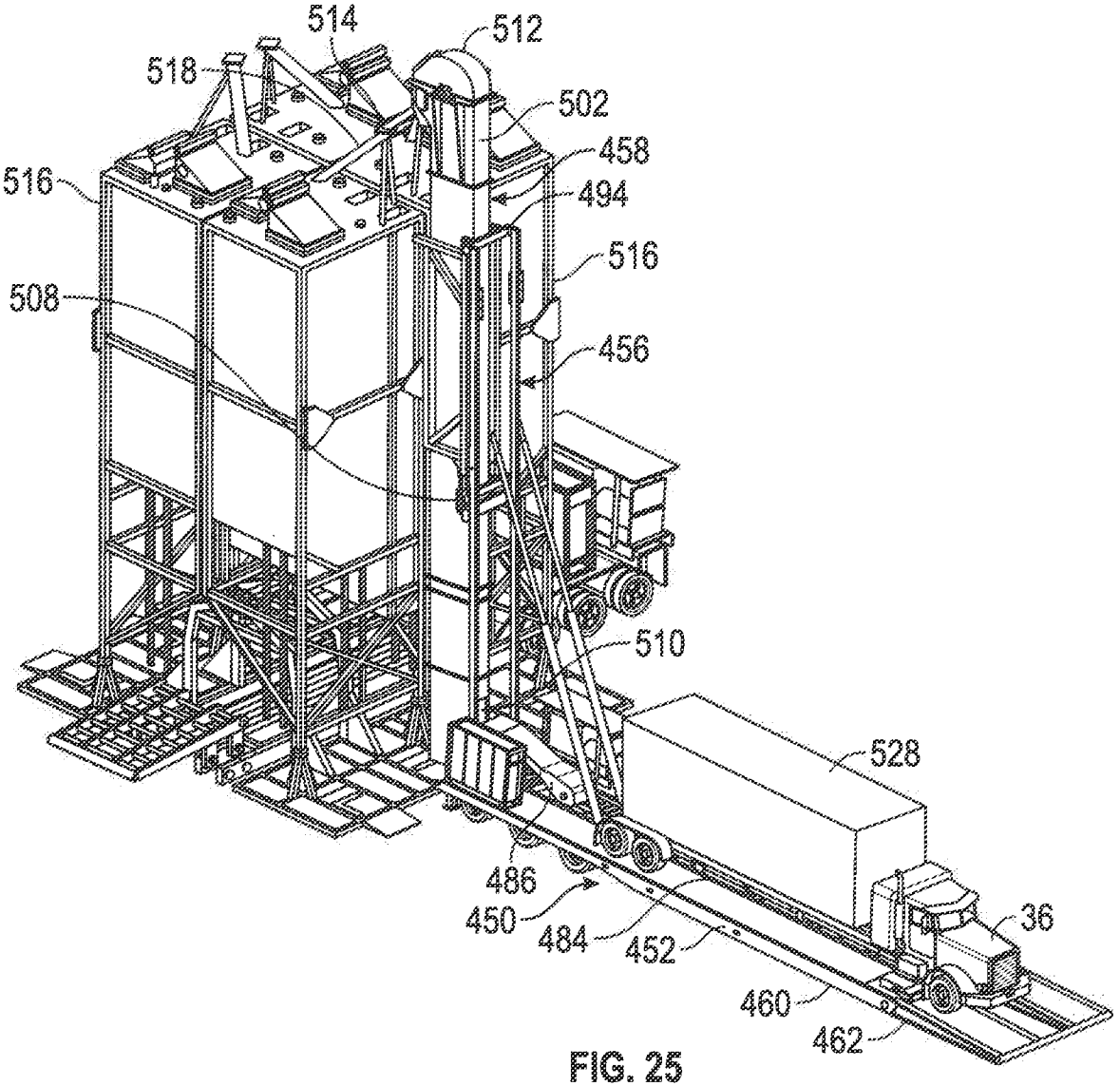
FIG. 25 is a perspective view of the mobile oilfield material transfer unit of FIG. 24 shown with an oilfield material delivery trailer positioned thereon, according to an embodiment of the disclosure.

The gooseneck portion 462 extends from the first end 464 of support base 460 and is configured to connect the chassis 452 to a truck such as the truck 36, such as via a suitable trailer hitch, for example. Once the truck 36 has been disconnected from the gooseneck portion 462, the gooseneck portion 462 may be manipulated to lie on the ground and be generally co-planar with the support base 460 as shown in FIG. 25. In this configuration, the gooseneck portion 462 may form a ramp to allow an oilfield material delivery truck or trailer to be driven over or backed onto the support base 460. For example, the gooseneck portion 462 may be provided with a first section 476 and a second section 478. The first section 476 may extend from the first end 464 of the support base 460. The first section 476 has a first end 480 and a second end 482. The first end 480 of the first section 476 is movably connected to the support base 460, such as by the use of a set of hinges, voids and pins or other types of connectors which may be locked at more than one position. The second section 478 is movably connected to the second end 482 of the first section 476. For example, the first section 476 may be a four bar linkage which can be locked in an elevated position to form the gooseneck portion 462, or a lowered position to form a ramp. Any desired trailer hitch such as a gooseneck hitch having a structure known in the art as a "kingpin", for example, may be implemented to connect the gooseneck portion 462 to the truck 36 as will be appreciated by persons of ordinary skill in the art having the benefit of the instant disclosure.

The second conveyor system 454 can be implemented as any suitable conveyor-belt type transloader or auger, and may be associated with the support base 460 so that the second conveyor system 454 is positioned at least partially in the gap 472 between the support beams 468-1 and 468-2. In another embodiment, the second conveyor system 454 may be pivotably connected to the chassis 452 so as to move oilfield material towards the second end 466 of the chassis 452. In one embodiment, at least a portion of the second conveyor system 454 extends along a centerline of the support base 460 as shown in FIGS. 20-21. The second conveyor system 454 has a second conveyor 484 and a third conveyor 486. The second conveyor 484 may be recessed in the gap 472 and positioned substantially horizontally such that a top surface of the second conveyor 484 is positioned level with or below a top surface of the support beams 468-1 and 468-2, and is configured to allow an oilfield material transport truck or trailer positioned on the support base 460 to discharge, dump, or otherwise deposit a volume of oilfield material onto the second conveyor 484 and to transport the volume of oilfield material from the first end 464 toward the second end 466 of the support base 460. In some embodiments, the second conveyor 484 may be positioned at a centerline of the support base 460. The third conveyor 486 is positioned between the second conveyor 484 and the second end 466 of the chassis 452 and is configured to receive a volume of oilfield material from the second conveyor 484 and to transport the oilfield material towards the second end 466. As will be appreciated by persons of ordinary skill in the art, the second conveyor system 454 may include an auger, a conveyor belt with a smooth surface, or with cleated features for oilfield material transfer (e.g., in the third conveyor 486). Further, in some embodiments the second conveyor 484 may be open, and the third conveyor 486 may be enclosed, as will be appreciated by a person of ordinary skill in the art having the benefit of the instant disclosure. The third conveyor 486 may positioned at an upwardly inclined (non-zero, positive angle) with respect to the second conveyor 484.

Figure 24:
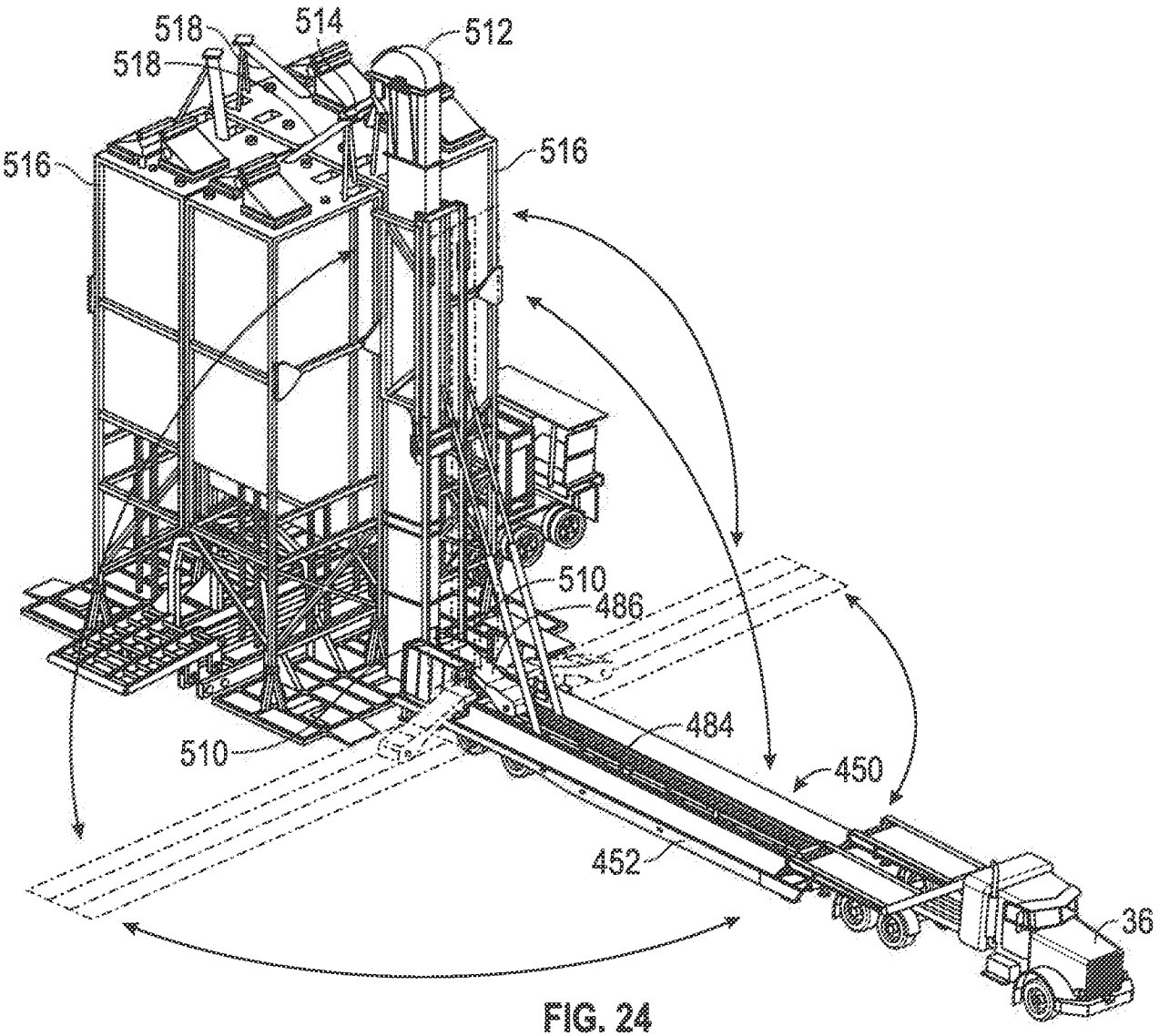
FIG. 24 is a perspective view of a mobile oilfield material transfer unit shown coupled with a modular silo according to an embodiment of the disclosure.

In some embodiments of the present disclosure, second conveyor system 454 may be pivotably connected with the support base 460 and/or the chassis 452 such that the second conveyor system 454 can be pivoted laterally from the support base 460 at any desired angle as shown in FIG. 24 below.

The erecting mast assembly 456 may include a mast 488 supported by the chassis 452, and an actuator system 490 engaging the mast 488 and the chassis 452. The erecting mast assembly 456 is configured to lay flat onto the support base 460 (e.g., onto the support beams 468-1 and 468-2) when the chassis 452 is transported, and to clear the second conveyor system 454 when the erecting mast assembly 456 is deployed to the upright or vertical operational position. The range of motion of the erecting mast assembly 456 may extend from horizontal to slightly past vertical (e.g., more than a 90 degree range of motion) when deployed to account for angular misalignment due to ground height differences. The erecting mast assembly 456 may be formed from steel tubing, beam, channel, I-beam, H-beam, wide flange, universal beam, rolled steel joist, or any other material.

The mast 488 may be supported by the support beams 468-1 and 468-2 of the chassis 452 proximate to the second end 466 of the chassis 452. The mast 488 is configured to support the first conveyor assembly 458 and to be moved between a horizontal position (FIG. 20) and a vertical position (FIG. 21) by the actuator system 490 to raise the first conveyor assembly 458 to the vertical position and to associate the first conveyor assembly 458 with a modular silo as will be described with reference to FIG. 24 below.

The mast 488 may be provided with a frame 492 including a first end 494, a second end 496, a first support beam 498-1 extending between the first end 494 and the second end 496, and a second support beam 498-2 extending between the first end 494 and the second end 496. The first and second support beams 498-1 and 498-2 may be spaced apart in a parallel orientation and configured to jointly support the first conveyor assembly 458 as will be described below.

The actuator system 490 engages the mast 488 and at least one of the support beams 468-1 and 486-2 of the chassis 452 to move the mast 488 in an arc-shaped path for moving the first conveyor assembly 458 between the horizontal and vertical positions. As shown in FIGS. 20 and 21, the actuator system 490 may include a plurality of actuators 500-1 and 500-2 working in concert to move the mast 488 from the lateral position to the vertical position. However, it will be understood that the actuator system 490 may be implemented as a single actuator 500 or any number of actuators 500. The actuator(s) 500 may be implemented as hydraulic actuators, pneumatic actuators, electrical actuators, mechanical actuators, or any suitable mechanism capable of moving the mast 488 into the vertical position.

The first conveyor assembly 458 may be implemented as an enclosed vertical bucket elevator or an auger (e.g., not using airflow to carry the oilfield material), and may include a first conveyor 502 and a support frame 504 which is movably connected to the mast 488 of the erecting mast assembly 456 so that the first conveyor 502 is movable between a horizontal position where the first conveyor 502 lies flat onto the support base 460 during transport, and a vertical position where the first conveyor 502 is oriented vertically for transporting a volume or oilfield material into one or more modular silos. In some embodiments, the first conveyor 502 may be implemented and may function similarly to the vertical conveyor 32 described above.

Figure 22:
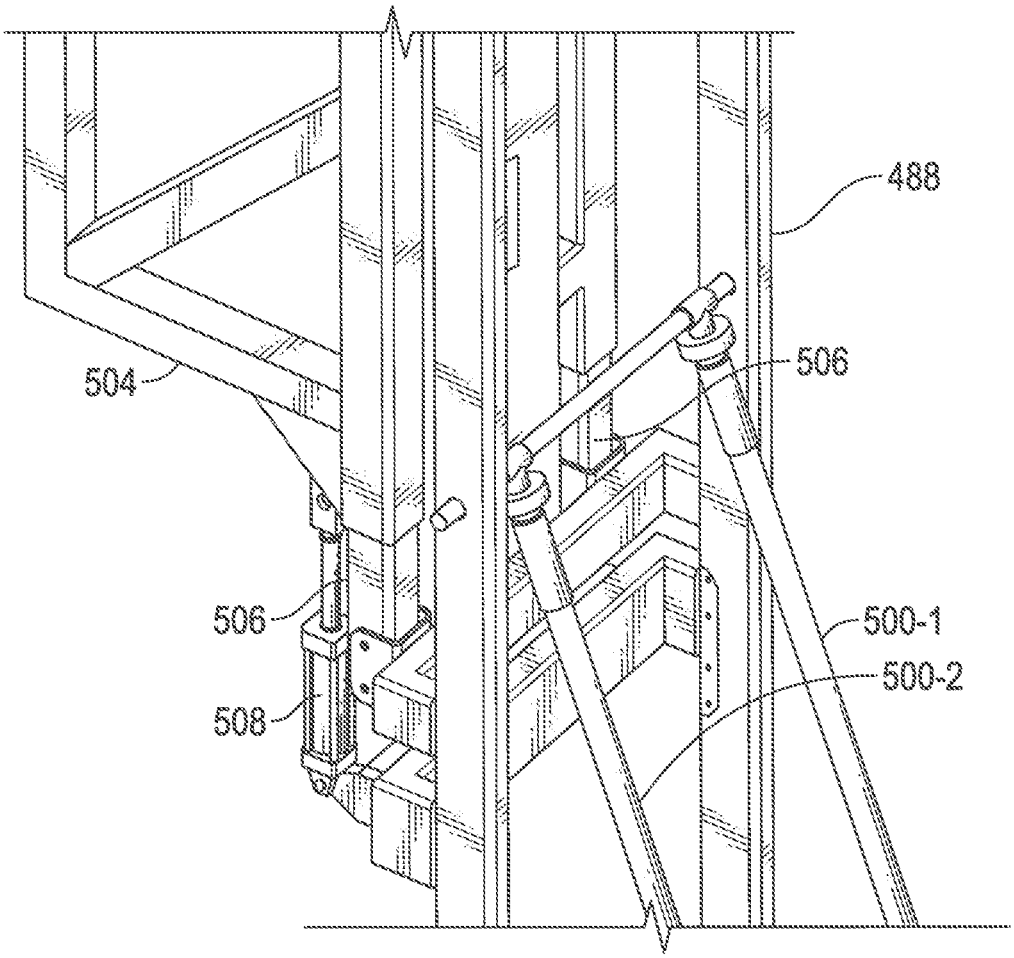
FIG. 22 is a partial perspective view of an example of a support frame of a first conveyor assembly according to an embodiment of the disclosure.

As shown in FIG. 22, the support frame 504 may be movably connected to the mast 488 via one or more mechanical linkages 506 attached to the mast 488 and one or more actuators 508 configured to slide, or otherwise move the support frame 504 relative to the first end 494 of the mast 488 within a predetermined range. In some embodiments the actuators 508 may be implemented as hydraulic or pneumatic actuators. It is to be understood that the mechanical linkages 506 may be implemented in a variety of manners, such as rails (as shown in FIG. 22) hydraulic or pneumatic arms, gears, worm gear jacks, cables, or combinations thereof.

Figure 23:
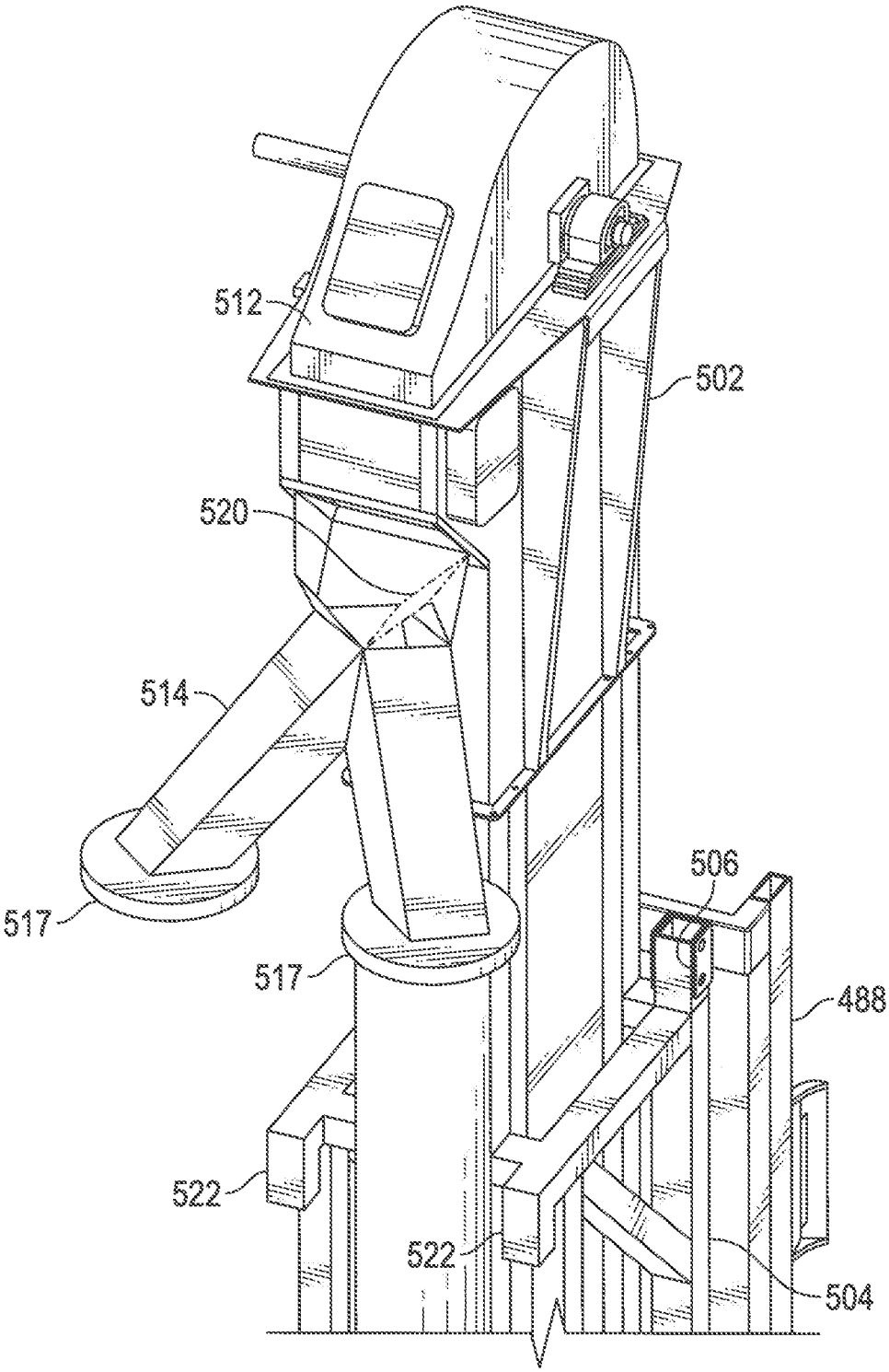
FIG. 23 is a perspective view of an example of a discharge chute of a first conveyor assembly according to an embodiment of the disclosure.

Referring now to FIGS. 23-24, the first conveyor 502 may include an inlet 510 and an upper discharge portion 512. The inlet 510 may be positioned proximate and/or below the third conveyor 486 of the second conveyor system 454 such that a volume of oilfield material transported via the third conveyor 486 of the second conveyor system 454 enters the first conveyor 502 via the inlet 510.

The upper discharge portion 512 may include a discharge chute 514 which may be a dual-discharge chute configured to fill two or more modular silos 516 simultaneously, such as by having two or more outlets 517 operably coupled with two or more receiving chutes 518 of the modular silos 516, for example. In some embodiments, the discharge chute 514 may include a built-in diverter valve 520 (e.g., a three-position diverter valve) to allow the discharge chute 514 to fill one, two, or more than two modular silos 516 as will be appreciated by persons of ordinary skill in the art. The discharge chute 514 can interface, or otherwise be coupled with the receiving chutes 518 of the modular silos 516 in any desired manner protected from rain and/or moisture, for example, by including one or more rain-covers or shields.

As shown in FIG. 23, the support frame 504 may include one or more optional silo-engaging members 522, which may be implemented as hooks, L-shaped protrusions, flanges, or combinations thereof, for example. The silo-engaging members 522 may be configured to engage corresponding frame-attachment members 524 formed in the modular silo(s) 516, such that the support frame 504 and the first conveyor 502 may be securely attached, or otherwise associated with the modular silo(s) 516. As will be appreciated by persons of ordinary skill in the art, the silo-engaging members 522 and/or the frame-attachment members 524 may be omitted in some embodiments of the present disclosure.

Referring back to FIG. 20, in some embodiments an optional power supply system 526 may be implemented with the mobile oilfield material transfer unit 450, and may be configured to power the actuator system 490, the first conveyor 502, and the actuators 508. However, in some embodiments the power supply system 526 may be omitted, and the actuator system 490, the first conveyor assembly 458, and the actuators 508 may be powered by any desired power source, such as a power source associated with the modular silos 516, a separate generator, an electrical line connected to a grid or to a local power source, and combinations thereof. In some embodiments where the power supply system 526 is provided with the mobile oilfield material transfer unit 450, the power supply system 526 is desirably sized and positioned onto the support base 460 so as to not interfere with the operation and movement of the erecting mast assembly 456 and the second conveyor system 454.

Referring now to FIG. 25, in operation a mobile oilfield material transfer unit 450 may function as follows: the truck 36 backs up the chassis 452 proximate to one or more modular silo 516 (e.g., a cooperating unit of two or more modular silos 516). When the truck 36 has been disconnected from chassis 452, the gooseneck portion 462 may be manipulated to lie on the ground and be generally co-planar with the support base 460 to form a ramp to allow an oilfield material transport trailer 528 to be driven over or backed onto the support base 460. The erecting mast assembly 456 is raised to the vertical position so as to raise the first conveyor assembly 458 to the vertical position as well. The actuators 508 may be operated to raise the first conveyor 502 to the upper limit of the predetermined range of movement of the actuators 508, by moving the support frame 504 relative to the first end 494 of the mast 488 (e.g., along the mechanical linkage 506). The position of the chassis 452 relative to the modular silo(s) 516 may be adjusted as needed (e.g., in three-dimensions, such as by moving the chassis 452, by docking or otherwise aligning the second end 466 of the chassis 452 with the modular silo(s) 516, and/or by collapsing a suspension of the chassis 452 to position the discharge chute 514 to engage with the receiving chutes 518. The actuators 508 may be operated to lower the first conveyor 502 over the modular silo(s) 516 such that the discharge chute 514 engages the receiving chutes 518. Optionally, lowering the first conveyor 502 may also cause the silo-engaging members 522 to engage with the corresponding frame-attachment members 524, such that the support frame 504 of the first conveyor assembly 458 is securely attached, or otherwise associated with the modular silo(s) 516 causing the discharge chutes 514 to be aligned with the receiving chutes 518 of the modular silo(s).

The oilfield material transport trailer 528 may be backed over the chassis 452, such that discharge openings (not shown) of the oilfield material transport trailer 528 are positioned over and vertically aligned with the second conveyor 484 of the second conveyor system 454. As a volume of oilfield material is dumped, discharged, or otherwise deposited (e.g., under gravity) on the second conveyor system 454, the oilfield material is moved by the second conveyor 484 towards the third conveyor 486. The third conveyor 486 is optional in that the second conveyor 484 may convey the oilfield material directly to the first conveyor 502. The third conveyor 486 continues moving the volume of oilfield material towards the second end 466 of the chassis 452. Once the volume of oilfield material reaches the first conveyor 502, the oilfield material enters the inlet 510 of the first conveyor 502. The volume of oilfield material is carried upward by the first conveyor 502 and is deposited into the modular silos 516 via the discharge chute 514 and the receiving chutes 518.

In some embodiments of the present disclosure, second conveyor system 454 may be pivoted laterally from the support base 460 at any desired angle, and the oilfield material transport trailer 528 may be positioned over the second conveyor system 454 without being backed over the chassis 452 as shown in FIG. 24, as will be appreciated by persons of ordinary skill in the art having the benefit of the present disclosure.

Figure 26:
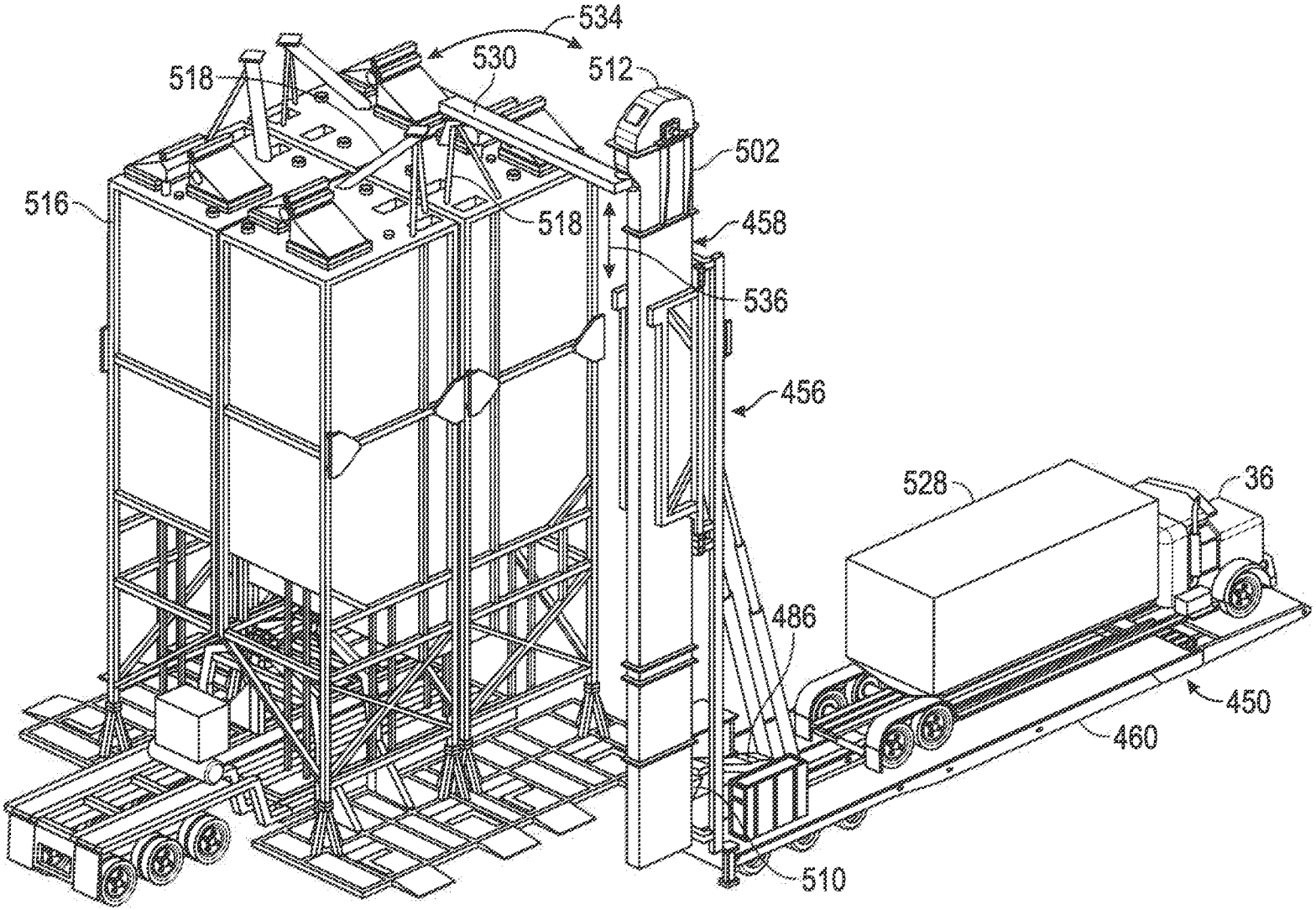
FIG. 26 is a perspective view of an embodiment of a mobile oilfield material transfer unit shown coupled with a modular silo and an oilfield material delivery trailer positioned thereon, according to an embodiment of the disclosure.

Referring now to FIG. 26, in another embodiment, the second conveyor system 454 includes a pivoting conveyor assembly 530 rather than the discharge chute 514. The pivoting conveyor assembly 530 includes a conveyor 532 that may be attached to a housing and/or support frame extending around the first conveyor 502 with a horizontal adjustment assembly and a vertical adjustment assembly. The horizontal adjustment assembly may include a mechanical linkage with one pivot connection or multiple pivot connections working in concert to provide a range of motion of the conveyor 532 in a horizontal path that may be approximately within a range from 0 degrees to 180 degrees as shown by an arrow 534. The conveyor assembly 530 may also include a vertical adjustment assembly (not shown) including a mechanical linkage to provide a range of motion of the conveyor 532 in a horizontal path that may be within a range from 0 degrees to 120 degrees as shown by an arrow 536. The horizontal and vertical adjustment assemblies may include one or more actuators to effect controlled motion in the horizontal and vertical paths discussed above.

The horizontal and vertical adjustment assemblies provides movement between a stowed position where the conveyor 532 extends substantially parallel to the first conveyor 502, and an extended position where the conveyor 532 extends laterally away from the first conveyor 502. The conveyor 532 may be implemented as an auger, or an enclosed two-way conveyor belt in some embodiments of the present disclosure, and may be pivoted by one or more actuators (not shown). The conveyor 532 may function similarly to the discharge chute 514, and may be coupled with one or more receiving chutes 518 of the modular silo(s) 516 similarly to the discharge chute 514. For example, the conveyor 532 may be coupled with one or more of the receiving chutes 518 in a manner protecting the receiving chutes 518 from rain or moisture, such as via one or more rain covers or shields, for example. As will be appreciated by persons of ordinary skill in the art, the pivoting conveyor assembly 530 allows the chassis 452 to be positioned at any desired angle, orientation, or position relative to the modular silo(s) 516, such as parallel, angled, or perpendicular, for example. Further, when the pivoting conveyor assembly 530 is implemented, the support frame 504 may or may not be attached to the silo(s) via the silo-engaging members 522.

As will be appreciated by persons of ordinary skill in the art having the benefit of the present disclosure, a mobile oilfield material transfer unit 450 according to embodiments of the present disclosure utilizes a first conveyor which is external from the silos, and is transported to any desired location and coupled with one or more silos in situ. Further, the chassis 452 or a mobile oilfield material transfer unit 450 according to the inventive concepts disclosed herein forms a ramp allowing oilfield material transport trailers 528 to be backed onto the chassis 452 and deposit oilfield material onto the second conveyor system 454 of the mobile oilfield material transfer unit 450. The mobile oilfield material transfer unit 450 may allow for flexible positioning and for quick and efficient transfer of oilfield material into modular silos 516 on location. Further, removing the vertical conveyor from the silo (e.g., the first conveyor being external to the silo) increases available silo volume. It is to be understood, however, that in some embodiments, an external first conveyor as disclosed herein may be used with modular silos including internal vertical elevators, for example.

Figure 27:
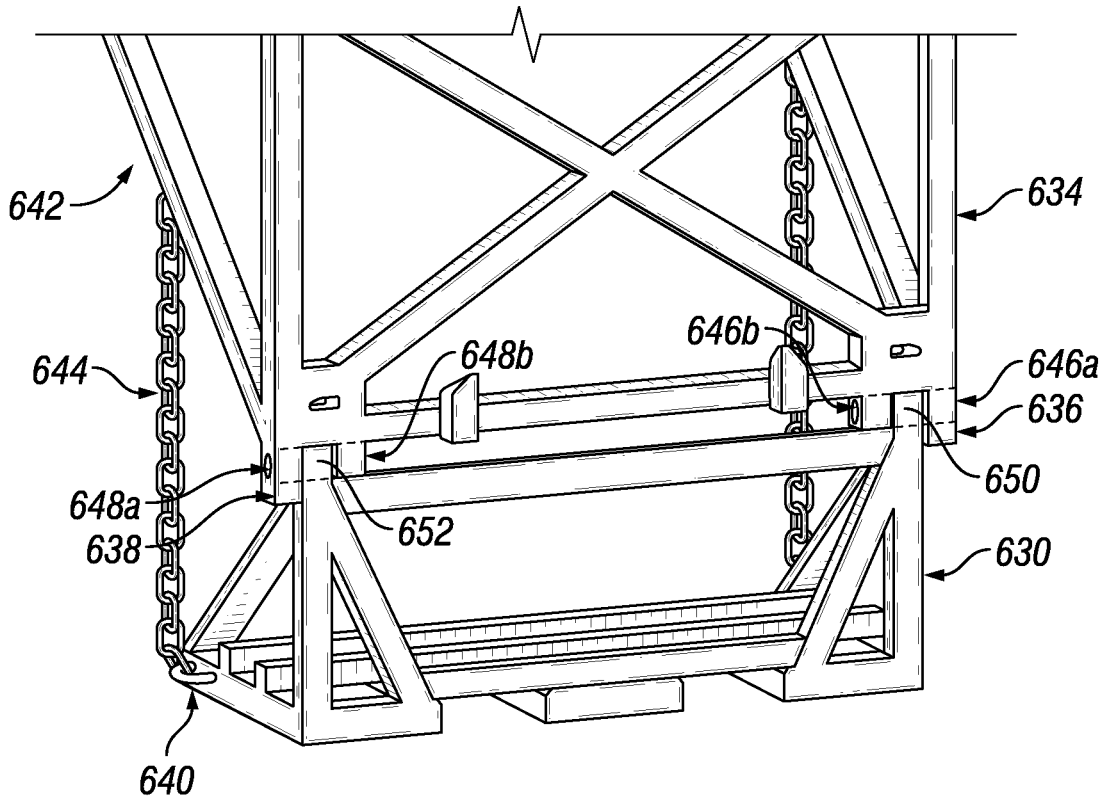
FIG. 27 illustrates modular silo frame connected with a silo base, according to an embodiment of the disclosure.

Now referring to FIG. 27, which illustrates some embodiments where a modular silo frame is connected with a silo base (such as 128 and 130 in FIG. 2A, by way of example). A modular silo has a silo frame 634 which may be movably connected with a silo base 630. The silo frame 634 supports a silo housing during the transport, erecting, utilization and lowering of the modular silo. Silo base 630 is movably connected with modular silo frame 634 at distal positions 636 and 638 of frame 634. Silo base 630 includes a bottom 640 while frame 634 includes an angular strut 642. Bottom 640 and angular strut 642 may be connected together by a tie 644 (two shown), such as a chain, cable, hydraulic cylinder, pneumatic cylinder, strut and the like. Tie 644 may be useful to secure and/or stabilize base 630 relative silo frame 634 during the transport and the erecting of the modular silo. During the erecting of the modular silo, tie 644 may be released from bottom 640 and/or angular strut 642 to accommodate free movement of base 630 and silo frame 634.

As indicated above, silo base 630 and modular silo frame 634 movably connect at general positions 636 and 638 of frame 634. The connection may be made with any suitable device. In some instances, clevis connection structures are utilized where flanges 646*a*, 646*b*, 648*a*, and 648*b*, extending from the end of silo frame 634 and include cylindrical openings defined therein, while complimentary cylindrical openings are formed in flanges 650 and 652 on silo base. Silo frame flanges 646*a* and 646*b* envelop silo base flange 650 and when aligned, cylindrical openings in flanges 646*a*, 646*b* and 650 are substantially positioned on an axial centerline. Likewise, flanges 648*a* and 648*b* envelop flange 652 and respective cylindrical openings therein are substantially positioned on an axial centerline. A connector is disposed in the cylindrical openings formed in flanges 646*a*, 646*b* and 650, and another connector disposed in the cylindrical openings formed in flanges 648*a*, 648*b* and 652. The cylindrical openings are indicated in FIG. 27 by the dashed/dotted lines. Any suitable device to enable a movable connection may be disposed in the cylinder, including, but not limited to pins, axles, pins, screws and the like. In some embodiments, load cell pins are utilized.

Figure 28:
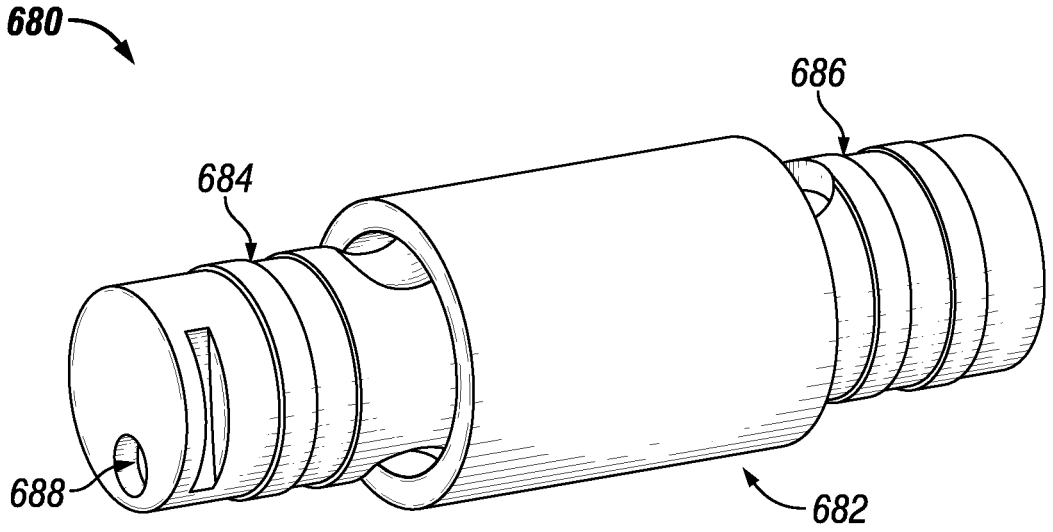
FIG. 28 illustrates a load cell pin useful in some embodiments of the disclosure.

Referencing FIG. 28 which illustrates a load cell pin used in some embodiments of the disclosure. Load cell pin 680 (also known as a load pin) is designed to be used where pins or bolts are carrying a load to provide accurate, real time monitoring of load forces generated by a modular silo and its material contents, which in turn, allows an operator to understand a real time material volume, discharge rate, filling rate, and the like, of the modular silo. The load measuring pins operate on a shearing principle. The deformation is measured proportional to the load through a strain gauge bridge integrated in the pin. The load may be applied by flanges 646*a*, 646*b*, 648*a* and 648*b*. When force is applied to the load measuring pin along its sensitive axis, the effect on the strain gauge bridge results in an output signal proportional to the applied force. The powering of the strain gauge bridge, as well as the amplification of its output signal voltage, is performed either by an external amplifier or through an internal amplifier. Load cell pin 680 may further include a bushing 682, which fits within the cylindrical opening of flange 650 or 652. Portions 684 and 686 of load cell pin 680 are disposed in cylindrical openings 646*a*, 646*b*, 648*a* and 648*b*. Port 688 may be used to connect the sensors within the load cell pin to external monitoring and/or powering equipment. In some instances where load cell pin 680 movingly connects silo base 630 and modular silo frame 634 through cylindrical openings 646*a*, 646*b*, 648*a*, 648*b*, 650 and 652, when the modular silo is erected, the ties 644 may their tension, or otherwise be configured to not interfere with the performance of the load cell pins 680. While load cell pin 680 is described herein as useful for the movable connection of silo base 630 and modular silo frame 634, it will appreciated that it is within the scope and spirit of the disclosure to use a load cell pin at any suitable position in the systems described herein, for example, but not limited to connections 1300 and 1500.

Figure 29:
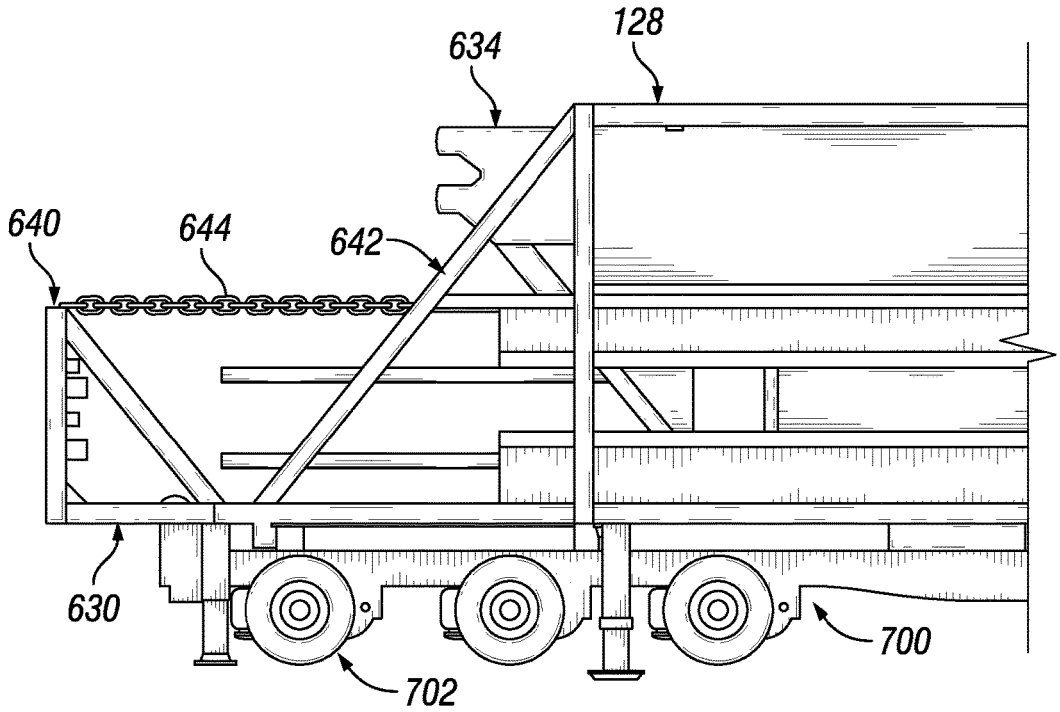
FIG. 29 shows a modular silo including a silo frame and silo base disposed on a trailer in a lateral stowed position, according to an embodiment of the disclosure.

FIG. 29 illustrates a modular silo 128 including a silo frame 634 and silo base 630 disposed on a trailer 700 in a lateral, e.g. horizontal, stowed position for transportation. Ties 644 are securely attached to bottom 640 and angular struts 642, and tensioned in order to maintain the position of silo base 630 as well as prevent base 630 from pivoting down onto the ground when in the stowed position. Trailer 700 may be backed up to move the laterally positioned modular silo 128 into position with a corresponding silo receiving region, such as 1240 in FIG. 12B of mobile support structure 1200. Wheels 702 may be moved onto ramps 1242 and then extended base 1232. Wheels 702 may engage wheel guides 1244 and wheel chocks 1246 to help ensure alignment of trailer 700 to the silo receiving region 1240. Furthermore to aid in the proper alignment, extended base 1232 may also serve as a reference elevation for the trailer 700.

Figure 30:
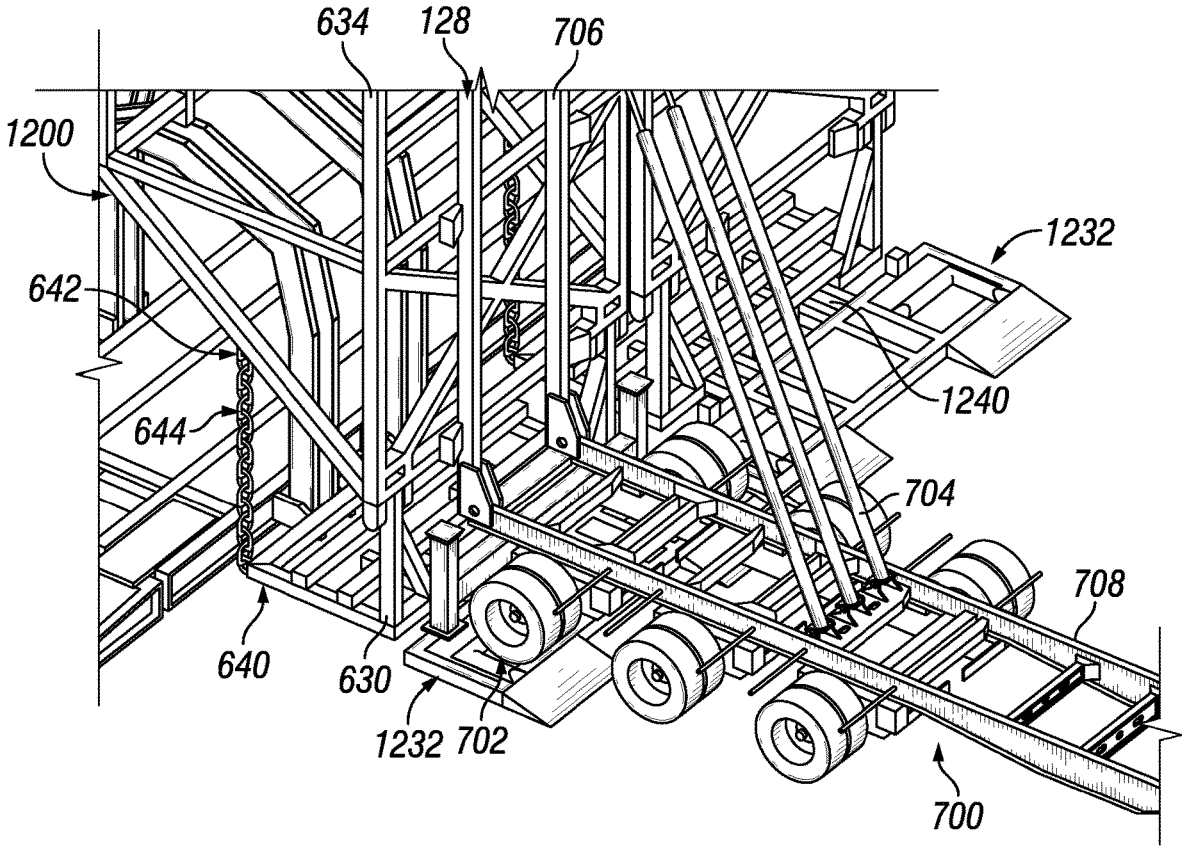
FIG. 30 depicts a modular silo in an upright orientation on mobile support structure, according to an embodiment of the disclosure.

Referring now to FIG. 30 which shows modular silo 128 in an upright orientation on mobile support structure 1200. Wheels 702 of trailer 700 are positioned upon extended base 1232, and modular silo 128 is disposed on receiving region 1240 of extended base 1232. While modular silo 128 is still in lateral position and trailer 700 positioned upon extended base 1232, before erecting modular silo 128, ties 644 may be released from bottoms 640 and/or angular struts 642, thereby allowing silo base 630 to be disposed upon receiving region 1240. Silo base 630 may be secured with receiving region 1240 as described further below. Modular silo 128 is then erected from a lateral stowed position to the upright position by ram 704 (three shown) connected with lifting frame 706 and trailer frame 708. Silo frame 634 may then be attached to mobile support structure 1200 at connection 1300. The ram 704 may be a hydraulic or pneumatic ram positioned on trailer 700 to act against frame 634 of each modular silo 128 to pivot the modular silo 128 until securely received in its upright position by silo receiving region 1240. The ram 704 may be designed to operate off a hydraulic (or pneumatic) system of a truck. In other applications, the ram 704 may be designed to pivot trailer 700 or a portion of trailer 700 upwardly while the modular silo 128 remains attached to the pivoting portion of the trailer 700. Other techniques may utilize cranes, pulleys, and/or other mechanisms to pivot each modular silo 128 as the modular silo 128 is transitioned from the lateral position to the operational, upright orientation. Ties 644 may then be reattached, but not necessarily tensioned, to bottoms 640 and/or angular struts 642, to generally aid in stabilizing the upright orientation of modular silo 128.

Figure 31:
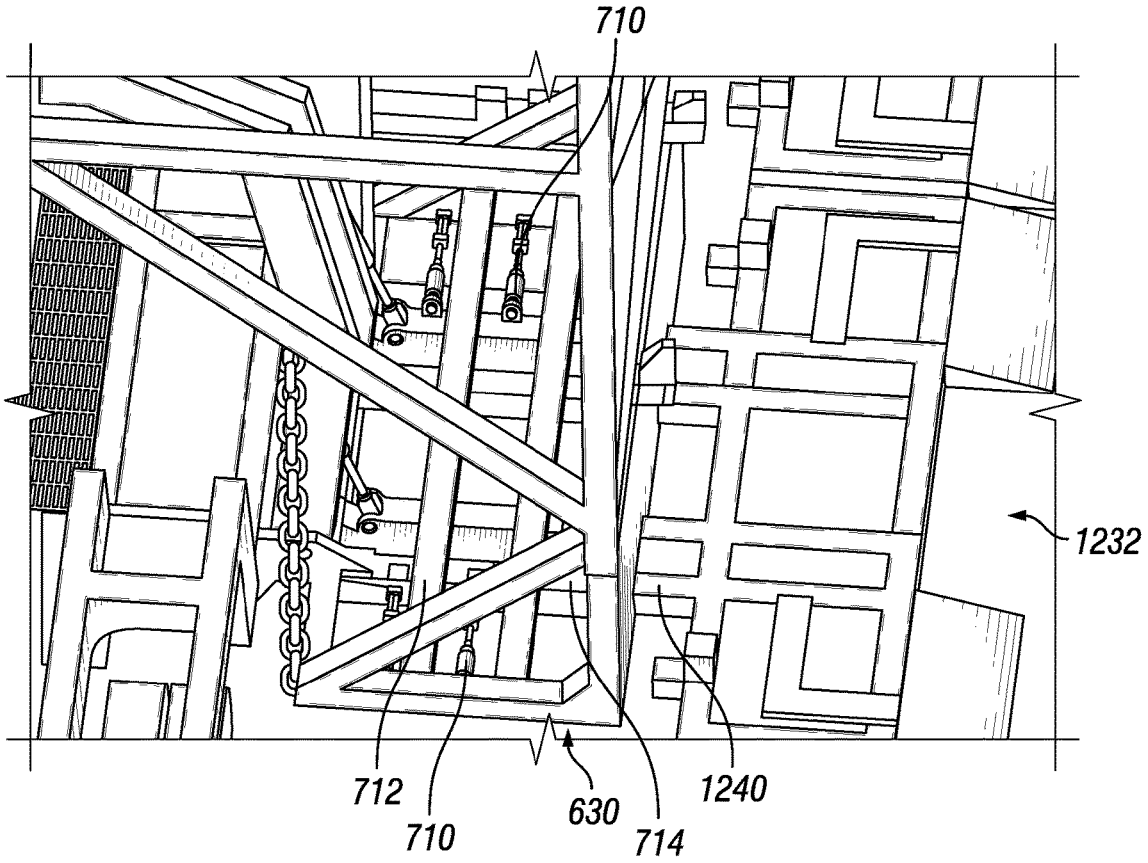
FIG. 31 illustrates a silo base secured with a receiving region, according to an embodiment of the disclosure.
Figure 32:
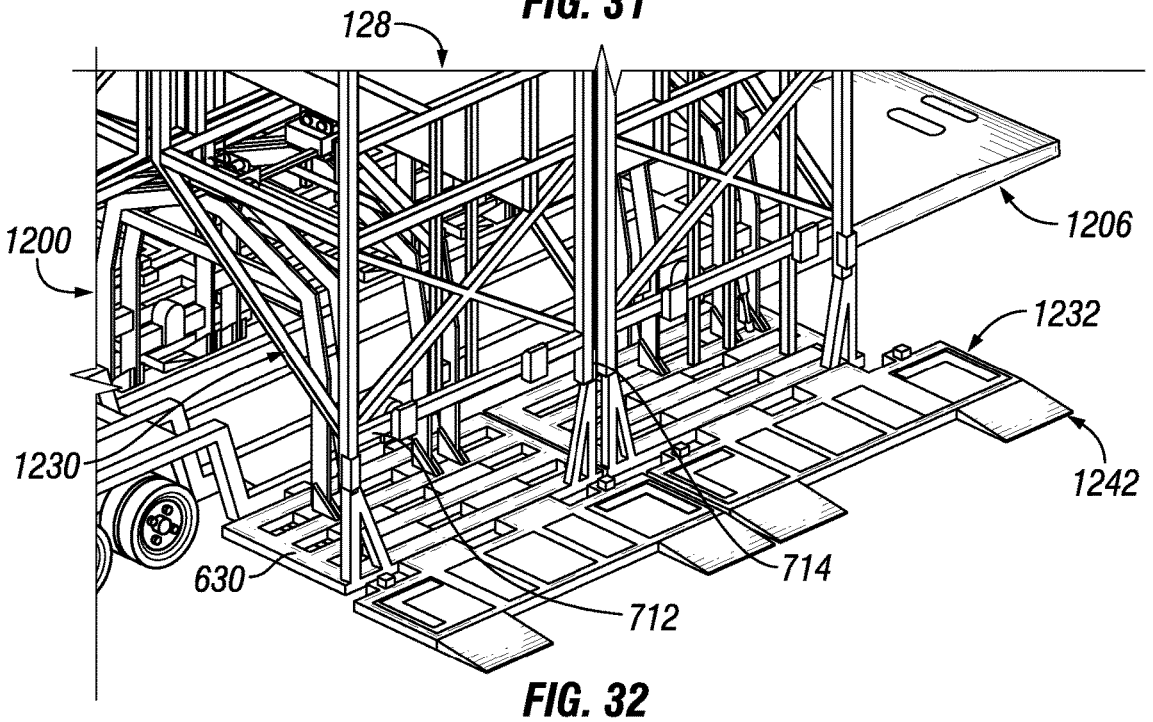
FIG. 32 shows a mobile material delivery system including a modular silo in an upright operational orientation integrated with a mobile support structure, according to an embodiment of the disclosure.

FIG. 31 illustrates silo base 630 secured with receiving region 1240. Silo base 630 is shown position upon receiving region 1240 of extended base 1232. Connection pins 710 (four shown) securely connect silo base 630 with extended base 1232. Cross beams 712 (two shown) of the silo base 630 are disposed directly over the support beams 714 (two shown) of extended base 1232 to transfer load to support beams 714 and which act as an extension to the silo base 630. The bottom surfaces of the silo base 630 and the support beams 714 may be flush with each other for maximum ground contact. FIG. 32 shows mobile material delivery system including a modular silo in an upright operational orientation integrated with a mobile support structure, in accordance with some embodiments of the disclosure. Modular silos 128 are positioned in vertical operational orientation and securely connected with mobile support structure 1200. Ramps 1242 of extended base 1232 are deployed in operational position to accommodate material delivery to the system, maintenance, additional equipment rig up, subsequent disassembly of the overall system, and the like. Gooseneck portion 1206 of the mobile support structure 1200 is lowered to form a ramp to enable accommodation of a blending system, or other equipment, within the passage 1230. Silo bases 630 are disposed upon and securely connected to extended base 1232 at one end, and connected with modular silo frames 634 by load cell pins on the opposing end at positions 712 and 714. The load cell pins may enable real time monitoring of material volume, discharge rate, filling rate, and the like, of the modular silo 132. Modular silo 132 may be further coupled with a conveyor assembly, such as that shown in FIG. 16 by numerical indicator 458, or any other suitable conveyor system, for delivering material to the modular silo 132.

Figure 33:
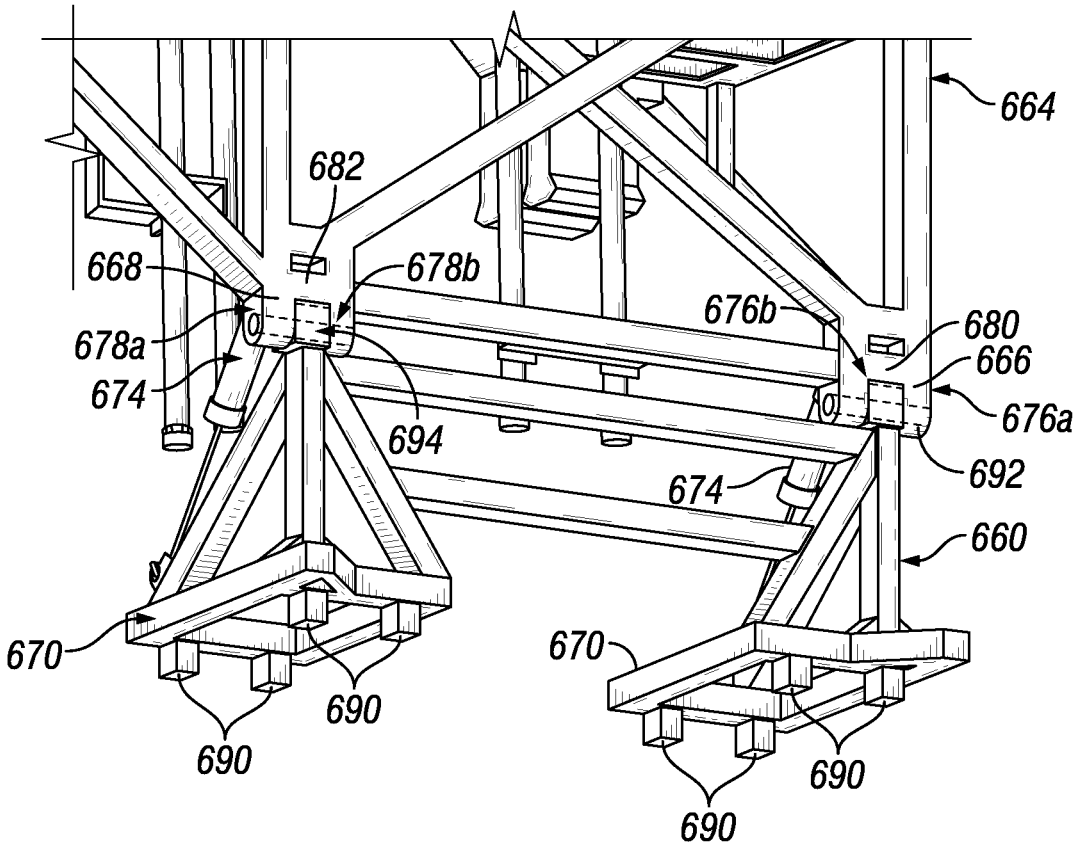
FIG. 33 illustrates a silo base connected to clevis structures at the bottom of a silo, according to an embodiment of the disclosure.

Referring to FIG. 33, which illustrates silo base 660 connected to clevis structures 680 and 682 at the bottom of a silo, such as 658 shown in FIGS. 1B and 2B. The modular silo has a silo frame 664 which may be movably connected with a silo base 660. The silo frame 664 supports a silo housing, and is movably connected with silo base 660 at distal positions 666 and 668. Silo base 660 includes a bottom 670. Bottom 670 and silo frame 664 may be connected together by a tie 674 (two shown), such as a chain, cable, hydraulic cylinder, pneumatic cylinder, strut and the like. In the illustration, tie 674 is shown as a hydraulic cylinder. Tie 674 may be useful to secure and/or stabilize base 660 during the transport, the erecting, and/or operation of the modular silo.

As indicated above, silo base 660 and modular silo frame 664 movably connect at general positions 666 and 668. The connection may be made with any suitable device. In some embodiments, flanges 676*a*, 676*b*, 678*a*, and 678*b* of clevis connection structures 680 and 682 include cylindrical openings defined therein, while complimentary cylindrical openings are formed in flanges 692 and 694 on silo base 660. Silo frame flanges 676*a* and 676*b* envelop silo base flange 692 and when aligned, cylindrical openings in flanges 676*a*, 676*b* and 692 are substantially positioned on an axial centerline. Likewise, flanges 678*a* and 678*b* envelop flange 694 and respective cylindrical openings therein are substantially positioned on an axial centerline. A connector is disposed in the cylindrical openings formed in flanges 676*a*, 676*b* and 692, and another connector disposed in the cylindrical openings formed in flanges 678*a*, 678*b* and 694. The cylindrical openings are indicated in FIG. 33 by the dashed/dotted lines. Any suitable device to enable a movable connection may be disposed in the cylinder, including, but not limited to pins, axles, pins, screws and the like. In some embodiments, load cell pins are utilized, such as load cell pin 680 shown in FIG. 28. Base 660 may further include base extensions 690 (eight shown), useful for connecting and interlocking with a mobile base.

Figure 34:
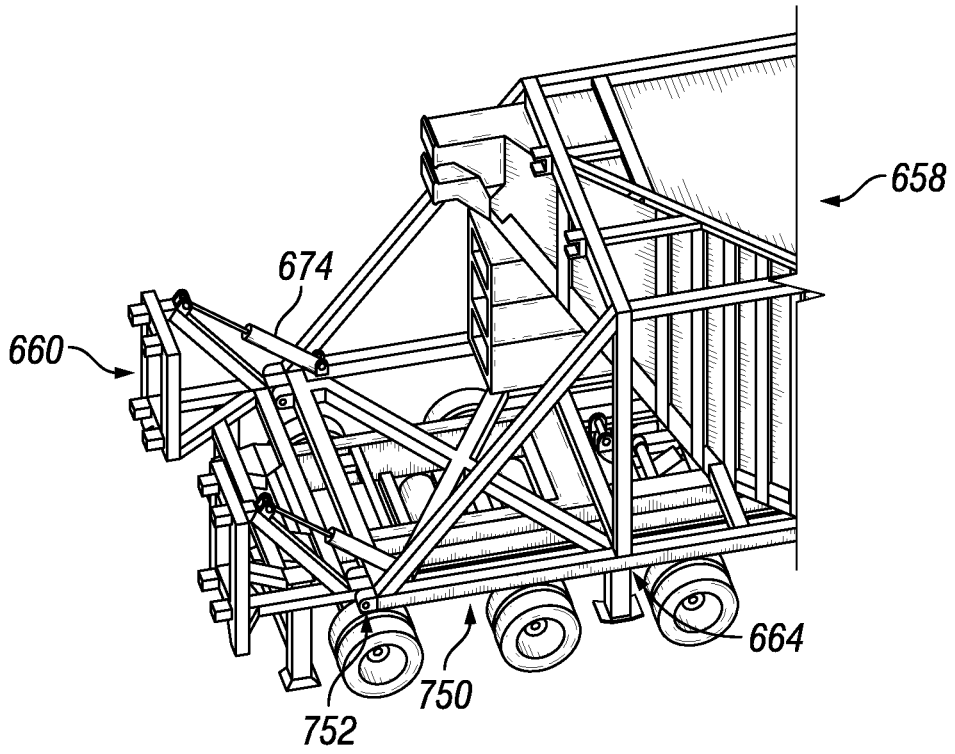
FIGS. 34 and 35 illustrate a pivoting silo base stowed by ties for on-road travel, according to some embodiments of the disclosure.
Figure 35:
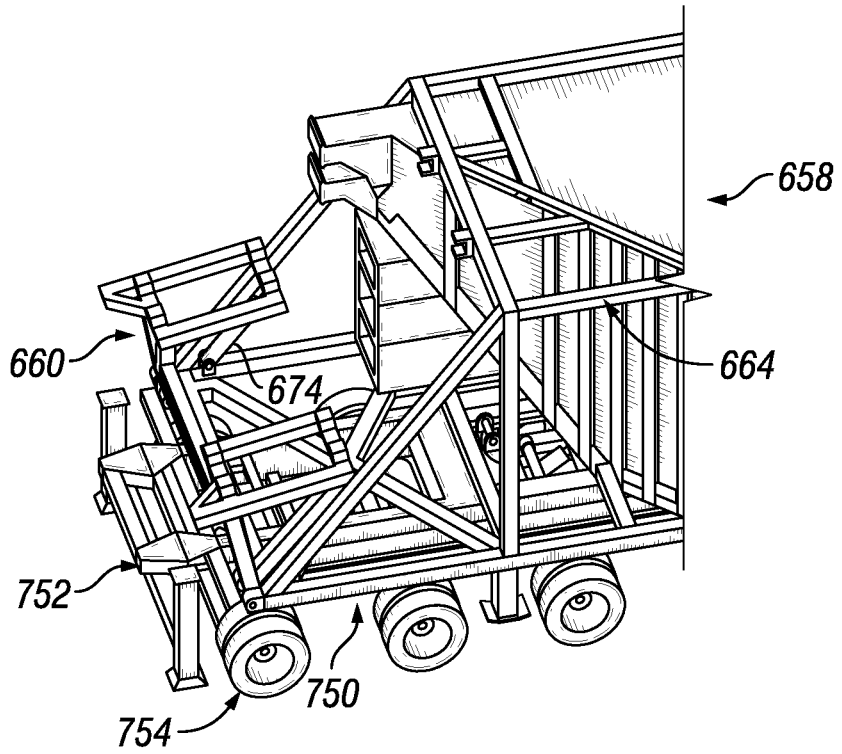

FIGS. 34 and 35 illustrate pivoting silo base 660 being stowed by ties 674, which may be hydraulic cylinders, for on-road travel, according to some embodiments of the disclosure. Modular silo 658 including a silo frame 664 and silo base 660 disposed on a trailer 750 in a lateral, e.g. horizontal, stowed positions for transportation. FIG. 34 shows a first position, and FIG. 35 shows a second position. Ties 674 are securely attached to frame 664, and tensioned in order to maintain the position of silo base 660 as well as prevent base 660 from pivoting down onto the ground when in the stowed position. In a first position, silo base 660 is in position extending beyond end 752 of trailer 750. In some cases where regulations do not permit base 660 to extend past the end 752 of trailer 750, then base 660 may be positioned nearer silo 658 and held in place by ties 674, as depicted in FIG. 35. Trailer 750 may be backed up to move the laterally positioned modular silo 658 into position relative a corresponding silo receiving region, such as 1440 in FIG. 12D of mobile support structure 1400. Wheels 754 may be moved onto ramps 1442 and then extended base 1432. Wheels 702 may engage wheel guides 1444 and wheel chocks 1446 to help ensure alignment of trailer 750 to the silo receiving region 1440. Furthermore to aid in the proper alignment, extended base 1432 may also serve as a reference elevation for the trailer 750.

Figure 36:
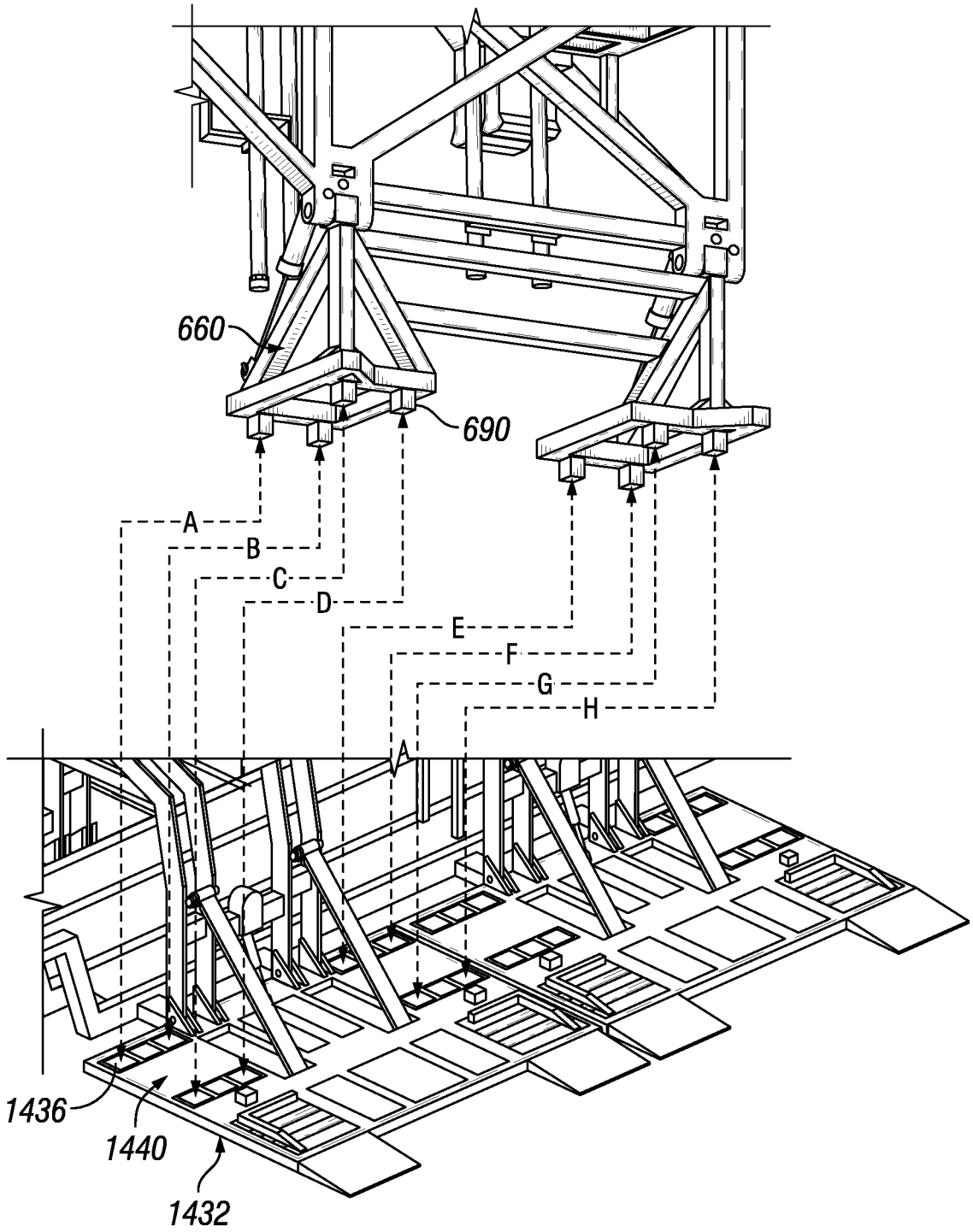
FIG. 36 depicts a male-to-female interlocking connection system for a pivoting silo base and an extended base of a mobile support structure, according to an embodiment of the disclosure.

Now referencing FIG. 36 which depicts a male-to-female interlocking connection system for a pivoting silo base and an extended base of a mobile support structure. Silo base 660 is an interlocking framework design which includes juts 690 (eight shown) extending from the bottom of silo base 660. Extended base 1432 includes receiving region 1440, as well openings 1436 (eight shown) in the framework, the openings disposed in receiving region 1440 for receiving and interlocking with silo base juts 690. Respective juts 690 and openings 1436 align and interlock as shown with dash-dot-dot lines A through H.

Figure 37:
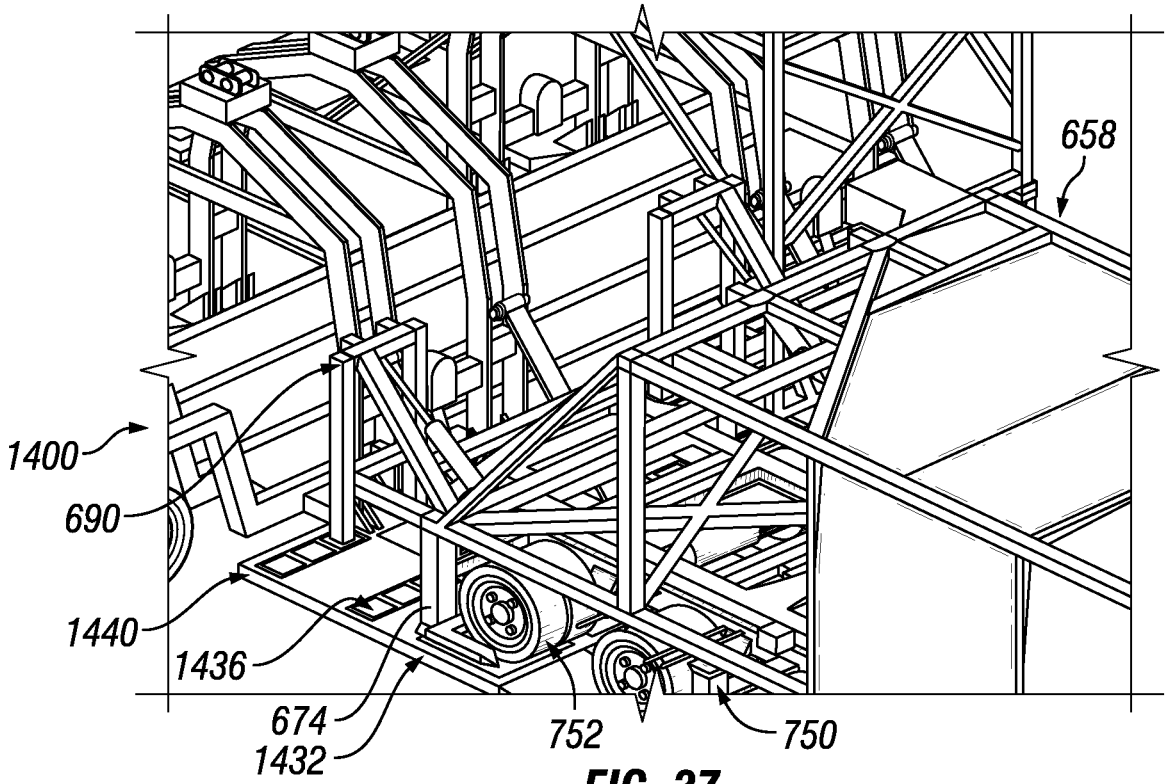
FIG. 37 shows a modular silo in a lateral stowed orientation on trailer docked upon an extended base, according to an embodiment of the disclosure.
Figure 38:
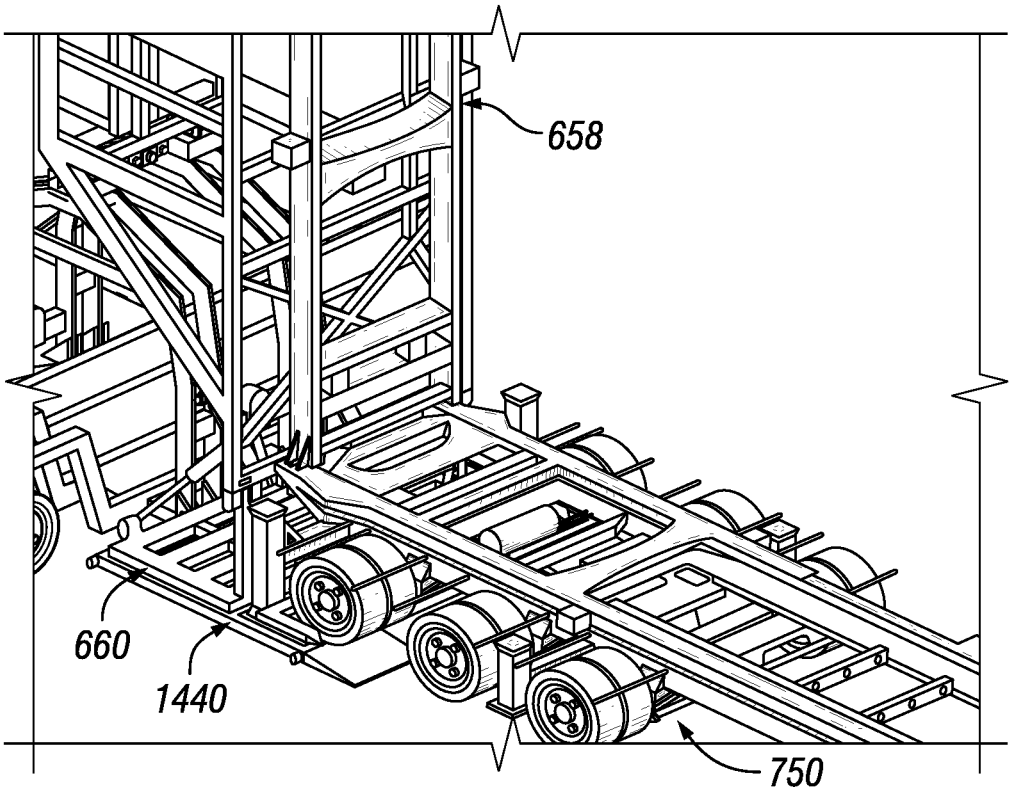
FIG. 38, illustrates a modular silo in an upright position moved from a lateral position on trailer, according to an embodiment of the disclosure.
Figure 39:
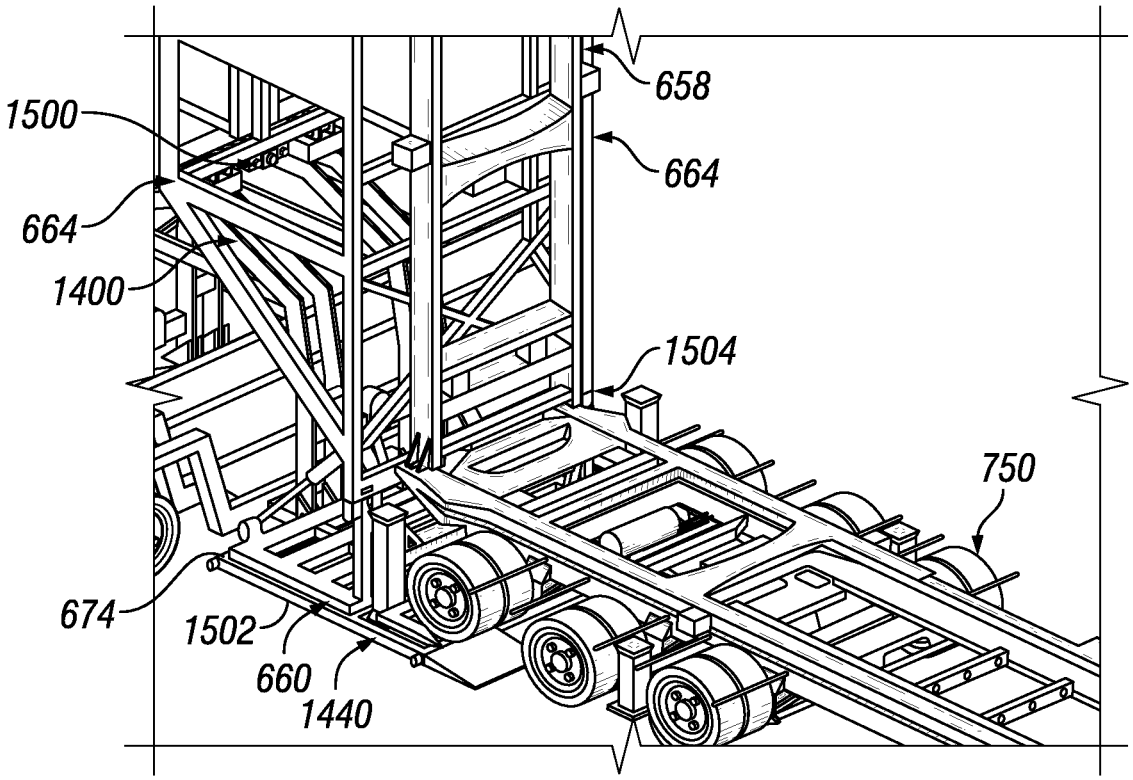
FIG. 39 depicts a silo base lowered and connected with a receiving region, and a modular silo in an upright position, according to an embodiment of the disclosure.

Referring now to FIG. 37 which shows modular silo 658 in a lateral stowed orientation on trailer 750 which is docked upon extended base 1432 of mobile support structure 1400, and ready to erect silo 658. Wheels 752 of trailer 750 are positioned upon extended base 1432, and silo base 660 in a stowed position is proximate receiving region 1440. While modular silo 658 is still in lateral position and trailer 750 positioned upon extended base 1432, before erecting modular silo 658, ties 674 may be utilized to move pivoting silo base 660 upon receiving region 1440, thus allowing juts 690 and openings 1436 to engage, interlock and be secured within receiving region 1440. Turning to FIG. 38, modular silo 658 is in an upright position moved from a lateral position on trailer 750. Modular silo 658 may erected from the lateral stowed position to the upright position by any suitable device including a ram, crane, pulleys, combinations thereof, and the like. Silo base 660 is shown positioned slightly above receiving region 1440, in an orientation ready to be lowered and connected with receiving region 1440. FIG. 39 illustrates silo base 660 lowered and connected with receiving region 1440, and modular silo 658 in an upright position. Silo frame 664 is attached to mobile support structure 1400 at connection 1500. In those embodiments where ties 674 are hydraulic cylinders, and load cell pins connect silo base 660 with silo frame 664 at positions 1502 and 1504, hydraulic pressure within the cylinders may be bled off to avoid interference with load cell readings.

Figure 40:
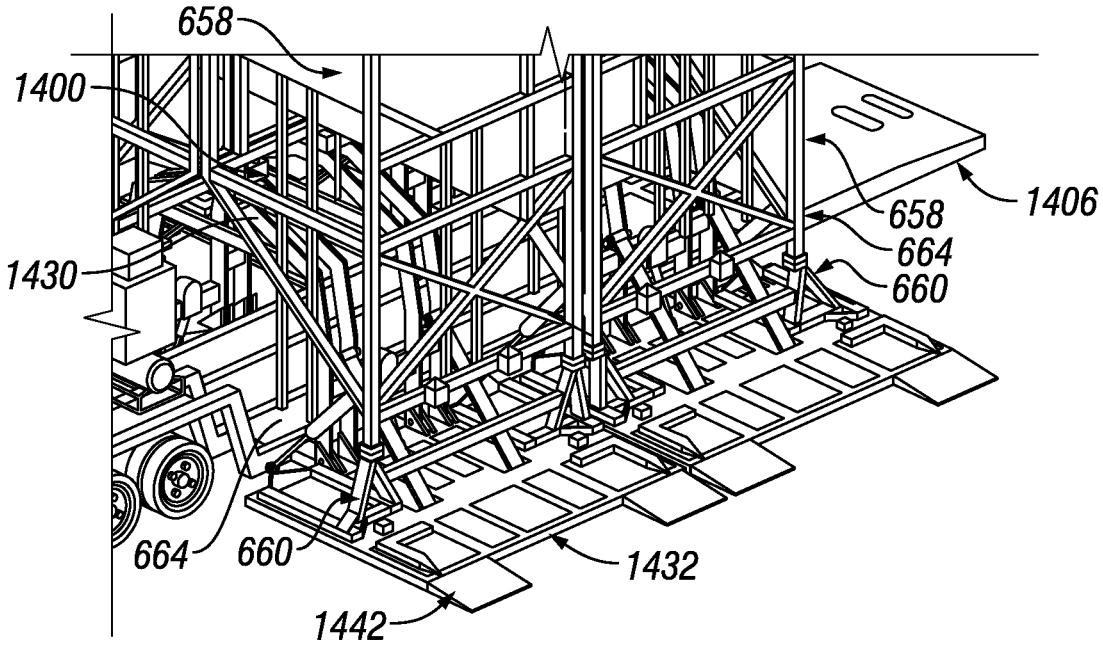
FIG. 40 illustrates another mobile material delivery system in an upright operational orientation integrated with a mobile support structure, according to some embodiments of the disclosure.

Now referencing FIG. 40, which illustrates another mobile material delivery system including modular silos 658 in upright operational orientation, and integrated with a mobile support structure 1400, according to some embodiments of the disclosure. Modular silos 658 are positioned in vertical operational orientation and securely connected with mobile support structure 1400. Ramps 1442 of extended base 1432 are deployed in operational position to accommodate material delivery to the system, maintenance, additional equipment rig up, subsequent disassembly of the overall system, and the like. Gooseneck portion 1406 of the mobile support structure 1400 is lowered to form a ramp to enable accommodation of a blending system, or other equipment within the passage 1430. Silo bases 660 are disposed upon and securely connected to extended base 1432 at one end, and connected with modular silo frames 664 by load cell pins, as depicted in FIG. 33. The load cell pins may enable real time monitoring of material volume, discharge rate, filling rate, and the like, of the modular silos 658. Modular silos 658 may be further coupled with a conveyor assembly, such as that shown in FIG. 16 by numerical indicator 458, or any other suitable conveyor system, for delivering material to modular silos 658.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for positioning a mobile support structure at a desired well site location, comprising:

(i) transporting the mobile support structure to the desired well site location, the mobile support structure comprising:

a support base having a first end and a second end, a top surface and a bottom surface, a first side and a second side, the bottom surface for engaging the mobile support structure with a ground surface at the well site;

a frame structure coupled to the support base, the frame structure having a plurality of silo receiving regions each positioned to receive a modular silo;

a first extended base having a framework design, the first extended base connected with the first side of the support base and extending substantially vertically and adjacent to the frame structure; and a second extended base having a framework design, the second extended base connected with the second side of the support base and extending substantially vertically and adjacent to the frame structure, the first and second extended bases having alignment guides;

(ii) deploying the first extended base and the second first extended base into an operation position, wherein deploying comprises moving the first extended base and the second extended base to extend substantially horizontally from the frame structure;

(iii) using a powered vehicle to move a corresponding modular silo along the alignment guides of each of the first and second extended bases to engage each corresponding modular silo with the mobile support structure; and (iv) pivoting each corresponding modular silo to an upright operational position.

2. The method of claim 1, wherein the first extended base and the second first extended base function as load distributing members.

3. The method of claim 1, wherein the first extended base and the second first extended base function as mobile support structure stabilizers.

4. The method of claim 1, further comprising detaching a truck from the mobile support structure.

5. The method of claim 1, further comprising dropping down a deck and a gooseneck portion of the mobile support structure.

6. The method of claim 1, further comprising positioning a blender between the support base and a modular silo.

* * * * *